US011801535B2

(12) United States Patent
Parr et al.

(10) Patent No.: US 11,801,535 B2
(45) Date of Patent: Oct. 31, 2023

(54) AUTONOMOUS DATA COLLECTION AND SYSTEM CONTROL FOR MATERIAL RECOVERY FACILITIES

(71) Applicant: Emerging Acquisitions, LLC, Eugene, OR (US)

(72) Inventors: Christopher Parr, Eugene, OR (US); Thomas Brooks, Eugene, OR (US); James Cole, Eugene, OR (US)

(73) Assignee: Emerging Acquisitions, LLC, Eugene, OR (US)

( * ) Notice: Subject to any disclaimer, the term of this patent is extended or adjusted under 35 U.S.C. 154(b) by 0 days.

(21) Appl. No.: 18/082,358

(22) Filed: Dec. 15, 2022

(65) Prior Publication Data

US 2023/0120932 A1 Apr. 20, 2023

Related U.S. Application Data

(63) Continuation of application No. 17/470,397, filed on Sep. 9, 2021, which is a continuation of application No. 16/247,449, filed on Jan. 14, 2019, now Pat. No. 11,135,620.

(60) Provisional application No. 62/640,779, filed on Mar. 9, 2018, provisional application No. 62/616,801, filed on Jan. 12, 2018, provisional application No. 62/616,692, filed on Jan. 12, 2018.

(51) Int. Cl.

| | |
|---|---|
| ***B07C 5/36*** | (2006.01) |
| ***B07B 1/14*** | (2006.01) |
| ***B07C 5/342*** | (2006.01) |

(52) U.S. Cl.

CPC ..... *B07C 5/362* (2013.01); *B07B 1/14* (2013.01); *B07C 5/342* (2013.01); *B07C 5/3422* (2013.01); *B07C 5/36* (2013.01); *B07C 2501/0054* (2013.01)

(58) Field of Classification Search

CPC ..... B07C 5/362; B07C 5/342; B07C 5/36; B07C 5/3422; B07C 2501/0054; B07B 1/14

See application file for complete search history.

(56) References Cited

U.S. PATENT DOCUMENTS

| | | | |
|---|---|---|---|
| 3,888,351 | A | 6/1975 | Wilson |
| 5,263,591 | A | 11/1993 | Taormina |
| 7,763,820 | B1 | 7/2010 | Sommer, Jr |

(Continued)

*Primary Examiner* — Patrick H Mackey

(74) *Attorney, Agent, or Firm* — Schwabe, Williamson & Wyatt, PC

(57) ABSTRACT

The present disclosure provides methods and systems for autonomous data collection and system control of a material recovery facility (MRF). A control system receives data from set of sensors that reflect a status of the MRF. The control system determines an operating status of various MRF components (e.g., material handling units (MHUs), sensors, and/or other elements) and/or a composition of a waste stream being processed by the MRF. The control system controls MHU(s) based on the data to optimize the recovery and/or purity of recoverable materials from the waste stream. The control system may rearranging MHUs within the MRF and/or re-tasking individual MHUs to perform different handling functions. Machine learning (ML) and/or artificial intelligence (AI) mechanisms can be used to optimize the operation of the MRF in an autonomous fashion. Other aspects are also disclosed.

20 Claims, 11 Drawing Sheets

(56) References Cited

U.S. PATENT DOCUMENTS

| | | | | |
|---|---|---|---|---|
| 7,893,378 | B2 | 2/2011 | Kenny | |
| 8,459,466 | B2 | 6/2013 | Duffy | |
| 10,137,573 | B2 | 11/2018 | Davis | |
| 11,135,620 | B2 * | 10/2021 | Parr | B07C 5/362 |
| 2006/0085212 | A1 * | 4/2006 | Kenny | B03B 9/06 705/308 |
| 2022/0080466 | A1 | 3/2022 | Parr | |

* cited by examiner

AUTONOMOUS DATA COLLECTION AND SYSTEM CONTROL FOR MATERIAL RECOVERY FACILITIES

CROSS-REFERENCE TO RELATED APPLICATIONS

The present application is a continuation of U.S. application Ser. No. 17/470,397 filed on 9 Sep. 2021, which is a continuation of U.S. application Ser. No. 16/247,449 filed on 14 Jan. 2019, which claims priority to U.S. Provisional App. No. 62/616,692 filed on 12 Jan. 2018, U.S. Provisional App. No. 62/616,801 filed on 12 Jan. 2018, and U.S. Provisional App. No. 62/640,779 filed on 9 Mar. 2018, the contents of each of which are hereby incorporated by reference in their entireties.

FIELD

The present disclosure relates to management of waste handling facilities. Specifically, the present disclosure provides automated control of solid waste facilities, including sorting recyclable from non-recyclable materials and facilitating the creation of high purity recyclable products with minimal human intervention.

BACKGROUND

Material Recycling or Material Recovery Facilities (MRFs) can separate various types of human-generated solid waste, which may be delivered in a single consolidated waste stream, into recyclable and non-recyclable waste streams in order to reduce land fill use and reuse raw materials for new products. For example, recyclable solid waste materials may include plastic film, paper, old corrugated cardboard (OCC), plastic, aluminum, steel, and glass containers, among other materials. These recyclable materials may be separated from other types of waste that may include wood, concrete, rocks, organic waste, and the like.

DETAILED DESCRIPTION

1. Material Recovery Aspects

Figure 1:
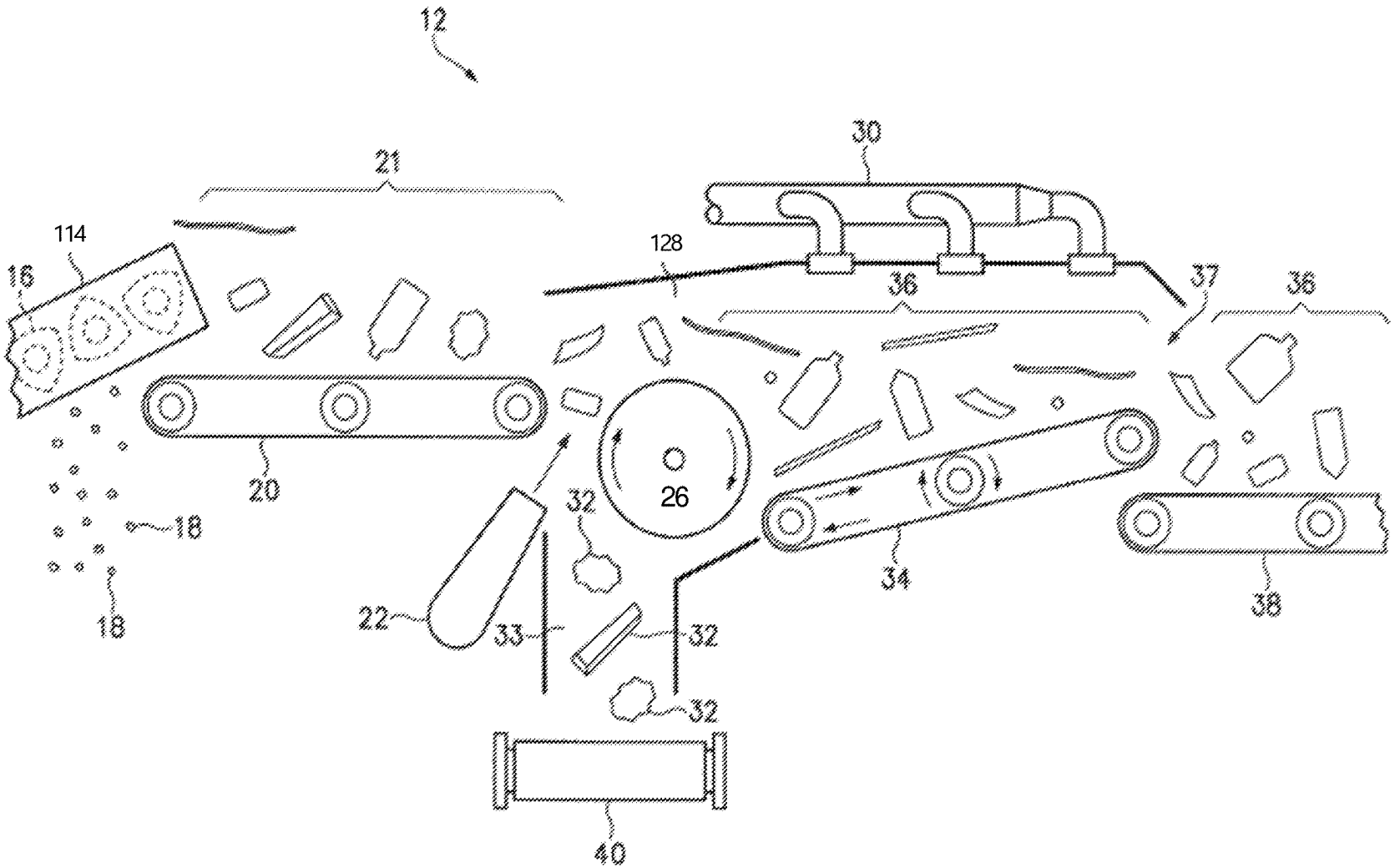
FIG. 1 depicts a side view of an air separator used for separating recyclable solid waste material from other solid waste material that implemented in an example MRF.

Human created waste materials include both two dimensional (2D) materials/objects and three dimensional (3D)

materials/objects. Examples of 2D materials/objects include, but are not limited to, fiber material (e.g., newspaper, mixed paper, paperboard, old corrugated cardboard (OCC), corrugated fiberboard, other cardboard, and/or office paper products), plastics, foils, films, sheets, and/or any other substantially sheet-like materials and/or relatively flat objects. Examples of 3D materials/objects include, but are not limited to, relatively light plastic containers, metal containers (e.g., aluminum, tin, tinplate, copper, steel, and/or the like), glass containers, and/or the like. It should be understood that 2D objects are, in fact, 3D in nature, and as used herein, the terms "two dimensional" and "2D" refer to objects that are substantially flat, where the length and width dimensions substantially outweigh the depth dimension and/or objects with negligible depth dimensions that can effectively be disregarded. 2D and/or 3D waste materials, collected together, can form a solid waste stream. Many materials in a material stream can be recovered and recycled, used for making new products, or used for energy sources. As used herein, "recoverable", "recovered", "recyclable", "recycled", "reusable", and "reused" all connote essentially the same idea: a solid waste material that has a potentially economically valuable use or uses following disposal other than being shipped to a landfill.

However, a solid waste stream, such as those that come from a municipality, residential and/or commercial settings, co-mingled residential and commercial recycling, single stream recycling, secondary commodity recycling, engineered fuel applications, organic waste, compostable waste, construction and demolition processing (C&D) waste, industrial waste, municipal solid waste (MSW), or refuse derived fuel (RDF), and/or any other source of solid waste that may include materials useful for secondary purposes, often also includes contaminants such as debris, and other materials that have no feasible reuse and so need to be disposed in a landfill or other suitable disposal facility. These contaminants, if present with recoverable materials, can prevent reuse of the recoverable materials and instead result in recoverable materials being disposed with the contaminants. Thus, the ability of a material recovery facility (MRF) to separate by size, physical characteristic and chemical makeup is vital to limiting the amount of contaminants found in the final recovered commodity, maximizing the amount of commodity that can be recovered, and minimizing the amount of material that is sent to a landfill.

For many applications, disc or ballistic screens are used in the materials handling industry for processing large flows of materials, and classifying what is normally considered debris or residual materials from recoverable commodities. However, the recyclable materials may need to be separated from other types of waste that have similar sizes and/or shapes. Thus, existing screening systems that separate materials solely according to size may not effectively separate certain solid waste recyclable materials.

It also may be desirable to separate different plastic films, such as garbage bags, from fiber material, such as paper and cardboard. However, all of these solid waste materials are relatively flat, thin and flexible. These different plastic and fiber materials are all relatively thin and light weight and have a wide variety of different widths and lengths. Even objects that are the same material can take different shapes and sizes by the time they arrive at the recycling center. This creates the need for a system that can also separate the materials according to density and chemical makeup.

Further still, a modern MRF that handles solid waste may need to change the targeted commodities on a day to day, or even minute to minute, basis. Conventional MRFs change their sorting capabilities by adjusting mechanical and automated sorters as well as by way of communication with the plant staff. The values of the recovered materials can vary greatly depending on the nature and amount of contamination. Current processes rely on a certain amount of human sorters to clean the commodities and remove prohibitive objects, with the amount of manpower required being proportional to the system throughput of the MRF, and contaminant amount of the solid waste stream to be processed.

The term "material recovery facility" or "MRF", as used herein, connotes any facility that can accept a solid waste stream for processing to separate recoverable materials from non-recoverable materials. The particular configuration and equipment of a given MRF may vary depending upon the specific waste stream intended to be processed by the MRF, as well as the intended recipient(s) of the final recovered material stream or streams. In some examples, a MRF may supply at least one recovered material stream and a residual stream, where the residual stream may include other recoverable materials for which the MRF is not equipped to process. In other examples, a single MRF may be able to output multiple streams of recoverable materials, with a final residual stream comprised nearly or entirely of unusable materials to be sent to a landfill or other suitable final disposal facility. Disclosed embodiments are intended to be applicable to any and all such configurations.

The solutions discussed herein allow for automated and intelligent sorting and cleaning of material waste streams resulting from initial mechanical separation via air and/or screen. By using a combination of one or more of size, density, shape characterizations, visual and/or infrared identification, and automated quality control stations, human staffed positions can be minimized and the plant can be dynamically configured to accommodate waste streams of a fluctuating nature and composition, thereby allowing the plant to be operated more efficiently over longer periods of time. In some cases, the automated and intelligent sorting mechanisms discussed herein can enable fully automated MRFs (sometimes referred to as "lights-out facilities") where material streams are processed with little to no human intervention, for example, only requiring one to two maintenance personnel that oversee the MRF operations. Moreover, disclosed implementations employ techniques such as machine vision and object recognition, potentially fed by different sensor technologies, such as infrared (IR), ultraviolet (UV), visible light, magnetic, chemical, and similar such sensors, to increase separation accuracy (either in initial air separation or in subsequent processing of recyclable streams following initial separation) to further purify and/or maximize recovery of separated recyclable waste streams. This increased purity thus can result in a more valuable recyclable waste stream, while increased recovery can result in a greater amount of recovered recyclable materials, likewise increasing its overall value.

Figure 2:
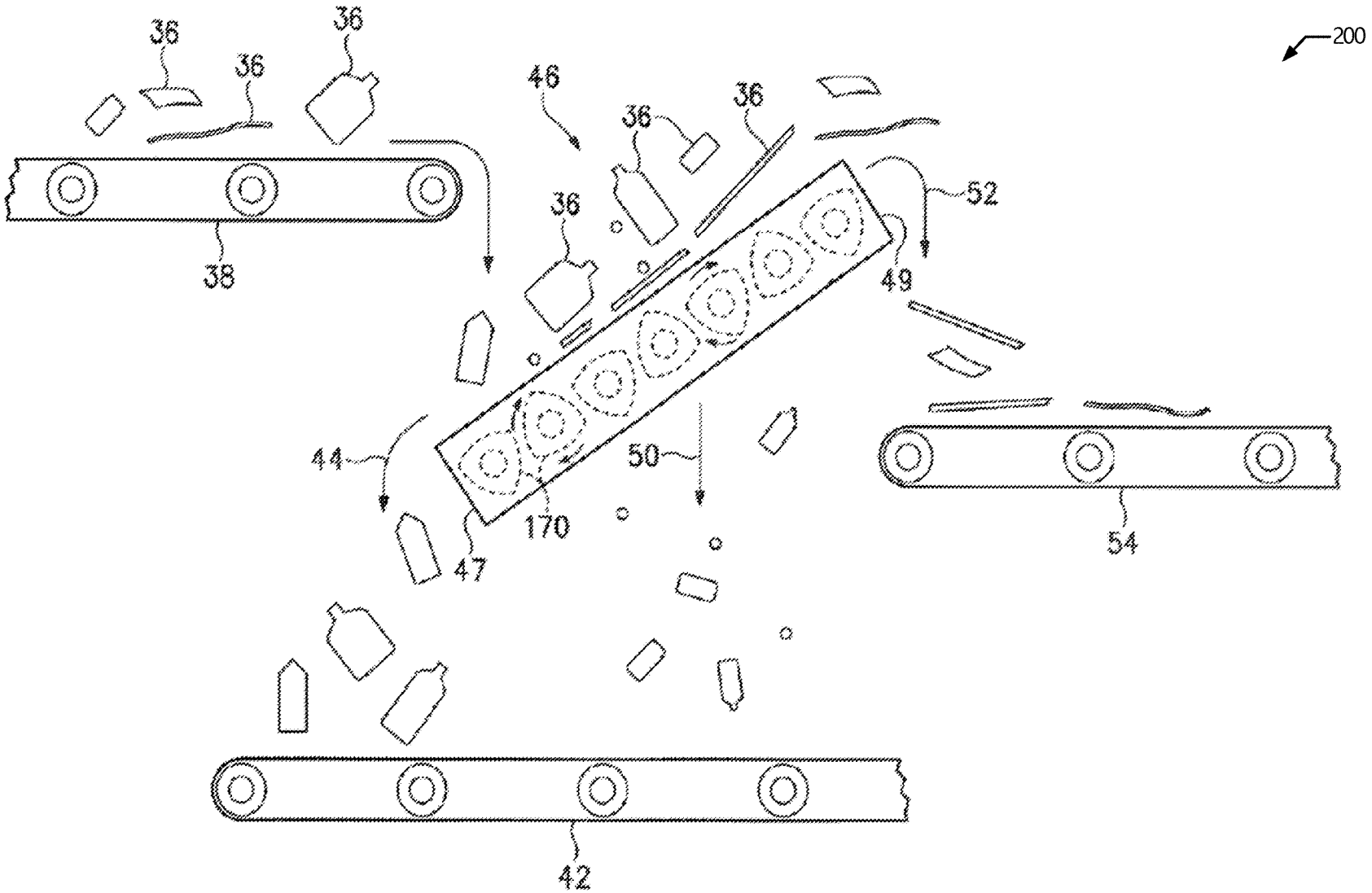
FIG. 2 depicts a side schematic view of a separation screen used for further separating the solid waste recyclable material output from the air separator shown in FIG. 1.

FIGS. 1 and 2 depict example components of a modern MRF. In the example of FIG. 1, an air separation system 12 separates out the recyclable solid waste materials 36 from other solid waste material 32, based on weight vs surface area. The lightweight materials in this case contain a high majority of the high value recyclable materials while heavier solid waste falls down the chute and onto the conveyor shown. These lightweight materials are transported, in the depicted embodiment, to a separation screen 46 shown in FIG. 2. The disc screen is utilized to separate the material by shape; with the light recyclable materials moving up the screen in a vertical direction. However, other types of screens may be used in other implementations. Additionally or alternatively, another separation screen, trommel, ballistic, or some other type of separation system is used for removing small items from the solid waste prior to the density separation to capture small organic material.

In FIG. 1, the air separator 12 includes an air chamber 28 that receives solid waste 21 from a conveyor 20. In one embodiment, the solid waste 21 is the waste typically retrieved from residential and office trash containers and bins. A fan 22 pulls relatively light recyclable solid waste 36 over the top of a drum 26 into the air chamber 28 and onto a conveyor 34. This is accomplished by taking more air out of the air chamber 28 than is returned by the fan 22. Heavier solid waste 32 falls down chute 33 onto a conveyor 40. In one embodiment, the drum 26 rotates to help carry the lighter recyclable solid waste items 36 over drum 26 and onto conveyor 34. The recyclable solid waste items 36 are carried up through air chamber 28, out opening 37, and dropped onto a conveyor 38.

As examples, the solid waste 21 includes, but is not limited to, food, bottles, paper, cardboard, jars, wrappers, bags, other food containers, and/or any other items that may be thrown away in a home, office, and/or the like. In some examples, waste streams may include a combination of both non-recyclable and recyclable materials. Additionally or alternatively, the light recyclable solid waste materials 36 may include, for example, paper products (e.g., newspaper, junk mail, office paper, receipts, cardboard, and/or the like), plastic products (e.g., plastic bottles, bags, jugs, and/or other plastic containers), and/or metal containers (e.g., cans and/or other containers made of aluminum, tin, steel, various alloys, and/or the like).

The heavier solid waste material 32 can include rocks, concrete, food waste, wood, or any other type of material that has a relatively heavier weight than the recyclable solid waste materials 36. Alternatively, some of the solid waste material 32 may have weights comparable with the weight of the lighter recyclable solid waste items 36. However, the combination of weight and a relatively small surface area may prevent sufficient air pressure to be produced underneath some of the materials 32, preventing these materials from being blown into air chamber 28. These items also fall down through chute 33 onto conveyor 40.

There may be some recyclable items in heavy solid waste 32. However, the majority of the recyclable solid waste items 36 referred to above that include paper and cardboard fiber materials, plastic films, and relatively light plastic and metal containers are typically blown over drum 26 and carried by conveyor 34 through air chamber 28 and out the opening 37. Recyclable items in heavy solid waste 32 may be subsequently removed from non-recyclable items using various other sorting mechanisms, such as one or more robotic sorters (e.g., robotic sorters 304 in FIG. 3), one or more optical sorters (e.g., optical sorters 306 in FIG. 3), and/or one or more additional air systems (e.g., air systems 308 in FIG. 3). In some implementations, conveyor 40 may carry heavy solid waste 32 to these additional sorters. In other implementations, these additional sorters may be disposed at the end or outfall of chute 33.

The air flow inside of chamber 28 promotes the movement and circulation of the lighter recyclable solid waste items 36 over the top of drum 26 and out of the opening 37. The fan 22 can be connected to air vents 30 located on the top of chamber 28 in a substantially closed system arrangement. The fan 22 draws the air in air chamber 28 back out through air vents 30 and then re-circulates the air back into air chamber 28. A percentage of the air flow from fan 22 is diverted to an air filter (not shown). This recycling air arrangement reduces the air-pressure in air chamber 28, further promoting the circulation of light recyclable solid waste materials 36 over drum 26 and out opening 37.

The negative air arrangement of the air recirculation system can also confine dust and other smaller particulates within the air chamber 28 and air vents 30. A filter (not shown) can further be inserted at the discharge of fan 22 such that a percentage of the air from the fan is diverted to a filter (not shown) to further remove some of the dust generated during the recycling process.

Current air separation systems only separate non-recyclable materials used for shredding and burning from other heavier materials. For example, air separation systems have been used for separating wood from other non-burnable materials such as concrete, rocks, and metal. Solid waste recyclable materials are already separated out prior to being fed into air separation systems.

In FIG. 2, the light recyclable solid waste items 36 are carried along conveyor 38 and dropped onto a separation screen 46. In this example, the separation screen 46 includes dual-diameter discs 170 arranged to form particular openings between adjacent disc rows (note that not all discs 170 are labeled in FIG. 2 for the sake of clarity). The discs 170 have arched shapes that when rotated both move the items 36 up the screen 46 while at the same time vibrating the light items 36 up and down in a vertical direction. However, other types of separation screens can also be used. The selection of a particular type or types of separation screen(s) will depend upon the specifics of a given embodiment.

In some applications, disc or vibratory screens are used for classifying what is normally considered debris or residual materials versus recoverable commodities; in these applications, the disc screens can classify material in two distinct ways: sizing (e.g., the screen creates overs and unders sizes, for example, from ¼ inch up to 12 inch) and physical characteristics (e.g., the screen can separate 2D from 3D objects such as, for example, OCC and other fiber materials can be removed from plastic and metal containers).

The combination of gravity, the upwardly inclined angle of separation screen 46, and the shape, arrangement and rotation of discs 170, cause some of the light recyclable solid waste items 44 to fall back down over a bottom end 47 of separation screen 46 onto a conveyor 42. Typically, these solid waste recyclable items 44 include containers such as milk jugs, plastic bottles, beer cans, soda cans, or any other type of container having a shape and large enough size to roll backwards off the bottom end 47 of screen 46.

Other recyclable solid waste items 50 drop through interfacial openings (IFOs) formed between the discs 170 while being carried up separation screen 46. The items 50 falling through the openings in separation screen 46 also fall onto conveyor 42 and typically also include plastic and metal containers. For example, the items 50 may be smaller volume containers. In one embodiment, the opening is 2"×2" but can be larger or smaller depending on the screen design. In another embodiment, where separation screen 46 is configured at 2 inches, the IFO is 1.25"×2.25". It will be understood that varying the IFO size may also impact the size and type of items 50 that pass through separation screen 46.

The remaining recyclable solid waste items 52 are carried over a top end 49 of separation screen 46 and dropped onto a conveyor 54. The recyclable solid waste items 52 often include items with relatively flat and wide surface areas such as plastic bags, plastic films, paper, cardboard, flattened containers, and other types of fiber materials. These waste materials may include other types of fiber materials and plastic film material. These relatively flat recyclable solid waste items have less tendency to topple backwards over the bottom end 47 of separation screen 46 and, further, have a wide enough surface area to travel over the openings between discs 170.

Thus, the combination of the air separator 12 in FIG. 1 and the screen separator 46 in FIG. 2 first separate relatively light recyclable solid waste items 36 from other solid waste material 32 (see e.g., FIG. 1) and then further separate the recyclable solid waste plastic and metal containers 44 and 50 from the recyclable solid waste plastic, paper and cardboard fiber material 52 (see e.g., FIG. 2). With respect to (w.r.t) screen separator 46 in FIG. 2, 3D objects (e.g., cartons, containers, and/or the like) typically will be sorted out, leaving only 2D objects, e.g., paper, foil, films, as described above, coming from screen separator 46 and onto conveyor 54. This process will be described in greater detail herein.

Referring back to FIG. 1, another separation screen 14, trommel, or some other type of separation system can be used for removing small items from the solid waste 21. In some implementations, the screen 14 includes discs 16 arranged to form openings of the same or various sizes that allow smaller materials 18, alternatively referred to as "fines", to drop through the screen 14. These smaller materials 18 can include small rocks, dirt, and/or the like, that might otherwise be blown against different parts of the air separator 12, possibly damaging, or at the least, increasing the wear and tear on the air separator 12. In some implementations, the configuration of screen 14 is similar in nature to screen separator 46 depicted in FIG. 2, with a plurality of discs that form IFOs, through which the smaller materials 18 fall. However, the IFO size, in such implementations, may vary w.r.t the types of materials being separated, viz. "fines" may require a considerably smaller IFO compared to screen separator 46 to allow substantially all solid waste 21 to pass, for later separation as described above w.r.t FIGS. 1 and 2.

FIGS. 1 and 2 depict example configurations that can be used with the MRF aspects discussed herein. The number and configuration of components of an MRF may depend upon a variety of factors, such as, for example, available physical space, materials to be handled, sorting methods employed, and intended output product, among many other possible factors. Further, some possible components not depicted in FIGS. 1 and 2 may be present, some of these additional components are discussed infra w.r.t FIG. 3.

As mentioned previously, once the initial screens remove the fines 18 and heavy contaminants, and separate the recyclables into 2D and 3D objects, the commodities will be separated further and additional contaminants removed. 3D objects typically contain a majority of the plastic bottles, tin and aluminum food and beverage containers. However, many other items in the stream can adopt a 3D shape. For example, 3D objects can include small plastic bags filled with shredded paper, bunched up textiles, cardboard boxes, green waste, kitchen food waste, and/or the like. These type of objects may be transported into the 3D object stream. While human sorters can be used to remove the objects prior to the container separation, automation can take the place of this operation in various implementations, as discussed infra. For example, by utilizing a control system that employs one or more of neural networks, vision cameras and optical sensor arrays, 3D contaminants can be removed without human intervention.

The 2D objects can require additional attention and/or equipment due to the nature of the contaminants. For example, the focus of the additional equipment would be to remove the contamination and refine the paper fiber. The primary sources of contamination are brown OCC, fiber board, plastic film, flattened containers and wet paper (e.g., diapers, napkins, tissue paper, and so forth). Depending on the level of contaminants, they can first be separated by size (e.g., by removing or otherwise separating materials that are smaller than 4 inches in any two dimensions). Other implementations may separate out materials of different dimensions, depending upon a given implementation and specifications for a desired output product. If necessary, in some implementations a second mechanical sort can employ near infra-red light to optically sort the material to purify the fiber. This can be done by removing the paper to create a clean stream or removing the plastic contaminant. These components can be changed on demand or removed from the system design depending on the type and volume of contaminant. This material can be handled in several implementations, including but not limited to conveyor transfer or pneumatic transfer.

Regardless of whether the level of contaminant requires mechanical or optical sorters, in some implementations human sorters may still be employed to inspect the resulting stream, to further refine the materials by removing any browns or missed plastic materials. In other implementations, automation can take the place of this operation. As discussed in more detail infra, by utilizing machine learning (ML) and/or artificial intelligence (AI) mechanisms (see e.g., neural network 1300 of FIG. 13), various sensors (e.g., vision sensors, cameras, and the like), and various sorters (e.g., optical sorters, robotic sorters, and so forth), the cardboard prohibitives or out-throws or plastic contaminants can be removed without human intervention.

Figure 3:
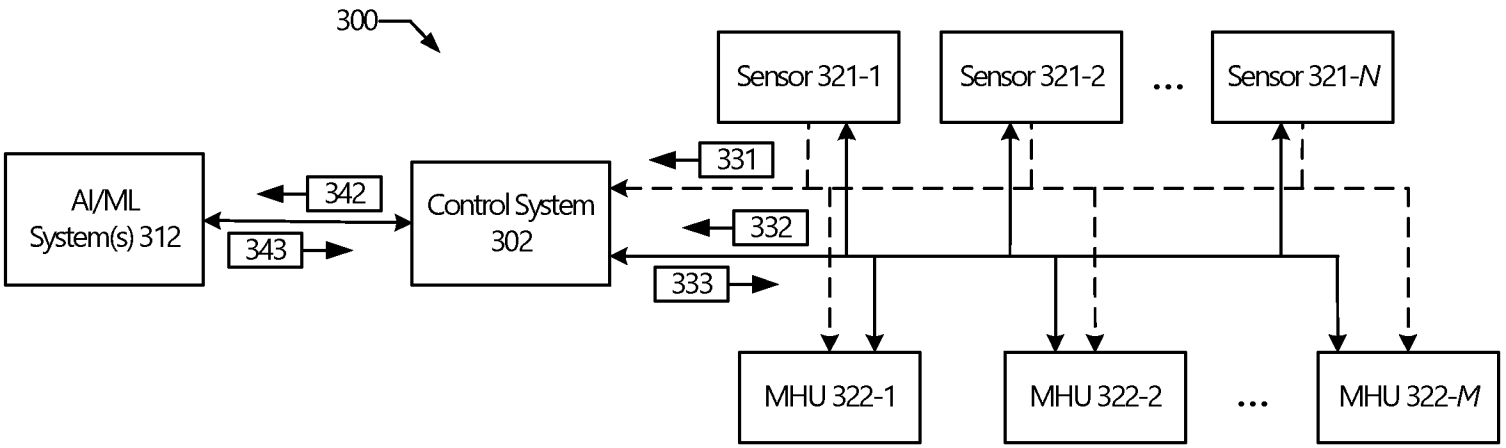
FIG. 3 depicts a system for autonomous data collection and control for a MRF, including a MRF implementing the separators of FIGS. 1 and 2.

FIG. 3 depicts an example MRF system 300 for autonomous data collection and control of an MRF. The MRF system 300 includes a control system 302, which manages, commands, directs, and/or regulates actions and/or behaviors of various components, devices, and/or systems of an MRF using, for example, one or more control loops or other like mechanisms. In particular, the control system 302 receives data from a variety of sources and uses these inputs to control various components, devices, and/or systems of the MRF. The various sources can include a set of sensors 321-1 to 321-N (where N is a number), a set of material handling units (MHUs) 322-1 to 322-M (where M is a number), and/or one or more AI/ML systems 312.

The control system 302 receives inputs (e.g., data streams 331, 332) from some or all components of the MRF and provides autonomous control of the MRF based on those inputs. The control system 302 is embodied as one or more computer devices and/or software that runs on the one or more computer devices to carry out, operate, or execute the techniques disclosed herein. As examples, the control system 302 can be implemented or embodied as a programmable logic controller (PLC), a distributed control system (DCS), a supervisory control and data acquisition (SCADA) system, some other computerized control system, and/or any computing device discussed. In some examples, the control system 302 may include, in whole or in part, custom or purpose-built hardware, such as one or more application-specific integrated circuits (ASICs), field-programmable gate arrays (FPGAs), digital signal processors (DSPs), digital signal controllers (DSCs), electronic control units (ECUs), programmable logic devices (PLDs), discrete circuits, and/or other electronic and/or software implements suitable to a given implementation, or a combination of any of the foregoing. Additionally or alternatively, the control system 302 includes one or more interfaces that connect or communicatively couple the control system 302 to the MRF components 312, 321, 322 for information/data collection, and for providing instructions/commands and/or configurations to the MRF components 312, 321, 322. In some examples, the control system 302 can provide collected data/information to a remote service provider and/or may receive instructions and/or configurations from the remote service provider to carry out the functions of control system 302. The various components/nodes of the MRF system 300 can communicate with one another using any suitable wireless or wired communication protocol, such as any of those discussed herein. Additionally or alternatively, the control system 302 may have the same or similar components as the compute node 1200 discussed infra w.r.t FIG. 12.

In some implementations, the control system 302 is local to the MRF (e.g., on or near the MRF premises), in a remote location, or a combination thereof. Control system 302 may execute on one or more computer devices that are under the control of the MRF owner/operator (e.g., compute node 1200 and/or client device 1250 of FIG. 12), and/or one or more computer devices 1200 that are under the control of a third party. Additionally or alternatively, control system 302 is implemented in whole or in part by software that executes on a remote service provider (e.g., remote system 1290 of FIG. 12), which can include or be part of, for example, a cloud computing service, an edge computing service, a cellular communications service, and/or other service provider that can communicate with a front end or client (e.g., client device 1250 of FIG. 12) under the control of the MRF operator. For example, the control system 302 can be implemented as one or more distributed applications operating within one or more virtualization containers or virtual machines (VMs), where the containers or VMs run on one or more application servers owned/operated by a third-party service provider (e.g., service provider 1290 of FIG. 12), which can include one or more cloud compute nodes of a cloud computing service, one or more edge compute nodes of an edge computing framework, one or more network functions in a cellular network, one or more application servers/platforms, and/or the like. In some implementations, the control system 302 represents individual compute nodes or controllers implemented in individual MHUs 322, which can operate in conjunction with one another to autonomously operate within the MRF (e.g., where the MRF has a distributed architecture or the like). Additionally or alternatively, the control system 302 is implemented as a distributed application, wherein various control system functions (or control system packages) operate on different MHUs 322 and/or sensors 321.

Examples of the sensors 321-1 to 321-N (collectively referred to herein as "sensors 321" or "sensor 321") include image capture devices/image sensors (e.g., visible light cameras, infrared cameras, x-ray sensors, and/or the like), temperature sensors, moisture sensors, and/or other sensors. Additionally or alternatively, the sensors 321 can include any of the sensor devices discussed herein (see e.g., sensors 1241 of FIG. 12). Examples of the MHUs 322-1 to 322-M (collectively referred to herein as "MHUs 322" or "MHU 322") include mechanical separators/sorters, robotic sorters, optical sorters, pneumatic (air) systems/sorters, conveyors, balers, infeed/metering systems, and/or any other general or specialized MHUs that may be employed by an MRF as appropriate to handle solid waste streams. Additionally or alternatively, the MHUs 322 can include any of the actuation devices discussed infra (see e.g., actuators 1242 of FIG. 12). The sensors 321 may be deployed at different locations within the MRF and/or may be individual sensors 321 that are part of one or more MHUs 322. These examples not intended to be comprehensive, but rather exemplary.

The MRF system 300 also includes one or more AI/ML systems 312, which obtains observation data 342, and generates and/or determines inferences 343 that assist the control system 302 in autonomously controlling aspects of the MRF. For purposes of the present disclosure, the term "inference" may refer to a set of inferences, a set of predictions, a set of probabilities, a set of detected patterns, optimized parameters or configuration data, a set of actions/tasks to be performed, and/or any other output of one or more AI/ML models. Examples of the AI/ML system(s) 312 can include supervised learning techniques, semi-supervised learning techniques, unsupervised learning techniques, reinforcement learning techniques, dimensionality reduction techniques, meta learning, deep learning (e.g., based on neural networks and the like), anomaly detection, artificial intelligence applications, and/or any other suitable AI/ML mechanisms/techniques, such as any of those discussed herein. Additionally or alternatively, the AI/ML system(s) 312 can include data mining, optimization functions, generalization functions, and/or statistical analyses, even though these concepts are sometimes considered to be separate from ML.

The AI/ML system(s) 312 can be implemented separately from the control system 302 or as part of the control system 302. In one example, the control system 302 operates one or more model(s) and/or algorithm(s) of the AI/ML system(s) 312. In another example, a host compute node (e.g., inference/prediction host) operates the model(s)/algorithm(s) of the AI/ML system(s) 312. The host compute node may include, for example, one or more network functions (or network access nodes), application functions (or application servers), cloud compute nodes/clusters, edge compute nodes/clusters, and/or other systems/services that host AI/ML models for training (e.g., online or offline learning), and/or detecting patterns and/or producing inferences and/or predictions (e.g., model execution). Additionally or alternatively, the same or different AI/ML model(s)/algorithm(s) of the AI/ML system(s) 312 can be distributed to different MRF components, such that individual AI/ML model(s)/algorithm(s) are implemented by respective MHUs 322 and/or sensors 321. In any of the aforementioned examples, the AI/ML model(s)/algorithm(s) of the AI/ML system(s) 312 can be operated by general-purpose hardware elements and/or ML/AI-specific hardware elements such as hardware accelerators, GPU pools, and/or the like.

The AI/ML system(s) 312 include AI/ML workflows and/or pipelines for building, training (e.g., including self-learning and/or retraining), validating, optimizing, testing, executing and/or deploying AI/ML models that produce inferences that are used to improve MRF design, operational efficiency, recovery efficiency, commodity purity, system optimization, maintenance, and/or the like. In various implementations, the AI/ML system(s) 312 identify recyclables and other commodities for recovery through AI/ML technology (e.g., deep learning and/or the like). In some examples, the AI/ML system(s) 312 employs multi-layered neural networks and machine/computer vision system(s) to identify objects (e.g., recoverable or recyclable materials) in one or more material streams. In these implementations, the AI/ML system(s) 312 is/are able to identify recoverable materials in an MRF by processing image and/or video data fed through a detection pipeline and/or deep learning (DL) neural networks (NNs). The DL NNs are computational ML models based on distributed representations that is/are inspired by the human brain. Additional aspects of such NNs that can be used by the AI/ML system(s) 312 are discussed infra w.r.t FIG. 13.

As alluded to previously, the control system 302 can receive various data streams, which the control system 302 utilizes to adjust various aspects of the MRF. The data streams can includes sensor data 331 obtained from various sensors 321 deployed at various locations within the MRF, and status information 332 (also referred to as "control data 332", "feedback 332", "state data 332", and/or the like) from various MHUs 322. The sensor data 331 can include any measurements, events, and/or other data related to one or more events or phenomena, which may be based on the specific sensing means employed by an individual sensor 321. The status information 332 can include any information related to the operation of respective MHUs 322 and/or sensors 321 including operational states (e.g., active, inactive, idle, sleeping, off, on, and/or the like), parameters and/or conditions of individual components or elements (e.g., compute system measurements, metrics, statistics including any of those discussed herein), maintenance/servicing data/statistics of individual MHUs 322 and/or individual sensors 321, and/or any other measurements and/or metrics to assist with the management of the MRF. Additionally or alternatively, the data streams can include data from other sources including sources outside of the MRF (e.g., sensor data from waste collection vehicles and/or other relevant vehicles, weather report data from weather stations, historical (stored) data collected from sensors 321, historical (stored) data collected from MHUs 322, historical MHU configurations, historical sorting logic settings and/or configurations, and/or the like). Any other data, measurements, metrics, statistics, and/or parameters may be monitored, collected, analyzed, and/or controlled for individual MHUs 322 and/or individual sensors 321 according to implementation and/or use case.

The control system 302 can record and/or store the received data stream data 342 (e.g., including data from data streams 331, 332 and/or other data) for later use, and/or provide the data stream data 342 to the AI/ML system(s) 312 for training and/or generating inferences. The data stream data 342 can include individual data items from the data streams 331, 332, and/or the data stream data 342 can include analyzed, fused, or otherwise processed data based on the received data streams 331, 332 and/or other collected data, measurements, and/or metrics. When used for training AI/ML models, the data stream data 342 may be referred to as "model training information 342", "training data 342", and/or the like. The model training information 342 includes data to be used for AI/ML model training including the inputs data and/or labels for supervised training. When used for generating inferences, the data stream data 342 may be referred to as "model inference information 342", "prediction data 342", "observation data 342", and/or the like. In some cases, the model inference information 342 may overlap with the model training information 342, however these data sets are at least logically different.

As mentioned previously, the AI/ML system(s) 312 builds, trains, optimizes, validates, and/or tests one or more AI/ML models using a training dataset 342. In some implementations, the AI/ML system(s) 312 include AI/ML engine(s) that execute or operate the trained AI/ML models to generate or determine inferences. In these implementations, the AI/ML system(s) 312 provides AI/ML data 343 to the control system 302, which includes configurations and/or data based on the inferences. Here, the AI/ML data 343 is used by the control system 302 to control various aspects of the MRF and/or update/configure individual sensors 321 and/or individual MHUs 322. For example, the control system 302 operations sorting logic to configure and/or arrange the various MHUs 322 and/or sensors 321 to operate as desired, and the AI/ML data 343 may influence or guide the control system 302 in how to adjust, update, or reconfigure of the sorting logic. The changes made to the sorting logic may then influence the control signaling 333 provided to the various MHUs 322 and/or sensors 321. Additionally or alternatively, the control system 302 provides AI/ML data 343 to different sensors 321 and/or MHUs 322 for performing their respective functions.

Additionally or alternatively, the AI/ML system(s) 312 provide trained AI/ML models to respective MRF components 302, 312, 321, 322, and those MRF components 302, 312, 321, 322 execute or operate the trained AI/ML models to produce inferences, optimization parameters, and/or control data for performing their respective functions. In these implementations, the AI/ML data 343 may be an AI/ML package including the models themselves and a model configuration. The model configuration can include information/data for compiling and/or configuring the models for provisioning and/or deployment, such as, for example, model host information (e.g., IDs and other information of the host/component 302, 312, 321, 322 on which the model is to be deployed), requirements for operating the model (e.g., software and/or hardware requirements and/or capabilities), acceptable accuracy and/or loss thresholds, specific operations to be performed, and/or any other relevant information.

In any of the aforementioned implementations, the trained AI/ML models may be the same or different for different MRF components 302, 312, 321, 322. In a first example, a first trained AI/ML model deployed on or otherwise associated with an MHU 322 may be different than a second trained AI/ML model deployed on or otherwise associated with a sensor 321. In this example, the first and second trained AI/ML models may be the same type of models but trained with different training data 342, and the first and second trained AI/ML models may be different types of AI/ML models trained on the same or different training datasets 342. In a second example, a first trained AI/ML model deployed on or otherwise associated with a first MHU 322 may be the same as a second trained AI/ML model deployed on or otherwise associated with a second MHU 322. In this example, the first and second MHUs 322 may be the same type of MHU and/or perform the same or similar functions, and the first and second trained AI/ML models may be trained on the same or similar training datasets 342. In a third example, a first trained AI/ML model deployed on or otherwise associated with a first MHU 322 may be different than a second trained AI/ML model deployed on or otherwise associated with a second MHU 322. Here, the first and second trained AI/ML models may be the same model or same type of model trained using different training datasets 342, or the first and second trained AI/ML models may be different types of ML models. It should be understood that these examples can be straightforwardly applied to the other types of MRF components 302, 312, 321. Furthermore, the type of models deployed on a particular MRF components 302, 312, 321, 322, and the training data used to train those models, may be based on the type and/or capabilities of MRF component 302, 312, 321, 322 to which it is deployed, and/or may be implementation specific or use case-specific.

Regardless of whether the AI/ML models are executed by the AI/ML system(s) 312 or if the AI/ML models are provisioned and deployed to respective MRF components 302, 312, 321, 322, the AI/ML models are used to predict and/or optimize various MRF operational aspects. Here, the AI/ML models generates AI/ML outputs, which includes, for example, inferences, operational configurations and/or parameters, optimization configurations and/or parameters, and/or control tasks and/or actions to be performed. In some examples, the AI/ML outputs are considered to be the "sorting logic" used to manage the material sorting aspects discussed herein. The AI/ML outputs are used by their respective MRF components 302, 312, 321, 322 to update and/or control various MRF aspects.

In a first example, the data stream data 342 and/or other data, measurements, and/or metrics can be used by the AI/ML system(s) 312 to train AI/ML object recognition model(s) to identify recoverable (commodity) materials from waste/material streams based on features extracted from the data stream data 342. The features can be based on the sensor data 331 (e.g., indicated size, shape, color, molecular structure, and/or other properties of the recoverable materials) and/or MHU status information 332 (e.g., MHU capabilities, MHU operational parameters, operational and/or system data/metrics of on-board compute systems, and/or the like). The trained AI/ML object recognition models can then be used by the control system 302 and/or individual MHUs 322 to identify and/or recognize the commodity materials from later obtained data stream data 342, which can then be used by the MHUs 322 to efficiently sort out the desired (commodity) materials from the waste stream and/or other material streams.

Figure 5:
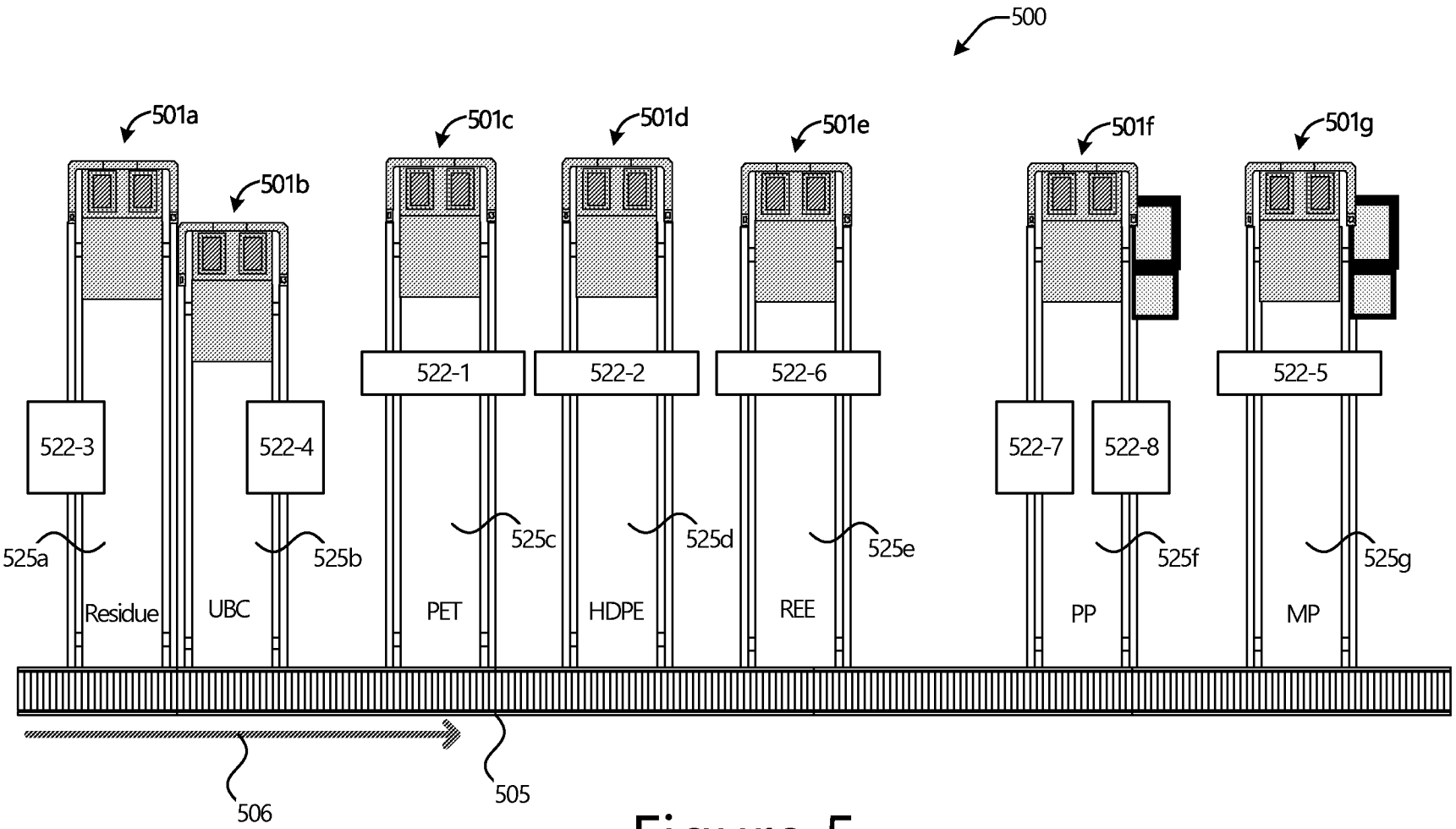
FIGS. 5, 6, and 7 depict example sorting lines for an MRF.
Figure 6:
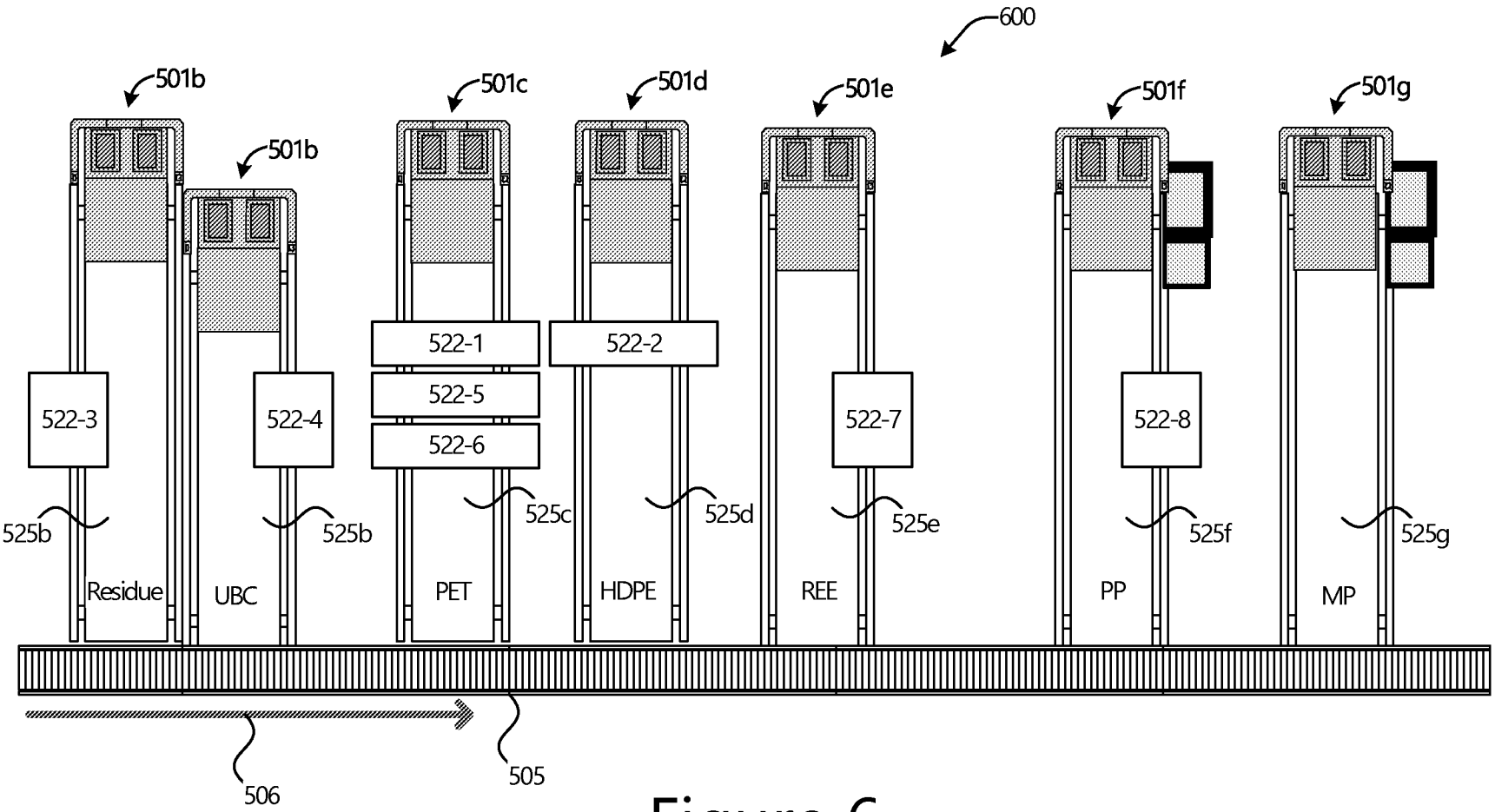
Figure 7:
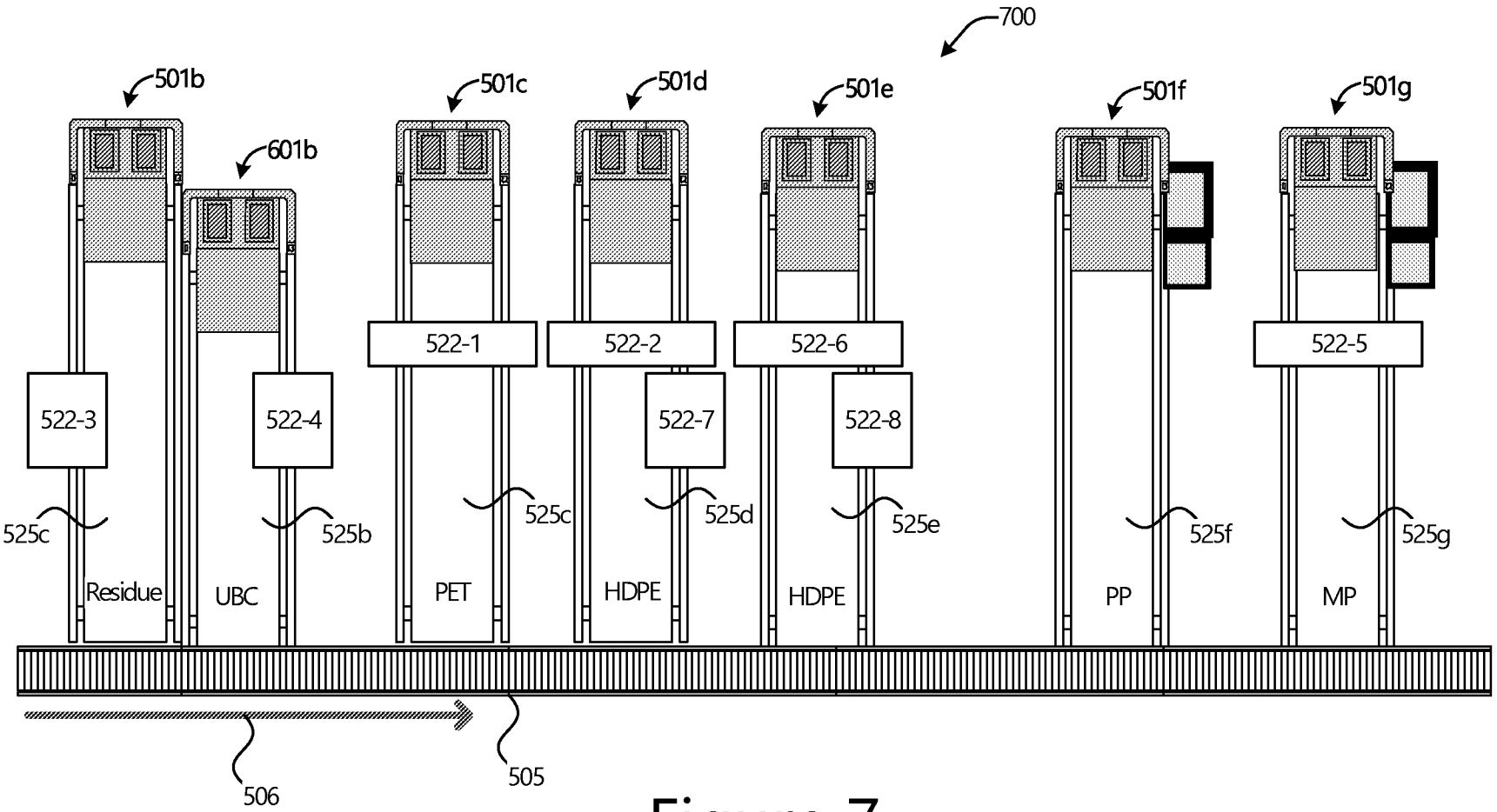

In a second example, the data stream data 342 and/or other data, measurements, and/or metrics can be used by the AI/ML system(s) 312 to optimize the functionality of the set of MHUs 322 and/or optimize the functionality of the MRF system as a whole. Here, the AI/ML system(s) 312 can determine optimal operational parameters 343 for different MHUs 322 and/or other MRF components in the MRF to optimize the sorting of materials out of the waste streams (or other material streams) based on the information from other MHUs 322 and/or the local MRF data streams 331, 332. The operational parameters 343 can include optimizing or otherwise reconfiguring the tasks/actions performed by individual MHUs 322, optimizing or otherwise reconfiguring the types and/or amounts of data collected by individual sensors 321, rearranging individual MHUs 322 and/or individual sensors 321 within the MRF for sorting different materials and/or for load balancing purposes, and/or the like. The rearranging of the MRF components can include taking MRF components offline, and instructing them to be moved to a service area for maintenance and/or testing purposes. Additionally or alternatively, the operational parameters 343 can include autonomous control of material baling and bunker section selection based on material conditions, capacity, and/or the like. In these ways, the MRF components 321, 322 can be configured to work together in an efficient manner to reach a collective target for material recovery and purity. Examples of the second example implementation are shown by FIGS. 5-7.

In a third example, the data stream data 342 and/or other data, measurements, and/or metrics can be used by the AI/ML system(s) 312 to optimize the functionality of individual MHUs 322. Here, the AI/ML system(s) 312 can determine optimal operational parameters 343 for the individual MHUs 322 to conserve energy, reduce resource consumption overhead, and/or reduce wear on different components. The operational parameters 343 can include activating or deactivating sorting technologies, changing directions of conveyors, altering detection capabilities of different on-board sensors 321, and/or other actions of individual MHUs 322 to achieve results with minimum power, air, and consumption of other resources. Additionally or alternatively, the AI/ML system(s) 312 can include models trained to predict when individual MHUs 322, sensors 321, and/or other MRF components need to be serviced and/or replaced.

In a fourth example, the data stream data 342 and/or other data, measurements, and/or metrics can be used by the AI/ML system(s) 312 to expand the MRF functionality to pre or post material processing based on one or more data streams 331, 332. Here, the expansion of the MRF functionality can include retasking individual MHUs 322 (e.g., mobile robotics, balers, loaders, and/or the like) to perform different functions within the MRF based on different trigger events, conditions, parameters, and/or criteria.

In a fifth example, the data stream data 342 and/or other data, measurements, and/or metrics can be used by the AI/ML system(s) 312 to autonomously control (or cause the control system 302 to control) the infeed of material to the facility by altering/adjusting and/or mixing inbound material(s) to achieve a desirable (semi-)homogeneous commodity distribution. Additionally or alternatively, the data stream data 342 and/or other data, measurements, and/or metrics can be used by the AI/ML system(s) 312 to autonomously control (or cause the control system 302 to control) the output of different recovered materials into different bales or packaging machines. Here, the operational parameters 343 provided by the AI/ML system(s) 312 to the control system 302 can cause the control system 302 to queuing different material bales based on material composition (e.g., purity percentages and the like) and/or market conditions based on data streams 332 from different MHUs 322 and/or based on data streams 331 from different sensors 321. In these ways, the MRF system can allow for mixing bale purities on a shipment to achieve and target value.

Additionally or alternatively, this example can include certification of commodity bales based on data from processing system and sorting activities. Here, a unique identifier (UID) can be attached to or otherwise associated with a bale attached to bale allowing material composition data of the bale to be made available at the next point of commerce. The UID may be stored in association with relevant data about the bale (e.g., material type, bale creation date, purity levels/percentages, and/or the like).

In some examples, the UID may be in the form of, or otherwise included in, a machine readable element (MRE). An MRE is any element that contains information about a bale or other package of commodity. In these example, the control system 302 or an MHU 322 generates an MRE for each bale, for example, by encoding the UID in the MRE when the MRE is a quick response (QR) code (e.g., model 1 QR code, a micro QR code, a secure QR code (SQR), a Swiss QR code, an IQR code, a frame QR code, a High Capacity Colored 2-Dimensional (CC2D) code, a Just Another Barcode (JAB) code, and/or other QR code variants), a linear barcode (e.g., Codablock F, PDF417, a code 3 of 9 (code 3/9), Universal Product Code (UPC) bar code, CodaBar, and/or the like), data matrix code, DotCode, Han Xin code, MaxiCode, SnapTag, Aztec code, SPARQCode, Touchtag, GS1 DataBar, an Electronic Bar Code (EPC) as defined by the EPCglobal Tag Data Standard, a radio-frequency identification (RFID) tag (e.g., including EPC RFID tags), a Bluetooth beacon/circuit, an near-field communication (NFC) circuit, a universal integrated circuit card (UICC) and/or subscriber identity module (SIM), and/or other like machine-readable element. When the MRE of a bale is scanned by a suitable scanner device (e.g., an RFID tag reader, a barcode scanning application on a mobile device, an NFC reader, and/or the like), the scanner device may automatically be directed to a database location, uniform resource locator (URL), and/or other resource that stores the bale data for consumption (e.g., downloading the bale data to the scanner device and/or another device, sending the bale data to another/remote device, and/or the like). Additionally or alternatively, the scanner device may also collect information when scanning the MRE (e.g., location information of the scanner when performing the scan of the MRE, additional bale information, and/or the like).

In any of the aforementioned examples, the UID may be any value or data structure that uniquely identifies an entity or element, such as an individual bale. In some implementations, the UID may be a randomly generated number or string, which may be generated using a suitable random number generator, pseudorandom number generators (PRNGS), and/or the like. For example, the UID may be a version 4 Universally Unique Identifier (UUID) that is randomly generated according to Leach et al., A Universally Unique IDentifier (UUID) URN Namespace, INTERNET ENGINEERING TASK FORCE (IETF), Network Working Group, Request for Comments (RFC): 4122 (July 2005) ("[RFC4122]"). Additionally or alternatively, the UID is a hash value calculated from one or more inputs (which may or may not be unique to the bale and/or MRF). In one example, the UID may be generated using the supplied contact information (or a portion thereof) as an input to a suitable hash function (e.g., such as those discussed herein). For example, the UID may be a version 3 or 5 UUID that is generated according by hashing a namespace identifier and name using MD5 (UUID version 3) or SHA-1 (UUID version 5) as discussed in [RFC4122]. Additionally or alternatively, the UID may be a digital certificate supplied by a suitable certificate authority, or may be generated using the digital certificate (e.g., hashing the digital certificate). Additionally or alternatively, the UID may be a specific identifier or may be generated using the specific identifier. The specific identifier may be any suitable identifier associated with a user and/or user system, associated with a network session, an application, an app session, an app instance, an app-generated identifier, the bale itself, the MRF, an intended recipient of the bale (e.g., a customer), and/or some other identifier (ID). The specific identifier may be a user ID or unique ID for a specific user on a specific client app and/or a specific user device. Additionally or alternatively, the UID may be based on a device fingerprint of the control system 302 and/or some other device or system in the MRF. Additionally or alternatively, the UID may be based on any other type of identifier and/or network address, such as any of those discussed herein. Any of the aforementioned examples may be combined.

In any of the aforementioned examples, the AI/ML system(s) 312 include one or more optimizers that perform the multi-objective optimization according. The optimizers are based on one or more objective functions or multi-objective function(s), which include an optimization problem involving more than one objective function to be either minimized or maximized. The optimizers may define a multi-objective optimization model that comprises one or more decision variables, objectives, and constraints. The decision variables are variables that represent decisions to be made, and the objectives are the measures to be optimized. The constraints define restrictions on feasible solutions (including all optimal solutions) that must be satisfied, and/or restrictions on the values the decision variables may hold. One example of the decision variables includes prioritized or otherwise desired materials to be recovered from the material stream. The objective functions indicate how much each of their decision variables contributes to the objectives to be optimized. The multi-objective optimization model may also define one or more coefficients corresponding to one or more of the decision variables. The coefficients indicate the contribution of the corresponding decision variable to the value of the objective function. The optimal solutions in multi-objective optimization can be defined from a mathematical concept of partial ordering. The term domination is used for this purpose in the parlance of multi-objective optimization. A first solution is said to dominate a second solution if both of the following conditions are true: (1) the first solution is no worse than the second solution in all objectives, and (2) the first solution is strictly better than the second solution in at least one objective. For a given set of solutions, a pair-wise comparison can be made using a graphical representation and a determination as to whether one point in the graph dominates the other can be established. All points that are not dominated by any other member of the set are called "non-dominated points" or "non-dominated solutions". The Pareto frontier comprises a set of non-dominated points in such a graphical representation. Here, the AI/ML system(s) 312 solves the multi-objective function(s) to optimize a number of objectives simultaneously, where the objectives of the multi-objective function include the data stream data 342 and/or one or more other measurements, metrics, and/or statistics such as any of those discussed herein. In some implementations, the specific measurements, metrics, and/or data stream data 342 to be collected, processed, and/or analyzed is specified in a suitable configuration file and/or is derived from other AI/ML model(s). Additionally, different task weights may be used as coefficients in the multi-objective function(s) to weight different tasks/actions, parameters, features, and/or the like, accordingly.

The control system 302 can signal instructions/commands 333 to reconfigure and/or rearrange the sensors 321 and/or MHUs 322 for any of the aforementioned purposes and/or for other purposes. For example, the control system 302 can signal instructions/commands 333 to individual MHUs 322 change specific operational parameters of the individual MHUs 322 and/or to cause the individual MHUs 322 to automatically move to different areas/locations within the MRF. The instructions/commands 333 can be generated or otherwise based on the inferences/predictions generated by the AI/ML mechanisms 312.

Furthermore, the MRF components 302, 312, 321, 322 can be in communication with one another and/or one or more other systems, devices, and/or data sources. The communications among the various MRF components 302, 312, 321, 322 may be physical and/or logical connections using any other interconnect technologies and/or access technologies, such as any of those discussed herein. In some implementations, the control system 302 is a central controller that acts as an intermediary or hub that manages the communication among the other MRF components 312, 321, 322. In other implementations, individual MRF components 302, 312, 321, 322 can directly communicate with one another. As will become apparent from the following discussion, a degree of overlap may exist between the different sources (e.g., machine vision may be utilized in conjunction with one or more of the sorters, and/or the like).

In some implementations, the various data streams can be fed into the AI/ML mechanisms 312 or portions of control system 302. Depending on the particulars of a given AI/ML mechanism 312, some data from the data streams can be used to train the AI/ML mechanism 312. Additionally or alternatively, other datasets may be used to train the AI/ML mechanism 312. Additionally or alternatively, the AI/ML mechanism 312 may include unsupervised learning mechanisms, perform self-training, and/or learn on-the-fly using real-time (or near-real-time) data collected from the various data streams. Additionally or alternatively, the AI/ML mechanism 312 can include backpropagation techniques for training or inference phases.

Some of the MHUs 322 include robotic sorters. The robotic sorters are sorting machines that include any form of robotic sorting capabilities such as, for example, articulated robots (e.g., including one or more manipulator arms), gantry robots, cylindrical coordinate robots, spherical coordinate robots, six axis robots, selective compliance assembly robot arm (SCARA) robots, parallel robots, delta robots, serial manipulators, and/or another type of robot or robotic elements suitable to handle an intended material/waste stream. In some implementations, one or more robotic sorters include end-effectors or end-of-arm-tooling (EOAT), which involve a portion of the robot's kinematic chain (e.g., robotic arm or the like) capable of interacting with an environment. For example, an end effector may include a portion of a robot or robotic arm that has one or more attached tools, such as, for example, impactive tools (e.g., jaws, claws, tweezers, mechanical fingers, humaniform dexterous robotic hands, and/or other gripper mechanisms that physically grasp by direct impact upon an object), ingressive tools (e.g., pins, needles, or hackles that physically penetrate the surface of ab object), astrictive tools (e.g., magnets, vacuums, electroadhesion, and/or other elements that use attractive forces applied to an object's surface), contigutive tools (e.g., adhesives, glue, surface tension, freezing, and/or other mechanisms requiring direct contact for adhesion to take place), projectile tools (e.g., mechanisms that shoot or propel objects or elements), and/or fabrication means (e.g., machine tools, drills, milling cutters, and/or the like), and/or the like. As examples, the robotic sorters can be or include the robotic sorters 1102, 1106 discussed infra w.r.t FIG. 11. Additionally or alternatively, the end effector and/or other aspects/elements of the robotic sorters can include one or more actuators (see e.g., actuators 1242 of FIG. 12).

The robotic sorters can communicate with the control system 302 to provide status information 332 to the control system 302. For example, a robotic sorter 322 may report the number and type of picks in different streams within the MRF to the control system 302, and the control system 302 can use this information to coordinate activities of other MHUs 322 in the MRF and/or MHUs 322 at other plant locations, track the operating status and time of the robotic sorter to determine whether maintenance should be scheduled, and otherwise assess the current status of the waste stream that is passing by the robotic sorter 322. The control system 302 can send instructions/commands 333 to instruct robotic sorter 322 to activate or deactivate, depending upon feedback and data from sensors 321 and/or other MHUs 322 within the MRF and/or feedback/data related to operational conditions of the MRF. The control system 302 can also signal the instructions/commands 333 to reconfigure individual robotic sorters to sort out different materials or materials of varying shapes or sizes, depending upon the nature of the waste stream presented to those robotic sorters.

Some of the MHUs 322 include optical sorters, which are sorting machines that utilize optical recognition techniques on a waste stream to detect the presence of desirable objects/materials and/or undesirable objects or contaminants in a waste stream. The optical sorters may employ a suitable light source or x-ray radiation to aid in recognition of contaminants. For example, where desirable materials reflect or absorb various infrared wavelengths differently from contaminants, an optical sorter may use an infrared light source in conjunction with an infrared sensitive camera or optical detector to distinguish undesirable contaminants from desirable (e.g., recyclable) material. Different light sources (e.g., possibly with different wavelengths) and/or cameras or other visible light sensors may be employed where different types of contaminants are to be detected, wherein the particular light/radiation and sensor types can be selected according to implementation and/or specific use cases. The recognized contaminants may then be mechanically removed at the direction of optical sorter, such as by mechanically grabbing (such as with a robotic sorter) or ejecting the contents, or via air separation, where precise blasts of air can be used to eject contaminants. Other means for removing or expelling contaminants detected by optical sorter may be used, depending upon the specific needs of a given implementation. As examples, the optical sorters can be or include the optical sorter 1103 discussed infra w.r.t FIG. 11.

The optical sorters can be in communication with control system 302, where the optical sorters can provide status information 332 indicating various contaminants, materials, or objects that were detected and/or ejected by the optical sorters. As with the data stream 332 from robotic sorters, the control system 302 may use data streams 332 from optical sorters to determine the status and quality of the waste stream moving past optical sorters, and take appropriate actions as to ensure optimal operation of the MRF. For example, data 332 from an optical sorter may be passed downstream to a robotic sorter by the control system 302, and the control system 302 may be able to dynamically reconfigure robotic sorter and/or the optical sorter based on the status information from the optical sorter and/or the robotic sorter. Likewise, the optical sorters may be in communication with the control system 302, and can receive control data 333 from control system 302. For example, the control system 302 can activate, deactivate, or otherwise reconfigured one or more optical sorters to monitor for and/or sort/remove different types of contaminants (e.g., within the limits/capabilities of the optical sorter hardware).

Some of the MHUs 322 include electromagnetic sorters, which are sorting machines that utilize magnetism and/or electromagnetic mechanisms on a waste stream to detect the presence of desirable objects/materials (e.g., recyclable metals and/or rare earth elements) and/or sort such materials from undesirable objects or contaminants in a waste stream. For example, the electromagnetic sorters can include electromagnets (e.g., coils and/or solenoids in various shapes, designs, and/or arrangements), which when supplied with electric current, produce magnetic field poles to attract or repel ferromagnetic materials, permanent magnet materials rare-earth materials, composite magnet materials, and/or the like. Here, the control system 302 can control the amounts of current (or varying pulses of current) to the electromagnets in order to control the strength and direction of the magnetic fields. Different magnetic field strengths can provide different oscillation/vibration frequencies for the electromagnets, which may provide various ways in which to separate out desirable materials from waste streams. Various oscillation frequencies can be achieved using various combinations of current pulses, for example, using phase offset modulation, pulse-width modulation, and/or other like modulation schemes.

Some of the MHUs 322 include pneumatic and/or air systems, which may include an air jet sorter or remover. The pneumatic and/or air systems use relatively precise air jets to eject contaminants from a waste stream. Additionally or alternatively, the air systems can be the same or similar as the air separator 12 (or include one or more air separators 12), which acts in conjunction with MHUs 322 or structures such as one or more sorters, conveyors, drums, and/or other components or devices such as any of those discussed herein, to provide rapid, relatively rough, sorting of recyclable materials from non-recyclable materials on the basis of weight and size. In some implementations, the air systems are implemented as more precise air jet sorters, which may be triggered by the AI/ML mechanisms 312, a set of sensors 321, MHUs 322 (e.g., optical sorters, robotic sorters, and/or the like) to supply the air systems with locations for air jets to remove identified contaminants. Additionally or alternatively, multiple data sources may feed data/triggers to individual air systems. Additionally or alternatively, other sensors 321 (e.g., inductive, optical, weight, density and/or the like), other data sources, and/or devices/systems may be in communication with the air systems to identify contaminants for removal from a waste stream. These other sensors, data sources, and/or devices/systems may be part of other data stream sources and/or the like, as discussed herein.

In some implementations, the air systems act as air sources for other sorters (e.g., robotic sorters, robotic sorters, mechanical sorters, and/or the like), which may be pneumatically operated. The air systems can communicate with the control system 302 to report status information 332 related to the air systems, which can include, for example, available air flow, compressed air tank data, pressure readings, various statistics (e.g., accuracy, number of objects removed and/or sorted over a time period, whether an object was successfully removed or sorted, and/or the like). The air systems can also contain temperature, flow, and/or speed instrumentation to report 332 its readings to the control system 302 as status information 332. The control system 302 uses the feedback 332 from the air systems to dynamically adjust the operation of the air systems themselves, adjust the operation of various other components 312, 321, 322 of the MRF. For example, the control system 302 may instruct 333 the air systems to activate, deactivate, adjust one or more operating parameters (e.g., increase or decrease air pressure, and/or the like), and/or move to a different location/area of the MRF based on the information obtained from various data streams. For example, where control system 302 determines that lighter contaminants may pass by an air system, the control system 302 may signal 333 the air system to decrease its working air pressure so that the lighter contaminants are successfully removed from the waste stream while reducing the overall resources consumed by the air system.

Some of the MHUs 322 include conveyor systems, which includes mechanical handling equipment that moves materials or objects from one location to another. The conveyor systems can utilize any suitable conveyance means, which can include, for example, belt (belted) conveyors, chain and/or drag chain conveyors, live roller conveyors, sanitary/food grade conveyors, gravity conveyors, pneumatic conveyors, vibrating conveyor systems, flexible conveyors, telescopic conveyors, vertical conveyors, spiral conveyors, motorized drive roller (MDR) conveyors, heavy-duty roller conveyors, walking beam and/or fluid power cylinder conveyors, sortation conveyors, and/or the like. In some examples, the conveyor systems include one or more of the conveyors 20, 34, 38, 40, 42, and/or 54 discussed previously w.r.t FIGS. 1 and 2, and/or can include the conveyors 1104*a*, 1104*b*, 1104*c*, and 1104*d* discussed infra w.r.t FIG. 11. These conveyor systems are generally used to conduct or convey waste streams between various MHUs 322 (e.g., sorting mechanisms, air systems, screen 46, and/or the like). In addition to the conveyor systems discussed herein, some of the MHUs 322 can include other conveyance means, such as, for example, industrial cranes and lifting equipment (e.g., gantry cranes, jib cranes, free standing bridge cranes, freight lifts, material lifts, and the like). In some implementations, individual conveyors may have one or more sorting mechanisms positioned at an end or along its length. Additionally or alternatively, some conveyors can be equipped with scales using load cells, speed sensors, and/or photo eyes that report the mass flow of the waste material at different parts of the system. In some implementations, weight measured by a load cell or other weight measuring mechanism can be used to detect and remove contaminants that exceed expected weight or density, either by a sorter (as described above) or at the direction of control system 302.

Additionally, the conveyor systems can communicate with the control system 302 to report status information 332, which can include information captured by the conveyor systems. The information captured by the conveyor systems can include, for example, weight measurements, speed measurements, mass flow measurements, maintenance/servicing data/statistics, and/or any other measurements and/or metrics to assist with the management of the MRF. The control system 302 uses feedback 332 from the conveyor systems to dynamically adjust the operation of the conveyor systems themselves and/or adjust the operation of various other components 312, 321, 322 of the MRF. For example, the control system 302 may instruct 333 the conveyor systems to activate, deactivate, adjust one or more operating parameters (e.g., conveyor speed, movement direction of the conveyor or conveyance means, and/or the like), move to a different location/area of the MRF, and/or other parameters based on the information obtained from various data streams.

Some of the MHUs 322 include mechanical separation mechanisms (or mechanical separators). As examples, the mechanical separation mechanisms can include vibratory equipment to form a vibratory screen, screen separators (e.g., separation screen 46 of FIG. 2) that may employ discs and/or the like, ballistic separators, and/or the like. Such mechanical separators may be used as an initial separation means for a given waste stream to generate a relatively crude recoverable (commodity) material stream and residual stream. Each such stream may then be passed through one or more other sorters (e.g., robotic, optical, air, vibratory, and so forth) for further refinement and/or purification of the recoverable material stream, and further recovery of recoverable materials from the residual stream. Although many of the sorting means is discussed herein are mechanical in nature, for purposes of the present disclosure, the mechanical separators connote any sort of separation technology useable with a MRF that is not otherwise discussed herein w.r.t other sorting technologies. Such mechanical separators may include sensors feeding a data stream (e.g., including status information 332 and/or sensor data 321) to control system 302 indicating the efficiency of the separation, to allow control system 302 to engage the additional sorter(s) as necessary. Other sensors, as discussed elsewhere, may feed control system 302 a data stream about the operating status of the mechanical separators (e.g., whether the separator is jammed or clogged, is in need of service, requires a speed adjustment to optimize efficiency, and/or the like).

In any of the examples discussed herein, any of the MHUs 322 can include mobility mechanisms (also referred to as locomotion mechanisms and/or the like) and/or any other devices or subsystems to transport themselves from place to place. These mobility mechanisms allow the MHUs 322 to move throughout the MRF based on the command/instructions received from the control system 302. These movement mechanisms can include walking mechanisms (e.g., using any number of legs), rolling mechanisms (e.g., wheels, continuous tracks, and the like), propulsion mechanisms, cranes, and/or any other suitable mechanism, including any of those discussed herein. In some implementations, the mobile MHUs 322 can utilize a suitable motion planning optimization techniques, costmaps, and/or AI/ML techniques to perform the movements necessary to travel throughout the MRF.

The various sorters (e.g., mechanical, robotic, optical, air, and/or any other type) may be located at any appropriate location within the MRF. In some implementations, sorters of different types may be located at a variety of locations throughout the MRF, with each sorter in communication with control system 302. The control system 302 uses data from the various data streams 331, 332 to, dynamically or in real time while the MRF is actively sorting waste/material streams, autonomously control and/or adjust operational parameters of the MRF based on the changing nature of the waste/materials streams. The autonomous control and/or parameter adjustments can include, for example, selectively activating or deactivating one or more MHUs 322 (e.g., sorters, conveyors, balers, and/or the like), change the sorting tasks of individual sorters 3, change conveyor directions and/or speeds, change the configuration and/or arrangement of the different sorters within the MRF, and/or the like.

In some examples, the control system 302 feeds the data from the various data streams 331, 332 into one or more AI/ML models (e.g., operating on the control system 302 or on a remote system) to determine the new or updated/adjusted operational/autonomous control parameters. For example, the control system 302 can use the AI/ML system(s) 312 to determine optimal operation tasks for individual MHUs 322, optimal operational parameters of individual MHUs 322, optimal location/area deployments for individual MHUs 322, whether to activate/deactivate different MHUs 322, whether individual MHUs 322 and/or sensors 321 need to be serviced, and/or any other controlled system of an MRF to optimize MRF operation, based on various parameters and/or conditions of the material/waste streams. The various parameters and/or conditions of the material/waste streams can be determined based on the collected sensor data 331, MHU status information 332, and/or other data streams and/or other data.

In some example implementations, the results of the various sorters is two or more material streams, where at least one material stream comprises primarily purified recoverable (recyclable) materials, and at least one other material stream is a residual stream of materials remaining following separation of the recoverable (recyclable) material. The sorters may accomplish this in a negative or positive fashion. In negative sorting, a given sorter removes identified contaminants from a mixed stream, with the stream thus becoming purified. In positive sorting, a given sorter removes the target materials that form the purified stream from the mixed stream, with the resultant or default stream moving on for further processing by the system, or in some implementations, forming the residual stream. Additionally or alternatively, some implementations employ a mix of negative and positive sorting with different sorters at different locations within an MRF. Whether negative or positive sorting, or the amount or mix of such strategies, employed is implementation-specific or can be based on specific use cases, such as the configuration of the MRF, available MHUs 321 within the MRF, the types of materials input to the MRF, and/or other parameters, conditions, or criteria. In any of these implementations, the removed materials (whether contaminants or desired materials) form a material stream, which can be diverted to other areas of the MRF for further processing.

In some implementations, the control system 302 is able to change individual sorters 321 (e.g., whether robotic, optical, air, or another suitable sorting technology) between a positive and negative sorting strategy in response to feedback from various data streams 331, 332 to optimize sorting efficiency. In some examples, a combination of strategies may be employed, with a positive sorting strategy being initially employed to create a new stream of desirable materials, for example, enhancing, optimizing or maximizing recovery (e.g., quantity) of desirable materials, and a second sort with a negative sorting strategy being employed on the new stream as a quality control step to ensure stream purity. The results of the negative sort may be redirected back to another suitable stream based upon the nature of the contaminant, for example, to another recyclable/recoverable stream, or to a stream for disposal.

In some implementations, contaminants rejected or sorted by the various sorters described previously from a given waste stream may be routed or diverted, such as by a conveyor, to another waste stream (or sorting line) for further processing. It should be understood that the residual or waste nature of the stream is relative; the remaining materials may themselves be recyclable or otherwise desirable, but of a different nature than the purified stream materials. The residual stream may thus be subject to further sorting to obtain an additional purified stream of different recyclable materials and another residual stream. The process of sorting/purification may be repeated on the stream until all materials of value have been extracted, leaving only materials intended for disposal.

In some implementations, one or more of the sorters, such as robotic sorter(s) 322, may be configured to manipulate objects such as recoverable material that is in a 3D configuration. For example, waste paper may be collected into a bag or stack, which presents as a relatively dense 3D object. A robotic sorter 302 (or similar robotic manipulator) may be configured to open or otherwise take apart the bag or stack, and reduce it to a collection of 2D objects (e.g., paper or cardboard sheets). Such materials may be returned back through the MRF at an appropriate point for resorting based on their 2D characteristics, molecular structures, and/or any other suitable parameters, conditions, or criteria.

Furthermore, in various implementations, each of the MHUs 322 is adapted to include a quick disconnect mechanism (QD). The QD of an MHU 322 enables the MHU 322 to physically latch on, or otherwise connect to, resource conveyance mechanism(s) (e.g., pipes, tubes, hoses, wires, and/or other suitable mechanism for conveying fluids or other resources to the MHUs 322). The QD provides sealed connections for the MHU 322 to receive the necessary resources to perform their configured or otherwise designated functions.

The QD may be designed and built in such a way that it requires little or no manual intervention for attaching and detaching from resource conveyance mechanisms and/or the MHU 322, and is managed automatically by the MHU 322, a docking station, and/or the control system 302. This physical latching or attaching can be done electrically (e.g., using an electromagnet or the like), mechanically (e.g., using a lever or similar mechanisms), and/or pneumatically.

Each MHU 322 has a unique identifier (UID), physical hardware platform, and software systems, and each docking station has a specific UID, physical hardware platform, and software systems. In some examples, the UIDs of the docking stations and/or the MHU 322 can be implemented using RFID tags, and/or any other suitable technology such as those discussed herein. The UIDs are used to know which MHU 322 is in each location or area of the MRF, and also allows for individual MHUs 322 to move to other locations. The instructions/commands 333 for an MHU 322 can include the specific docking station UID, indicating the location that the MHU 322 should move to and the specific docking station to which it should dock. The QD can also be keyed in such a way to identify which type of MHU 322 is in a docking station.

In the example of FIG. 3, the control system 302 receives input(s) 343 from the AI/ML system(s) 312 (e.g., a machine vision model, object detection model, and/or the like), which it can then use to assist in efficient management of the MRF. The AI/ML system(s) 312 is configured to detect (or predict) composition and contaminant levels of different streams, and report 343 those findings to the control system 302 as discussed herein. Additionally or alternatively, the AI/ML system(s) 312 can be in communication with one or more of the MHUs 322 and/or one or more of the sensors 321, either directly or by way of input to control system 302 to provide guidance for the one or more MHUs 322 for removing contaminants. The AI/ML system(s) 312 can utilize any suitable AI and/or ML technique(s) (e.g., such as those discussed herein) or those later developed as appropriate to a given implementation (e.g., object recognition, pattern matching, edge detection, and/or the like).

In some implementations, the AI/ML system(s) 312, potentially in conjunction with the control system 302, may distinguish between 2D and 3D objects for directing (e.g., via a conveyor or the like) to an appropriate MHU 322 (or set of MHUs 322) for sorting. For example, milk cartons, bottles, cans, and/or the like, may be recognized as 3D materials as compared to 2D materials, such as paper, OCC, foil, plastic sheeting, and/or the like. With this feedback, the control system 302 and/or individual MHUs 322 (e.g., robotic sorters, optical sorters, and/or the like) may expel, redirect, or otherwise separate 2D objects from 3D objects so that each is appropriately processed and handled.

System 300 may also include input and output MHUs 322 located at both the input and output of the MRF, respectively. On the output side, the MRF may be equipped with one or more packaging machine MHUs 322. Examples of such packaging machines 322 include balers, stretch wrappers, case erectors, carton and tray formers, baggers, palletizers, and case sealers. These MHUs 322 are designed to bundle, bale, or otherwise package materials from a recoverable material stream for subsequent shipment to a receiving facility or the like. A packaging machine 322 (e.g., baler) may also be used to package a residual stream for transport to a landfill or other suitable disposal facility. The control system 302 may receive information 332 from the packaging machines 322 and/or relevant sensor data 331 from one or more environmental sensors 321, such as operating status (e.g., whether normal, in need of servicing, jammed, and/or the like), amount of material processed, capacity, service information, and/or the like. The control system 302 is configured to control the packaging machines 322 including, for example, commanding it/them to start or stop, adjust baling or packaging sizes, and/or the like.

On the input side, a MRF may be equipped with one or more infeed or metering MHUs 322. These input-side MHUs 322 are configured to receive incoming solid waste streams from one or more sources (e.g., conveyor from a pile, a shredder, hopper, unbaler, waste collection vehicles, and/or other solid waste sources), and direct the solid waste streams to the start of the sorting pipeline (e.g., screen 14 depicted in FIG. 1 or the like). In some implementations, infeed or metering MHUs 322 and/or relevant sensors 321 supply the control system 302 with a data streams 332, 331 which can include parameters such as operating status, amount of solid waste being accepted, speed of infeed, nature of the infeed solid waste stream, and other such parameters relevant to the operation of the MRF. The control system 302 is configured to control the infeed/metering MHUs 322 including, for example, commanding it/them to start or stop, accepting solid waste streams from one or several possible sources, controlling the speed or rate of infeed (e.g., accelerate, decelerate, conveyor speeds, and so forth), combine infeed from several sources, and/or any other control aspect to help optimize the operation of the MRF.

In the example of FIG. 3, one or more facility environmental sensors 321 may be in communication with control system 302, to enable control system 302 to effectively manage the various systems of an MRF. At least some of the sensors 321 can be facility environmental sensors 321 associated with one or more other components of MRF system 300 (e.g., robotic sorters, optical sorters, air systems, conveyors, and/or the like). These sensors 321 can enable the control system 302 to monitor the status of the various MRF components to ensure proper operation, determination/alerting when service is needed and/or when a malfunction or other anomaly is detected, and/or the like. The sensors 321 also enable the control system 302 to monitor the status/condition of various material streams.

Examples of facility sensors 321 include bailer sensors/sensor systems that can report the number, weight, and/or type of bales or material (e.g., recyclable or otherwise) produced; moisture sensing instrumentation to determine if materials are wet and need to be discarded or rerouted for additional processing; inclinometers on screens, sorters, feeders and conveyors; induction sensing arrays, which may help detect metal contaminants or types of metal for appropriate recycling; laser-based measurement devices that report volumetric characteristics of the material stream; smart current sensors/meters for detection of overloads or frequency drives that report running amperage of system equipment; positive and/or negative pressure transducers to compute system vacuum and pressure required to remove objects in positive and negative sorting applications; flow switches and/or meters to report total air consumed by optical and robotic sorters; fire and/or smoke detectors; gas detectors. Other sensors may be employed in a given embodiment, depending upon the specific needs of the implementation. In some implementations, facility environmental sensors 321 monitor for screen health, such as screen 14 and screen separator 46. Screen health can be impacted by issues such as clogging or jamming of IFOs or the screen discs (e.g., depending upon a given configuration of a screen; other screen configurations may employ vibratory methods that do not require discs), by debris, by jams, and/or by wear of the discs or vibratory components, to name a few possible issues. Environmental sensor data stream data 331 and/or inference data 343 may be used by control system 302 to detect adverse impacts to a given screen and/or other MHU components.

In one example, by utilizing one or more light sources located under a screen or over the screen, the screen can be scanned by an environmental sensor 321 (e.g., a visible light camera, a near infrared (NIR) spectrometer, an ultraviolet light camera, another suitable light sensor, and/or the like) to determine the status of the screen, such as whether it is operating at efficiently or at optimal performance. The light source(s) and/or sensor(s) 321 may either be in one or more fixed locations, or be positioned on a moveable assembly to allow flexible scanning of the screen. In either implementation, the light source(s) and/or sensor(s) 321 may also be disposed on rotational mechanisms to change the orientation of the light source(s) and/or sensor(s) 321. In some examples, the light source(s) are coordinated to match the sensors 321 used for machine vision applications 312. Furthermore the control system 302 continuously or periodically scans the screens, depending upon the needs and configuration of a given configuration or arrangement. Some implementations allow continuous monitoring of the screen health while in operation, while others may require periodic shutdown of the screen for scanning, such as where the presence of a material stream would hinder detection of screen condition. In some implementations, the light source may be located on one side of the screen, with the sensor 321 on the other, where the obstruction of the light source(s) through an IFO would indicate a possible jam.

If an adverse condition is detected, control system 302 may either dispatch an automated means (e.g., one or more MHUs 321 or the like) to clear the condition, such as a robotic manipulator and/or an air jet to remove or dislodge a jam. In another example, the automated means can adjust or alter the screen operation to clear the screen, such as by reversing the rotation of one or more discs or set of discs, or employ another suitable technique. Additionally or alternatively, if the jam cannot be automatically cleared or the adverse condition is not subject to automated correction, control system 302 may notify an operator of the MRF of the adverse condition to dispatch manual correction. For example, detection of excessive screen wear may trigger a maintenance notification to the operator that the screen discs (or another component) needs replacing. In some implementations, the screen discs or other components may be configured to facilitate wear detection.

Depending on the MRF conditions and/or context, the health of the screen could relate to wrapping of materials on the shafts or blockages in the screening openings that would require cleaning by the operational staff; wear of the screening surface that would allow the sizing ability to be compromised, which may require maintenance by the operational staff; excessive material and/or prohibitive objects that could cause jams and or damage to the screening surface; or monitoring the RPM of the screen or disc shafts or operative components through variable frequency drives to optimize material flow and component wear life, to name a few possible conditions. Different environmental sensors 321 may be used to detect various conditions.

Additionally or alternatively, materials may be utilized within the screening surface, either within different components or within layers of the same component, which would allow the scanning equipment to determine the health of the screen. For example, the screen discs (where employed) may be configured with multiple layers, including a wearable top layer placed over a second indicator layer. The indicator layer may be configured to be uniquely detectable by a machine vision system 312 or another camera when exposed due to the wear of the top layer, thus indicating that the screen disc needs replacement and/or refurbishing.

Additionally or alternatively, the MRF can include a multiple MRF components that includes a select number of MHUs 322 and/or other sorting technologies (e.g., in addition to robotic sorters, optical sorters, and air systems discussed previously), including but not limited to fines removal; density separation; 2D/3D separation; optical identification of 2D contaminant; optical removal of 2D contaminant; optical purification of 2D product; automated quality control (QC) sorters on 3D material; automated QC sorters on 2D fiber; automated QC sorters on large heavy material; automated Recovery sorters for recovering commodities from residue; and automated System pre-sorters on system infeed. Other components may be possible on different implementations.

By utilizing a combination of one or more of the data streams 331, 332, as well as any future type of data and/or data collection technologies, the control system 302 in conjunctions with AI/ML system(s) 312 can identify and classify individual and composite objects, and adjust the principal sorting logic and components of the system, in real time, in response to increase throughput and efficiency, maximize or optimize the amount of materials that are recovered, the purity of the final products, and to create different types of residual or recovered components for use in specific applications. The data streams 331, 332 can also be used by control system 302 to load balance between various MHUs 322 (e.g., by splitting or directing multiple waste streams to different material handling units, and/or retasking a given material handling unit to purify and/or recover varying types of materials). For example, where an incoming waste stream is heavy in one particular type of recoverable material (e.g., 2D fiber and paper-based materials), some of the MHUs 322 in the MRF that otherwise would sort different materials may be retasked to sort for 2D fiber materials to handle the preponderance of 2D materials. This may result in multiple streams of 2D fiber materials that can later optionally be rejoined together, such as by controlling one or more conveyors and/or one or more balers. Alternatively, infeed/metering systems may be controlled to pull from multiple waste stream sources to create an initial solid waste stream that is optimally balanced for a given MRF configuration. Thus, control system 302 potentially allows a MRF to be configured with one or more processing lines with various material handling units that can be reconfigured, potentially in real time, to handle a variety of different types of solid waste streams with various amounts of different recoverable materials. Such a MRF can accept solid waste streams of fluctuating compositions and dynamically reconfigure the various material handling units in real time to target varying types of materials, to optimize recovery from the varying streams and to balance workload across the material handling units.

Further, as mentioned above, the data streams can be used by control system 302 to create maintenance records and schedules for various components of the implementing MRF. Still further, control system 302 can utilize the data stream(s) to create human sorting requirements and locations, where the automated sorters cannot practically or feasibly handle complete sorting of the waste stream.

As mentioned above, control system 302, in implementations, employs an AI neural network model or models. Thus can enable control system 302 to research commodity processes and pricing, such as via an external information source like the Internet, to adjust the system to recover the highest possible value stream. An AI driven autonomous control system 302 can also analyze historical system outputs as well as real-time sensors to create an interaction with one or more bailer units at the end of the MRF processing for preparing recovered recyclable materials for shipment, allowing the system to utilize the bailer more efficiently.

Control system 302, in implementations, further utilizes one or more of the data streams listed above, as well as any future type of data stream that may be available, to manage belt speeds and emergency stop scenarios to protect downstream equipment from prohibitive materials. For example, using machine vision, control system 302 may identify and divert potentially incendiary devices such as batteries or propane tanks, or other similarly dangerous items, prior to ignition or explosion. Further, in the event a flammable object is not recognized or otherwise caught and diverted by control system 302 and ignites (including potentially initiating a fire in other flammable materials, such as paper to be recycled), the control system 302 can be configured to detect and recognize combusting material, and divert the material using automated equipment (such as a conveyor or sorter, as described above) to an area for safe containment. Additionally or alternatively, such materials may be extinguished automatically using a fire suppression system (not shown) that is controlled by or otherwise in communication with control system 302.

Figure 4:
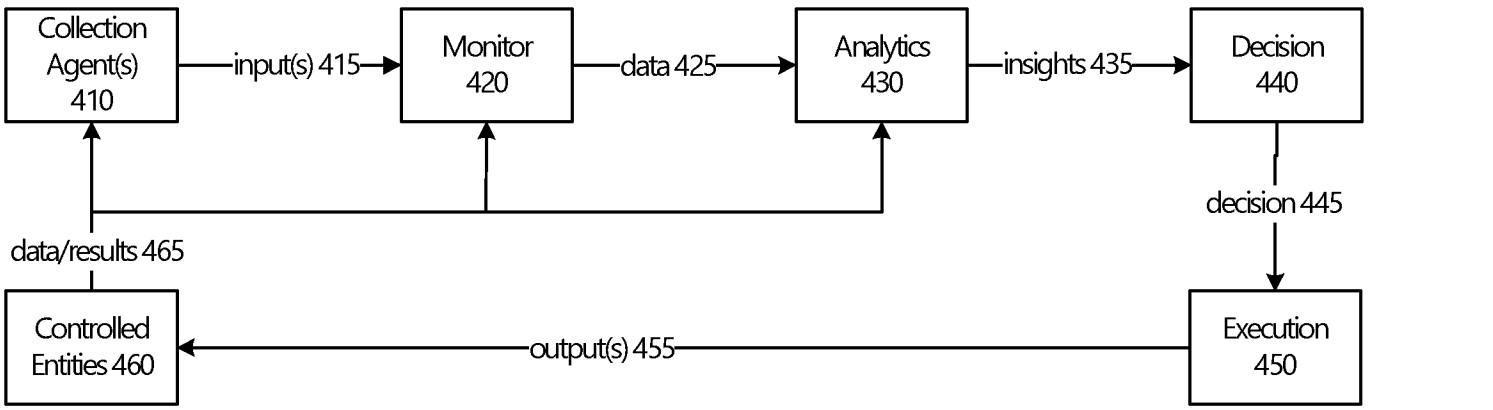
FIG. 4 depicts an example control loop architecture.

FIG. 4 illustrates an example control loop 400 that may be used to autonomously control an MRF. The control loop 400 can be used to monitor systems and optimize performance of such systems. For example, the control loop 400 can be used to re-task the various MHUs 322 and/or sensors 321 in an MRF as discussed herein. In one example, the control loop 400 is a container sorting loops that runs independently, making its own decisions on when it wants to run, what materials the MRF is going to process, and when to purge those things. In the example of FIG. 4, the control loop 400 includes a collection agent 410 (also referred to as "collector 410"), monitoring function 420 (also referred to as "monitor 420"), analytics function 430, decision function 440, and execution function 450.

The collector 410 measures and/or collects measurements, metrics, and/or observations, and provides input(s) 415 to a monitoring function 420. The collector 410 may be one or more telemeters in a telemetry system, a system under test (SUT), device under test (DUT), a sensor hub, a data fusion system, and/or some other suitable data consumer(s). The collector 410 collects, samples, or oversamples various measurements, metrics, and/or observations in response to detecting one or more events, according to one or more timescales, during one or more time periods or durations at one or multiple timescales, and/or based on one or more predetermined or configured conditions. The various measurements, metrics, and/or observations can include the data of data streams 331, 332 as discussed previously and/or is based on data 465 produced as a result of a previous iteration or epoch of the control loop 400. In some examples, the concept of timescales relates to an absolute value of an amount of data collected during a duration, time segment, or other amount of time. Additionally or alternatively, the concept of timescales can enable the ascertainment of a quantity of data. For example, first metrics/measurements may be collected over a first time duration and second metrics/measurements may be collected over a second time duration. For the control loop 400 to act on input(s) 415 in the context of a set goal, the control loop 400 may continuously consume and produce information from each other in a loop according to the sequence of monitoring 420, analysis 430, decision 440, and execution 450.

The input(s) 415 are provided by the collector 410 to the monitoring function 420, and the monitoring function 420 passes data 425 to the analytics function 430 (also referred to as a "profiler 430", "analytics tool 430", or the like). In some examples, the data 425 is/are simply the input(s) 415 without processing being applied (e.g., "raw data 425"). Additionally or alternatively, the monitoring function 420 generates the data 425 by applying filter(s), transformation(s), and/or some other processing mechanisms to the input(s) 415. The analytics function 430 analyzes the data 425, and generates one or more insights 435 (also referred to as "profile(s) 435", "trace(s) 435", "inference(s) 435", and/or the like) based on the data 425. In some examples, the analytics function 430 produces the insights 435 by analyzing, determining, or identifying variations in data 425 that is/are collected over the same or different timescales, collected in response to different triggering events and/or conditions, and/or collected from the same or different MRF components.

The analytics function 430 provides the insights 435 to a decision function 440, which determines and/or generates one or more decisions 445 (also referred to as "prediction(s) 445", "inference(s) 445", and/or the like) based on the insights 435, and provides the decision(s) 445 to the execution function 450. In some examples, the decision(s) 445 include one or more actions, operations, tasks, actions, performance optimizations, policies, rule sets, configurations (or configuration parameters), and/or other aspects of the present disclosure, such as any of those discussed previously.

The execution function 450 generates one or more outputs 455 based on the decision 445, and provides the output(s) 455 to the controlled entity 460. In some examples, the execution function 450 executes and/or otherwise performs the actions, operations, tasks, actions, and/or performance optimizations included in the decision 445. Additionally or alternatively, the execution function 450 generates the output(s) 455 to include instructions, commands, which when executed by the controlled entity 460, causes the controlled entity 460 to perform the actions, operations, tasks, actions, and/or performance optimizations included in the decision 445. Additionally or alternatively, the execution function 450 generates the output(s) 455 to include the policies, rule sets, and/or configurations (or configuration parameters) included in the decision 445, and provisions those policies, rule sets, and/or configurations (or configuration parameters) in the controlled entity 460. Here, the controlled entity 460 will operate according to the policies, rule sets, and/or configurations (or configuration parameters) once provisioned. Additionally or alternatively, various other output(s) 455 may be provided to the controlled entity 460 at some interval, on-demand, and/or based on some trigger event or conditions. Results and/or data 465 based on the output(s) 455 is/are provided to the collector 410, the monitoring function 420, and/or the analysis function 430, which are then used to adapt aspects of the control loop 400 during later iterations or epochs. The control loop 400 process continues in an iterative and/or continuous fashion.

As examples, the controlled entity 460 may be, or may represent, any combination of MHUs 322 and/or sensors 321; the control system 302 may be, include, or otherwise represent the collector 410 and/or the monitor 420; and the AI/ML system 312 may be, include, or otherwise represent the analytics function 430 and the decision function 440. In another example, the controlled entity 460 may be, or may represent, the control system 302 itself. In any of the aforementioned examples, the execution function 450 may be part of the AI/ML system 312 and/or the control system 302. Other arrangements and/or configurations of the control loop elements 410, 420, 430, 440, 450, and 460 in other example implementations.

As examples, the input(s) 415 and/or the data 425 can include data of data streams 331, 332 discussed previously, the data stream data 342, previous and/or current inferences 343, and/or any of the other types of data discussed herein. Additionally or alternatively, the input(s) 415 and/or the data 425 can include system-based metrics, such as any of those discussed herein in *Intel® VTune™ Profiler User Guide*, Intel Corp., version 2022 (2 Jun. 2022) ("[VTune]"), the contents of which are hereby incorporated by reference in its entirety. Additionally or alternatively, the input(s) 415 and/or the data 425 can include performance measurements, key performance indicators (KPIs), performance threshold monitoring events, and/or fault supervision events. Additionally or alternatively, the input(s) 415 and/or the data 425 can include security and/or resiliency related events such as, for example, voltage drops, memory error correction events (e.g., memory error correction being above a threshold and/or the like), thermal events (e.g., temperature of a device or component exceeding a threshold and/or the like), detection of physical SoC intrusion (e.g., at a sensor and/or other component(s)), vibration levels (e.g., periodic readings when vibrations exceed a threshold, and/or the like), and/or other suitable security and/or resiliency related data. Additionally or alternatively, the input(s) 415 and/or the data 425 can include performance extrema events such as, for example, loss of heartbeat signals for a period of time, reported timeouts from individual MRF components and/or hardware (HW) components, and/or the like. Additionally or alternatively, the input(s) 415 and/or the data 425 can include various identifiers (IDs), network IDs, session IDs, application instance IDs, and/or any other type of data such as any of those discussed herein.

In some examples, the input(s) 415 and/or the output(s) 455 can include goals, policies, rule sets, configurations, actions, tasks, and/or performance optimizations. Additionally or alternatively, the goals, policies, configurations, actions, and/or individual parameters of the goals, policies, rule sets, configurations, actions, tasks, and/or performance optimizations can be updated from time to time via suitable request messages that are input(s) 415 to the control loop 400. Additionally or alternatively, the output(s) 455 and/or data/results 465 can be used to adjust one or more parameters, characteristics, goals, policies, configurations, actions, tasks, performance optimizations, and/or other aspects of the control loop 400.

A goal is a desired result or outcome, and is usually set within certain parameter boundaries, such that the control loop 400 can automatically adjust one or more actions/tasks and/or output(s) 455 based on the input(s) 415 within the specified parameter boundaries. The policies may include a set of guidelines or rules intended to achieve a desired outcome, and may be used for decision making by the decision function 440 and/or other purposes. A configuration may be an arrangement of one or more functional units, set of resources, and/or a set of parameters used to set various settings of a system, device, component, and/or other element(s). In some implementations, a configuration includes a set of capabilities that allow a consumer or other entity to govern and/or monitor the controlled entity 460, including, for example, lifecycle management (e.g., including creating, modifying, activating and/or deactivating, and deleting and/or terminating the controlled entity 460), configuring goals for the controlled entity 460, monitoring goal fulfillment of the controlled entity 460, and/or the like. Additionally or alternatively, the configuration(s) can include or indicate various control parameters such as, for example, settings, parameters, conditions, trigger events, and/or one or more actions to be taken based on indicated input(s) 415, data 425, insight(s) 435, and/or decision(s) 445.

An action may include an instruction, command, or indication of how a system, device, component, or other element/entity should be changed, or has been changed. Examples of the actions includes adjusting the number of processor cores and/or processing devices allocated to a particular workload, adjusting a core frequency, adjusting an uncore frequency, adjusting cache allocations, adjusting one or more hardware (HW) and/or software (SW) configuration parameters that affect execution of a workload, adjusting one or more configuration parameters (e.g., including any of those discussed herein), causing an output, causing an actuation element to change its state or the state of some other entity/element, causing signaling, and/or any other action(s), such as any of those discussed herein. As examples, the control actions can be application specific such as, for example, adjusting the speed and/or direction of a conveyor when the controlled entity 460 is a conveyor, changing the type of material to be sorted when the controlled entity 460 is a sorter MHU 322, changing the speed at which material is sorted when the controlled entity 460 is a sorter MHU 322, changing the type of data to be collected/monitored when the controlled entity 460 is a sensor 321, changing the intervals of sensor data reporting when the controlled entity 460 is a sensor 321, changing the location/position and/or orientation when the controlled entity 460 is a sensor 321 and/or an MHU 322, and/or the like. The adjustment, alteration, and/or tuning of resources and/or services is completed by the continuous iteration of the steps in the control loop 400.

In some implementations, the input(s) 415, output(s) 455, and/or results data 465 include data concerning the controlled entity 460 such as, for example, resources used by the controlled entity 460; status information related to the functioning of the controlled entity 460 and/or components therein; device, system, or service KPIs of the controlled entity 460; and/or other devices or systems that is/are monitored by the monitoring function 420, analyzed by the analytics function 430, and so forth. Additionally or alternatively, the input(s) 415 and/or results data 465 can include ML model parameters (e.g., training/observation data 343, ML model tuning parameters, and/or the like) for the AI/ML system(s) 312. In some examples, the ML model parameters and/or ML weights/biases can be provided via input(s) 415. Additionally or alternatively, the output(s) 455 can include, for example, control statuses (e.g., results of various control governance and/or control management commands/actions, and/or the like), updated/adjusted goals, policies, configurations, actions, and/or updated/adjusted parameters of goals, policies, configurations, and/or actions.

Figure 12:
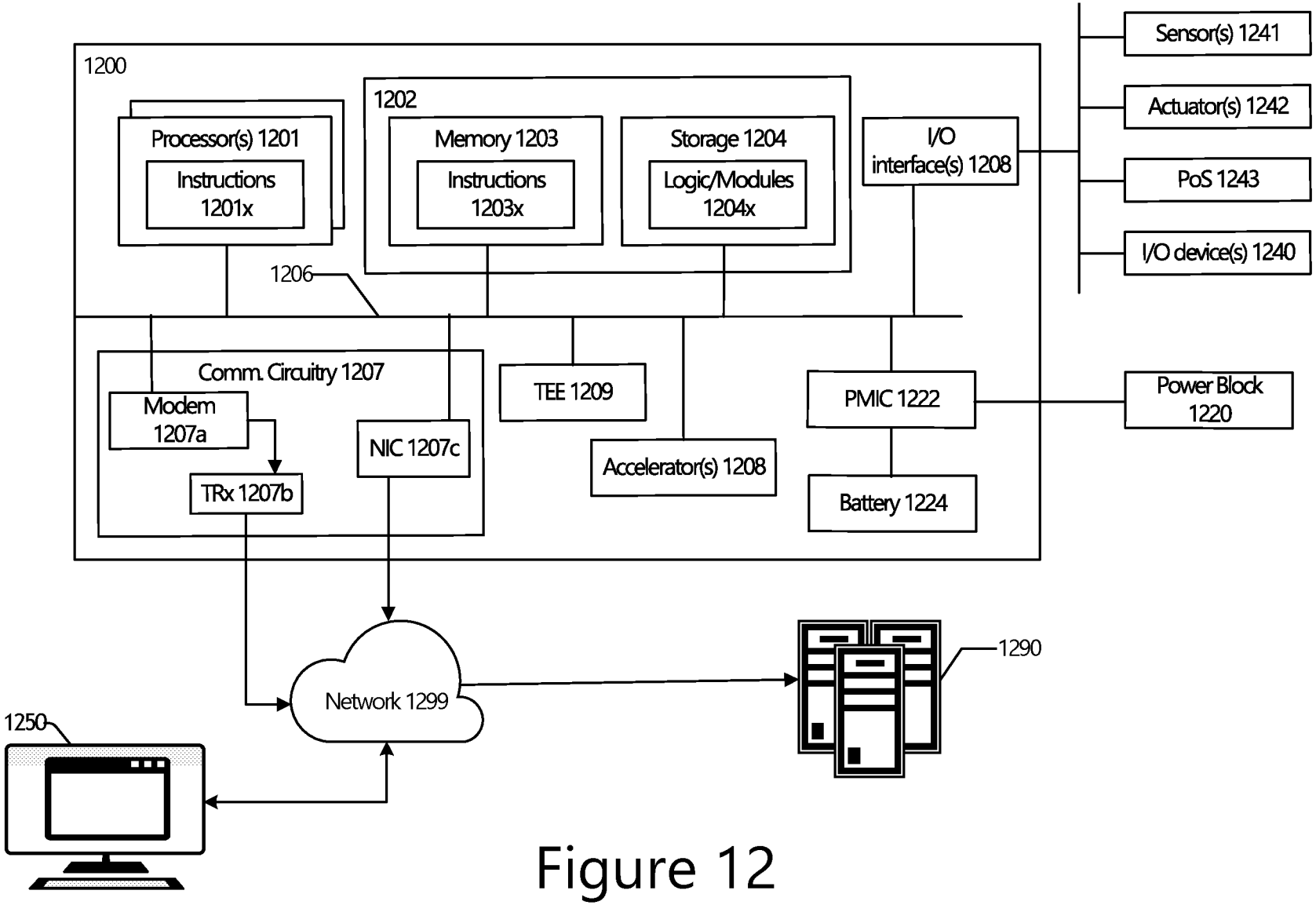
FIG. 12 illustrates an example computing system suitable for practicing various aspects of the present disclosure.

In some examples, the controlled entity 460 is embodied as an MRF component (e.g., control system 302, an MHU 322, and/or compute node 1200 of FIG. 12 discussed infra), the collector 410 includes or represents a set of sensors (e.g., sensor(s) 321, 1241, and/or the like) in the MRF component or otherwise accessible to the MRF component, and the outputs(s) 455 include actions to alter or adjust various operational parameters of the MRF component to optimize performance of the MRF component itself and/or optimize the performance of the MRF as a whole. Additionally or alternatively, the outputs(s) 455 include actions to alter or adjust various operational parameters of the set of sensors, such as location/position of individual sensors, orientation of individual sensors, collection monitoring aspects of individual sensors (e.g., zoom and/or lighting aspects for image capture devices, and the like), and so forth. Additionally or alternatively, the collector 410 can include or represents other components of the MRF component such as, for example, any of the components and/or controllers discussed herein (see e.g., actuators 1242 of FIG. 12 discussed infra), and the outputs(s) 455 include actions to alter or adjust various operational parameters of these components, such as, for example, changing the state of end effector tools, changing (e.g., switching out) end effector tools of a robotic sorter, changing the vibration frequency of vibrational sorters, changing the direction and/or speed of conveyors, causing mobility components to move to different locations and/or orientations, and/or the like.

In some implementations, each of the functions/elements 410, 420, 430, 440, 450, 460 are implemented by respective physical compute nodes connected to one another using one or more communication technologies such as any of those discussed herein. Additionally or alternatively, each of the functions 410, 420, 430, 440, 450, 460 are implemented as respective network functions (NFs) and/or respective application functions (AFs). Additionally or alternatively, each of the functions 410, 420, 430, 440, 450, 460 are implemented as, or operate within respective virtualization containers and/or respective virtual machines (VMs). In other implementations, each of the functions 410, 420, 430, 440, 450, 460 is implemented by a single virtual or physical computing device/system. In either of the aforementioned implementations, some or all of the functions 410, 420, 430, 440, 450, 460 is/are operated by separate processing elements/devices within one or more virtual or physical computing devices/systems. Additionally or alternatively, some or all of the functions 410, 420, 430, 440, 450, 460 are operated by a single processing element. Additionally or alternatively, one or more stream processors are used to operate one or more of the functions 410, 420, 430, 440, 450, 460.

Additionally or alternatively, the input(s) 415, data 425, insights 435, decision(s) 445, output(s) 455, and results data 465, can be expressed as one or more attributes and/or parameters, and/or using suitable data structure(s) and/or information object(s) (e.g., electronic documents, files, packages, and/or the like). Additionally or alternatively, the control loop 400 can include one or more signaling or communication technologies for transferring or otherwise conveying information between the various functions 410, 420, 430, 440, 450, 460, such as any of the technologies and/or protocols discussed herein. In one example, the functions 410, 420, 430, 440, 450, 460 can communicate with one another using one or more of API(s), web service(s), middleware, SW connectors, file transfer mechanisms discussed, data streaming mechanisms, notification mechanisms, Telemetry Network Standards (TmNS) standards, and/or any other mechanisms such as those discussed herein, and/or any combination thereof.

FIGS. 5, 6, and 7 show example MHU arrangements 500, 600, and 700, respectively, including multiple sorting lines 501*a* to 501*g* (collectively referred to as "sorting lines 501" and/or the like), each of which is designated to sort a particular material out of a waste stream. In this example, sorting line 501*a* is designated to sort residue (e.g., green waste, kitchen food waste, and/or the like), sorting line 501*b* is designated to sort used beverage cans (UBC) (e.g., [97/129/EC] resin identification code (RIC) 41 (aluminum), [97/129/EC] resin identification code (RIC) 40 (steel), tin, and the like), sorting line 501*c* is designated to sort polyethylene terephthalate (PET or PETE) (e.g., [97/129/EC] RIC 1 materials), sorting line 501*d* is designated to sort high-density polyethylene (HDPE) (e.g., [97/129/EC] RIC 2 materials), sorting line 501*e* is designated to sort rare earth elements (REEs) (e.g., light REEs (LREEs), heavy REEs (HREEs), and the like), sorting line 501*f* is designated to sort polypropylene (PP) (e.g., [97/129/EC] RIC 5 materials), and sorting line 501*g* is designated to sort melamine-phenol resin (MP) (e.g., [GB/T16288] code 41 materials, and/or the like). Each sorting line 501 also includes a conveyor 525*a* to 525*g* (collectively referred to as "conveyors 525" and/or the like) and one or more MHUs 522-1 to 522-8 (collectively referred to as "MHUs 522" and/or the like). In the example of FIGS. 5-7, the MHUs 522 are robotic sorters. However, MHUs 522 may be any other type of MHUs, including any of the MHUs 322 discussed herein. Additionally, each MHU 522 may be the same or different than another MHU 522 (e.g., MHU 522-1 may be a first type of robotic sorter, MHU 522-2 may be a second type of robotic sorter, and so forth).

During operation, an initial material stream goes through an initial sorting/separation phase to separate out undesirable materials. As an example, the initial sorting/separation phase may be performed by one or more optical sorters 322 (not shown by FIGS. 5-7). After the initial separation phase, the somewhat refined material stream 506 is routed towards the sorting lines 501 via conveyor 505, and individual MHUs 522 are configured to further refine or further separate/sort a predetermined or configured material from the material stream 506. For example, FIG. 5 shows an initial MHU arrangement 500 where MHU 522-3 on sorting line 501*a* is configured to sort out residue from the material stream 506, MHU 522-4 on sorting line 501*b* is configured to sort out UBC materials from the material stream 506, MHU 522-1 on sorting line 501*c* is configured to sort out PET from the material stream 506, MHU 522-2 on sorting line 501*d* is configured to sort out HDPE from the material stream 506, MHU 522-6 on sorting line 501*e* is configured to sort out REEs from the material stream 506, MHUs 522-7 and 522-8 on sorting line 501*f* is configured to sort out PP from the material stream 506, and MHU 522-5 on sorting line 501*g* is configured to sort out MP from the material stream 506.

At some point later, the MRF (or control system 302) is triggered to prioritize sorting out PET materials, wherein the main optical sorter 322 (not shown by FIGS. 5-7) supports ejecting on PET (e.g., sorting or separating out PET materials from an initial (raw) waste stream), and the control system 302 can send instructions 333 to individual MHUs 522 to rearrange the MHUs 522 to support more aggressive PET sorting as shown by FIG. 6. FIG. 6 shows an MHU arrangement 600 for elevated PET content, wherein MHUs 522-5 and 522-6 have been retasked to handle PET sorting with MHU 522-1. Here, the instructions 333 from the control system 302 cause the MHUs 522-5 and 522-6 to move from their original positions and orientations on sorting line 501*f*, and move to a different position and/or orientation on sorting line 501*c*. Additionally, the AI/ML system(s) 312 may have determined that sorting REE materials should be prioritized over sorting MP materials, and as such, the control system 302 may send instructions 333 to MHU 522-7 to retask MHU 522-7 to sort REE materials instead of PP materials. These instructions 333 from the control system 302 cause the MHU 522-7 to move from its original position and orientation on sorting line 501*f*, and move to a different position and/or orientation on sorting line 501*e*. In some implementations, after some time, or in response to trigger event or condition, the MRF (or control system 302) can cause the MHUs 522 to be rearranged into the initial arrangement 500 of FIG. 5 or to be rearranged into some other arrangement (e.g., arrangement 700 of FIG. 7).

In another example, the MRF (or control system 302) is triggered to prioritize sorting out HDPE materials, wherein the main optical sorter 322 (not shown by FIGS. 5-7) supports ejecting on HDPE (e.g., sorting or separating out HDPE materials from an initial (raw) waste stream and/or a different material stream), and the control system 302 sends instructions 333 to individual MHUs 522 to rearrange the MHUs 522 to support more aggressive HDPE sorting as shown by FIG. 7. FIG. 7 shows an MHU arrangement 700 for elevated HDPE content. In this example, MHUs 522-7 and 522-8 have been retasked to handle HDPE sorting on sorting lines 501*d* and 501*e*, respectively. This may be done in a same or similar manner as discussed previously. In addition to retasking the MHUs 522-7 and 522-8, the control system 302 has also retasked the sorting line 501*e* from sorting REE materials to sorting additional HDPE materials, which may involve reconfiguring the MHU 522-6 to sort for HDPE materials. The reconfiguration of MHU 522-6 can involve providing or enabling a new/different AI/ML model to recognize and sort out HDPE materials, and/or can involve causing the MHU 522-6 to adjust its position and/or orientation with respect to the conveyor 525*e* and/or the other MHU 522-8. Additionally, the AI/ML system(s) 312 may have determined that sorting MP materials should be prioritized over sorting PP materials, and as such, the control system 302 may or may not send instructions 333 to one or more MHUs 522 to retask those MHUs 522 to sort MP materials (depending on the arrangement of MHUs when the MRF/control system 302 is triggered to prioritize sorting out HDPE materials). In some implementations, after some time, or in response to trigger event or condition, the MRF (or control system 302) can cause the MHUs 522 to be rearranged back into the initial arrangement 500 of FIG. 5 or to be rearranged into some other arrangement.

Figure 8:
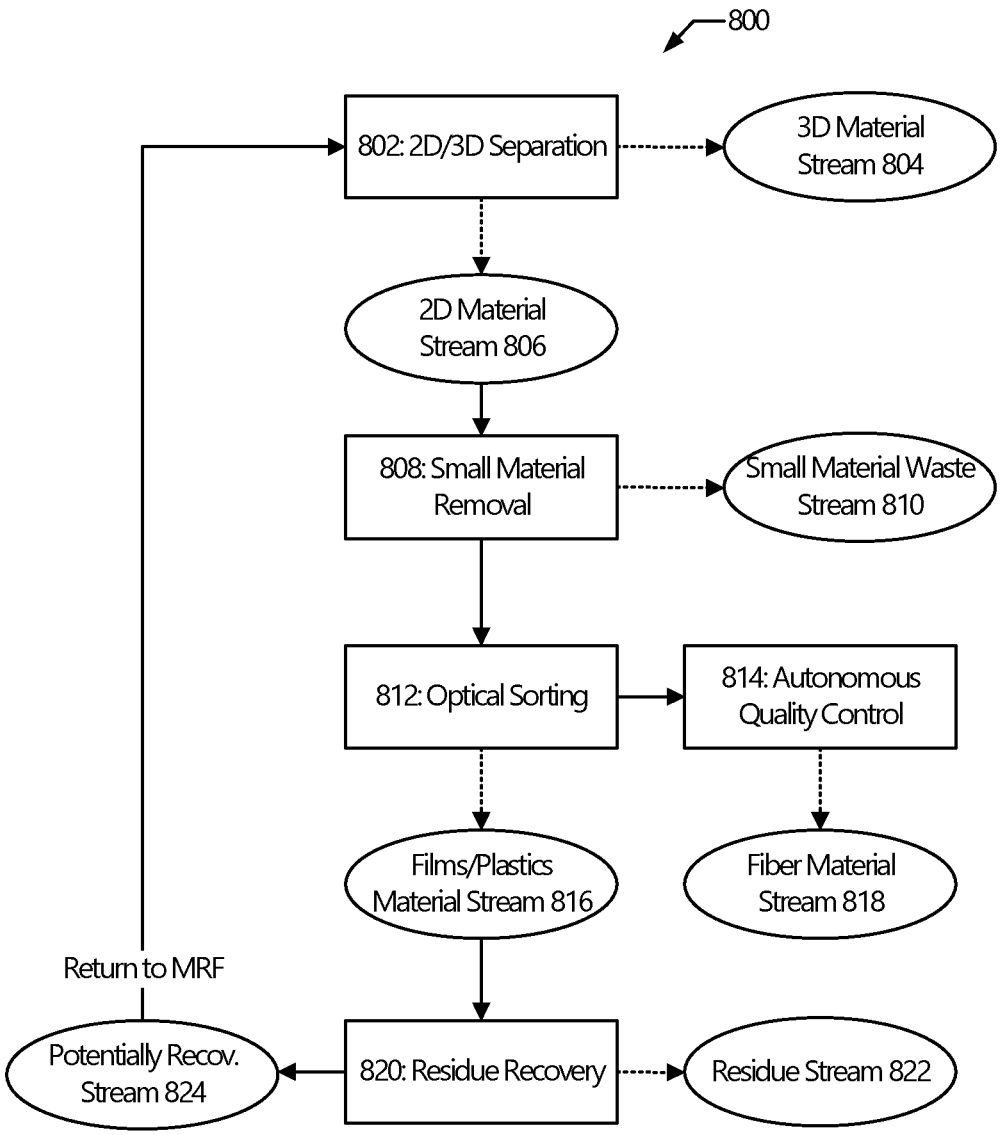
FIGS. 8, 9, and 10 depicts an example material separation processes.

FIG. 8 depicts an example 2D-3D separation process 800, the resulting sorting to allow the solid waste system to create a clean fiber stream utilizing mechanical, optical and robotic sorting, that may be carried out by the system of FIG. 3. The operations for process 800 for automated sorting of solid waste, optimizing or maximizing recovery of recyclable or reusable materials, and purification of recyclable/recoverable waste streams is depicted. Process 800 may be carried out by one or more components of system 300, such as control system 302 and/or one or more MHUs 322. Various operations may be added, omitted, repeated, or carried out in a different sequence depending upon the requirements of a given MRF and implementation. Although FIG. 8 is described as processing and sorting various types of materials, any other type of materials may be sorted according to the aspect discussed infra. For example, process 800 may be used to sort or otherwise process any of the materials discussed in *COMMISSION DECISION of* 28 *Jan.* 1997 *establishing the identification system for packaging materials pursuant to European Parliament and Council Directive* 94/62*/EC on packaging and packaging waste*, Official Journal of the European Communities, No. L 50, pp. 28-31 (28 Jan. 1997) (197/129/EU), *Standard Practice for Coding Plastic Manufactured Articles for Resin Identification*, ASTM International, ASTM D7611/D7611M-21 (2021) ("[D7611]"), *Marking of Plastics Products*, Standardization Administration of the People'S Republic of China (SAC), Standard GB/T16288-2008 (11 Apr. 2008) ("[GB/T16288]"), and/or *Plastics—Generic identification and marking of plastics products*, International Organization for Standardization (ISO), ISO 11469:2016 (October 2016).

Starting with operation 802, 2D materials are separated from 3D materials. This may be initially performed via air separation system 12 and/or screens, such as separation screen 46, as described above w.r.t FIGS. 1 and 2. Additional sorting may be refined via one or more MHUs 322, such as, for example, robotic sorters, optical sorters, air soring systems, mechanical sorters, among other possible MHUs 322. Additionally or alternatively, the sorting may be done using one or more MHUs 322. The result of operation 802 includes two resultant material streams including a 3D material stream 804 and a 2D material stream 806. The 3D material stream 804 including 3D objects, such as containers (e.g., milk cartons, jugs, bottles, cans, and/or the like), and the 2D material stream 806 includes objects, such as paper products and films (e.g., plastic, metal, and/or the like). The 3D materials may be handled as described infra w.r.t process 900 of FIG. 9. In some examples, the 2D material stream 806 is produced as a result of the sorting procedures discussed previously w.r.t FIGS. 1 and 2, and conveyed by conveyor 54. However, the 2D materials may be further purified (or solely purified) by the sorting methods described herein.

The 2D material stream 806 passes on to small material processing in operation 808, where small materials are removed from the 2D material stream 806, for example, via a screen as described w.r.t FIGS. 1 and 2. Additionally or alternatively, the small materials are sorted out under the direction of the control system 302 by means of robotic, optical, air sorters as described previously. Small materials may include items, such as napkins and flat containers, and form a separate waste stream 810, which is separate from the main waste stream 806.

Following removal of small 2D materials, at operation 812, an optical sorter 322 sorts and/or separates out film/plastics and fiber into a films/plastics stream 816 and fiber material stream 818, respectively. The optical sorter 322 is able to distinguish between fibers and film/plastics using characteristics, such as reflectivity/absorption of certain light wavelengths (e.g., infrared and/or the like). In other implementations, other sorting machines may be used in addition to or instead of the optical sorter 322. Following the optical sorting at operation 812, the separated fiber material stream 818 is processed at operation 814. In some implementations, this further processing is done through a an autonomous quality control (AQC) station in communication with the control system 302 for autonomous quality control, and potential removal of any remaining contaminants not removed in the optical sort. In one example, the AQC station is the same or similar as the AQC-2 robotic sorters 1102, 1106 discussed infra w.r.t FIG. 11. The result of the AQC is a (more) purified fiber material stream 818 than was produced using only the optical sorting.

Following removal of small 2D materials and fiber materials, the remaining waste stream may include only film and miscellaneous 2D plastic materials. Such waste stream may be subject to residue recovery at operation 820. Operation 820 may include further detection and separation of any remaining contaminants and/or waste material that would otherwise reduce the purity of the recyclable material stream(s) (e.g., films/plastics stream 816 and/or purified fiber material stream 818), or otherwise diminish the amount of materials recovered into the recyclable stream. Such processing may be carried out by a robotic sorter, optical sorter, air system, and/or another suitable sorting mechanism, which further may be configured by the control system 302 to locate specific types of contaminants using AI/ML systems 312. The result of operation 820 is a residue stream 822 of mostly or entirely unrecoverable material (or non-commodity materials), which may be sent to a landfill or other suitable disposal facility, and a stream 824 of potentially recoverable materials that is refed or otherwise sent back through the MRF for reprocessing.

Although the potentially recoverable material stream 824 is shown as being placed back into initial 2D/3D separation at operation 802, this is only by way of example. Some implementations involve redirecting the potentially recoverable material stream 824 to one or more intermediate steps or stations within the MRF. Here, the control system 302 and/or AI/ML systems 312 determine the optimal location to reintroduce the potentially recoverable stream 824 in the MRF on the basis of real-time input 331 from one or more sensors 321 and/or status information 332 from relevant MHUs 322, and thus control various MHUs 322 in the MRF as appropriate to route the potentially recoverable stream 824. Additionally or alternatively, the control system 302 can determine that a final sort carried out by human workers is necessary to achieve a desired purity level and/or maximize recovery for any of the streams obtained in process 800, and may so direct human workers to carry out a final sort on any given stream. This final human sort may also be applied to waste streams resulting from methods 900 and 1000 described infra.

Figure 9:
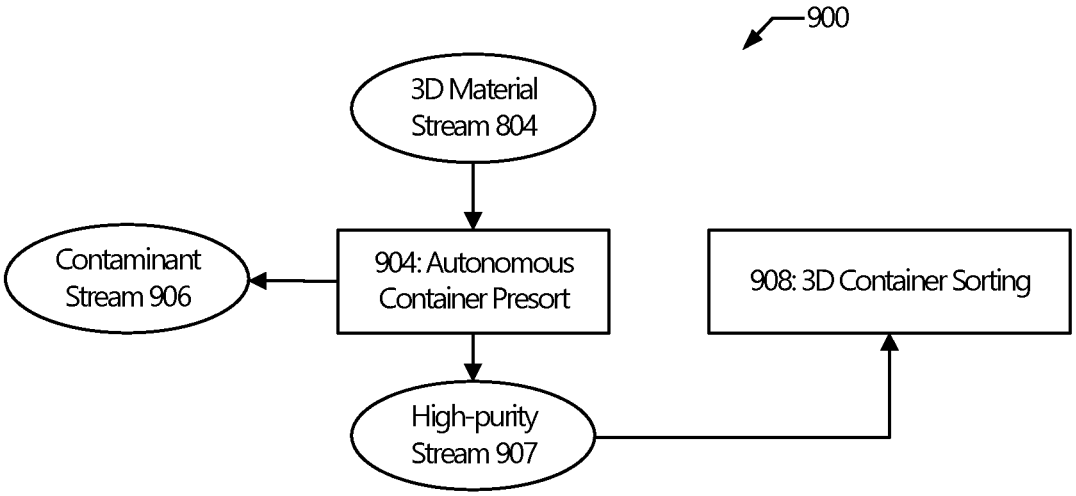

FIG. 9 depicts an example 3D material stream separation process 900 that allows the solid waste system to create a clean 3D container stream from the resulting streams of FIGS. 1 and 2, utilizing mechanical and robotic sorting on the container line presort, that may be carried out by the system 300 of FIG. 3. FIG. 9 depicts the operations for example process 900, which may be carried out in whole or in part by one or more components of system 300. Various operations may be added, omitted, repeated, or carried out in a different sequence depending upon the requirements of a given MRF and implementation. Process 900 starts with obtaining the 3D material stream 804 from operation of process 800. At operation 904, an autonomous container presort is carried out by a sorting MHU 322 (e.g., one or more robotic sorters, one or more optical sorters, one or more air systems, and/or the like). This presort results in a contaminant stream 906 and a high-purity recyclable stream 907 including 3D containers, which are subject to further sorting at operation 908. The contaminant stream 906 includes materials, such as fiber materials, OCC, and/or other residues. These residues may have been mis-sorted earlier, and so may be routed back into the MRF at an appropriate stage for further processing and redirection to a recyclable waste stream. Additionally or alternatively, the residues may be too highly contaminated (e.g., saturated with moisture, oil, or another contaminant) to allow for recovery, and so may be combined with other non-recoverable waste streams for eventual shipment to a landfill, to a waste energy facility, or another suitable handling facility.

Figure 10:
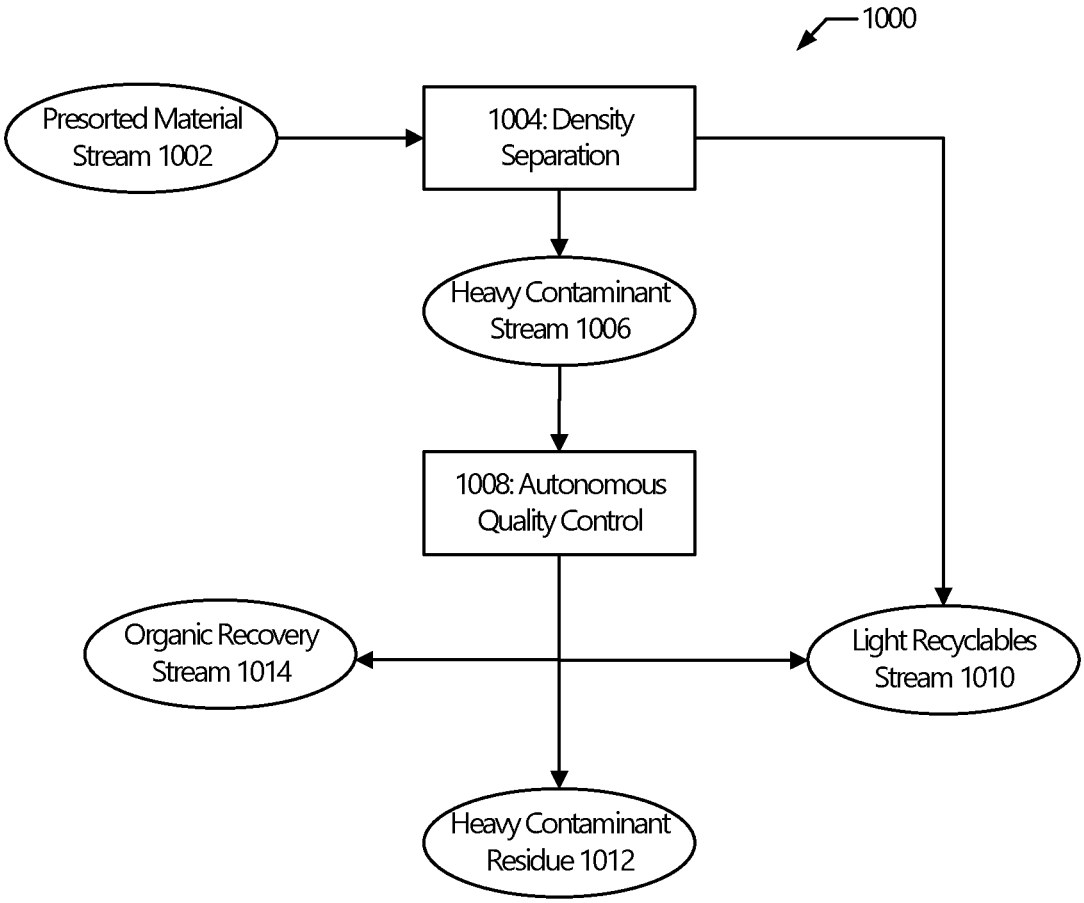

FIG. 10 depicts an example heavies residue separation process 1000 that occurs prior to the 2D-3D separation, wherein plastics and metals can be recovered using robotic sorting, which may be carried out at least in part by the system of FIG. 3. FIG. 10, the operations for an example method 1000, which may be carried out in whole or in part by one or more components of the system 300 of FIG. 3. Various operations may be added, omitted, repeated, or carried out in a different sequence depending upon the requirements of a given MRF and implementation. Process 1000 begins where a presorted material stream 1002 is obtained. In some examples, the presorted material stream 1002 includes objects of 0-24". Additionally or alternatively, the presorted material stream 1002 may be the same or similar as the small material waste stream 810 from process 800. Different implementations may presort for different material sizes. Additionally or alternatively, the operations of process 1000 may be carried out in parallel to the operations of process 800. At operation 1004, a density separation is performed on the presorted material stream 1002. This separation may occur via air separation 12 of FIGS. 1 and 2, where heavier, more dense objects fall from the air stream to conveyor 40. Additionally or alternatively, an air system 322 or load cell in a conveyor 322 can be used to provide sorting via mass and/or density. For example, a conveyor 322 may detect higher density (and thus more massive) objects, which control system 302 can use to redirect the detected materials to an appropriate processing stage in the MRF.

A result of the density separation at operation 1004 is a waste stream 1006 of heavy contaminants (e.g., aggregates, textiles, construction debris, and/or other similarly dense materials). This heavy contaminant stream 1006 can be passed through an AQC station at operation 1008, where the control system 302 directs one or more MHUs 322 to further extract any possibly recyclable/recoverable materials. As an example, the AQC station is the same or similar as the AQC-2 robotic sorters 1102, 1106 discussed infra w.r.t FIG. 11.

The result of the AQC at operation 1008, as well as earlier density separation operation 1004, is a light recyclable materials stream 1010 and an organic materials stream 1014, which may be subject to organic recovery methods (e.g., packaging, waste energy generation, and/or the like). This waste stream may rejoin the final product of process 800 in operation 822, if of sufficient purity, or may be returned to an earlier block of process 800 for reprocessing. Finally, a heavy contaminant residue stream 1012 remains. This residue stream 1012 may be sent to a landfill, a waste energy generation plant, another suitable disposal facility, or may be returned back to an earlier stage in the MRF for reprocessing as appropriate. In other implementations, the control system 302 performs or causes further quality control processes and/or sorting to be performed on the residue stream 1012, either automatically via one or more MHUs 322 and/or via human processing, to ensure that any recyclable materials that remain are extracted prior to final disposal of the residue.

Additionally or alternatively, a system for separating lightweight material that is configured to receive a mixture of 2D and 3D recyclable materials is also included, wherein the 2D and 3D objects are separated by shape. These 3D objects are then sorted according to material. The objects removed can include, but are not limited to: paper, cardboard, film plastic and other general residual components. The remaining stream includes the lightweight recyclable containers. The automated system may include any form of robotic sorting such as but not limited to a six axis robot, parallel robot, or delta robot. Additionally or alternatively, a multiple component solid waste facility that requires unprocessable material to be removed prior to the size, density and shape sorting components. This presort is done using a large automated system to remove these objects by material type or composition. The identification equipment on the system presort would be able to identify metals, compound plastics, large objects, and includes volatile compounds such as batteries, propane tanks and fuel cells.

Figure 11:
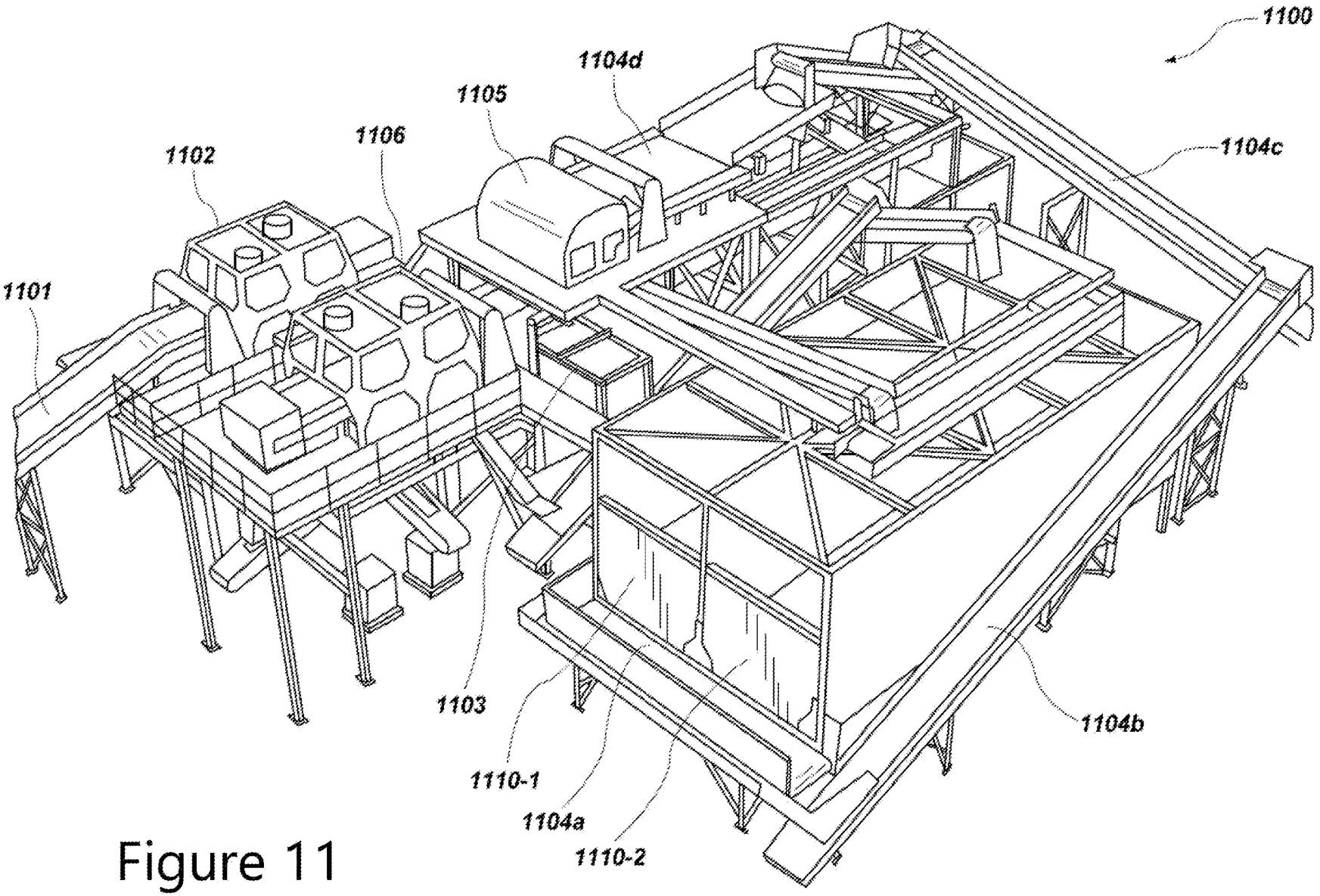
FIG. 11 depicts a perspective view of an example autonomous processing system that can be deployed as or in an MRF.

FIG. 11 shows a perspective view of an example autonomous material processing system 1100, which includes various MHUs 322. Operation of the MRF system 1100 begins with material being conveyed by conveyor 1101 passing under the robotic sorter 1102. The robotic sorter 1102 removes relatively large residue materials prior to entering the system 1100. At this stage the first material composition is created. The resulting composition data is utilized by the system 1100 to determine the priority that materials will be sorted for subsequent processing loop cycles.

Next, the inbound material passes under a magnet 1103 to remove ferrous metals, with the remaining material being conveyed to bunker 1110-1. Bunker 1110-1 is then opened and live feeds material via conveyor system 1104 (including conveyors 1104*a*, 1104*b*, 1104*c*, and 1104*d*) to the optical sorter 1105. The optical sorter 1105 is equipped with an AI/ML high speed object identification system and a metal detector to further sort the initial prioritized material as it is fed through the optical sorter 1105. This combined sensing technology can sort material based on shape, color, molecular composition, and/or based on other parameters. This allows for sorting complex materials throughout a variety of stream scenarios.

The commodity is ejected from the optical sorter 1105 and passes under a second robotic sorter 1106, which conducts a final quality control (QC) check/sort of the sorted fraction prior to the material entering its respective commodity bunkers 1110, ultimately to be baled. The default non ejected material is conveyed into bunker 1110-2. Once bunker 1110-2 is full, bunker 1110-1 closes and the system processes at full capacity from bunker 1110-2, removing each targeted commodity, respectively, based on the initial material composition until desired recovery values have been achieved. Once all targeted commodities have been depleted from bunker 1110-2, the system 1100 purges any remaining residue material and resumes processing material from bunker 1110-1, which continued to fill while the material from bunker 1110-2 were being processed. After all available materials have been processed, the autonomous processing system returns to idle, awaiting additional material availability.

In a first example implementation, the optical sorter 1105 is a SpydIR®-R optical sorter provided by National Recovery Technologies (NRT)®, the metal detector is an NRT® MetalDirector™ sorting system, and the AI/ML high speed object identification system is a Max-AI® system provided by Bulk Handling Systems®. In a second example implementation, which is combinable with the first example implementation, the robotic sorters 1102, 1106 are Autonomous Quality Control 2 (AQC-2) robotic sorters provided by Bulk Handling Systems®, which are equipped with Max-AI® systems.

2. Hardware System Configurations and Arrangements

FIG. 12 illustrates an example compute node 1200 (also referred to as "platform 1200," "device 1200," "appliance 1200," "system 1200", and/or the like), and various components therein, for implementing the techniques (e.g., operations, processes, methods, and methodologies) described herein. This compute node 1200 provides a closer view of the respective components of node 1200 when implemented as or as part of a computing device or system.

The compute node 1200 can include any combination of the hardware or logical components referenced herein, and may include or couple with any device usable with a communication network or a combination of such networks. In particular, any combination of the components depicted by FIG. 12 can be implemented as individual ICs, discrete electronic devices, or other modules, instruction sets, programmable logic or algorithms, hardware, hardware accelerators, software, firmware, or a combination thereof adapted in the compute node 1200, or as components otherwise incorporated within a chassis of a larger system. Additionally or alternatively, any combination of the components depicted by FIG. 12 can be implemented as a system-on-chip (SoC), a single-board computer (SBC), a system-in-package (SiP), a multi-chip package (MCP), and/or the like, in which a combination of the hardware elements are formed into a single IC or a single package.

The compute node 1200 includes physical hardware devices and software components capable of providing and/or accessing content and/or services to/from the remote system 1290. The compute node 1200 and/or the remote system 1290 can be implemented as any suitable computing system or other data processing apparatus usable to access and/or provide content/services from/to one another. The compute node 1200 communicates with remote systems 1290, and vice versa, to obtain/serve content/services using any suitable communication protocol, such as any of those discussed herein. In some implementations, the remote system 1290 may have some or all of the same or similar components as the compute node 1200. As examples, the compute node 1200 and/or the remote system 1290 can be embodied as desktop computers, workstations, laptops, mobile phones (e.g., "smartphones"), tablet computers, portable media players, wearable devices, server(s), network appliances, smart appliances or smart factory machinery, network infrastructure elements, robots, drones, sensor systems and/or IoT devices, cloud compute nodes, edge compute nodes, an aggregation of computing resources (e.g., in a cloud-based environment), and/or some other computing devices capable of interfacing directly or indirectly with network 1299 or other network(s). For purposes of the present disclosure, the compute node 1200 may represent any of the computing devices discussed herein, and may be, or be implemented in one or more of the control system 302, AI/ML system(s) 312, sensor systems 321, MHUs 322, 522, functions/elements 410, 420, 430, 440, 450, 460, sorters 1102, 1105, 1106, conveyors 525, 1104, and/or any other device or system discussed herein.

The compute node 1200 includes one or more processors 1201 (also referred to as "processor circuitry 1201"). The processor circuitry 1201 includes circuitry capable of sequentially and/or automatically carrying out a sequence of arithmetic or logical operations, and recording, storing, and/or transferring digital data. Additionally or alternatively, the processor circuitry 1201 includes any device capable of executing or otherwise operating computer-executable instructions, such as program code, software modules, and/or functional processes. The processor circuitry 1201 includes various hardware elements or components such as, for example, a set of processor cores and one or more of on-chip or on-die memory or registers, cache and/or scratchpad memory, low drop-out voltage regulators (LDOs), interrupt controllers, serial interfaces such as SPI, I2C or universal programmable serial interface circuit, real time clock (RTC), timer-counters including interval and watchdog timers, general purpose I/O, memory card controllers such as secure digital/multi-media card (SD/MMC) or similar, interfaces, mobile industry processor interface (MIPI) interfaces and Joint Test Access Group (JTAG) test access ports. Some of these components, such as the on-chip or on-die memory or registers, cache and/or scratchpad memory, may be implemented using the same or similar devices as the memory circuitry 1203 discussed infra. The processor circuitry 1201 is also coupled with memory circuitry 1203 and storage circuitry 1204, and is configured to execute instructions stored in the memory/storage to enable various apps, OSs, or other software elements to run on the platform 1200. In particular, the processor circuitry 1201 is configured to operate app software (e.g., instructions 1201*x*, 1203*x*, 1204*x*) to provide one or more services to a user of the compute node 1200 and/or user(s) of remote systems/devices.

As examples, the processor circuitry 1201 can be embodied as, or otherwise include one or multiple central processing units (CPUs), application processors, graphics processing units (GPUs), RISC processors, Acorn RISC Machine (ARM) processors, complex instruction set computer (CISC) processors, DSPs, FPGAs, programmable logic devices (PLDs), ASICs, baseband processors, radio-frequency integrated circuits (RFICs), microprocessors or controllers, multi-core processors, multithreaded processors, ultra-low voltage processors, embedded processors, a specialized x-processing units (xPUs) or a data processing unit (DPUs) (e.g., Infrastructure Processing Unit (IPU), network processing unit (NPU), and the like), and/or any other processing devices or elements, or any combination thereof. In some implementations, the processor circuitry 1201 is embodied as one or more special-purpose processor(s)/controller(s) configured (or configurable) to operate according to the various implementations and other aspects discussed herein. Additionally or alternatively, the processor circuitry 1201 includes one or more hardware accelerators (e.g., same or similar to acceleration circuitry 1208), which can include microprocessors, programmable processing devices (e.g., FPGAs, ASICs, PLDs, DSPs. and/or the like), and/or the like.

The compute node 1200 also includes non-transitory or transitory machine-readable media 1202 (also referred to as "computer readable medium 1202" or "CRM 1202"), which may be embodied as, or otherwise include system memory 1203, storage 1204, and/or memory devices/elements of the processor 1201. Additionally or alternatively, the CRM 1202 can be embodied as any of the devices/technologies described for the memory 1203 and/or storage 1204.

The system memory 1203 (also referred to as "memory circuitry 1203") includes one or more hardware elements/devices for storing data and/or instructions 1203*x* (and/or instructions 1201*x*, 1204*x*). Any number of memory devices may be used to provide for a given amount of system memory 1203. As examples, the memory 1203 can be embodied as processor cache or scratchpad memory, volatile memory, non-volatile memory (NVM), and/or any other machine readable media for storing data. Examples of volatile memory include random access memory (RAM), static RAM (SRAM), dynamic RAM (DRAM), synchronous DRAM (SDRAM), thyristor RAM (T-RAM), content-addressable memory (CAM), and/or the like. Examples of NVM can include read-only memory (ROM) (e.g., including programmable ROM (PROM), erasable PROM (EPROM), electrically EPROM (EEPROM), flash memory (e.g., NAND flash memory, NOR flash memory, and the like), solid-state storage (SSS) or solid-state ROM, programmable metallization cell (PMC), and/or the like), non-volatile RAM (NVRAM), phase change memory (PCM) or phase change RAM (PRAM) (e.g., Intel® 3D XPoint™ memory, chalcogenide RAM (CRAM), Interfacial Phase-Change Memory (IPCM), and the like), memistor devices, resistive memory or resistive RAM (ReRAM) (e.g., memristor devices, metal oxide-based ReRAM, quantum dot resistive memory devices, and the like), conductive bridging RAM (or PMC), magnetoresistive RAM (MRAM), electrochemical RAM (ECRAM), ferroelectric RAM (FeRAM), antiferroelectric RAM (AFeRAM), ferroelectric field-effect transistor (FeFET) memory, and/or the like. Additionally or alternatively, the memory circuitry 1203 can include spintronic memory devices (e.g., domain wall memory (DWM), spin transfer torque (STT) memory (e.g., STT-RAM or STT-MRAM), magnetic tunneling junction memory devices, spin-orbit transfer memory devices, Spin-Hall memory devices, nanowire memory cells, and/or the like). In some implementations, the individual memory devices 1203 may be formed into any number of different package types, such as single die package (SDP), dual die package (DDP), quad die package (Q17P), memory modules (e.g., dual inline memory modules (DIMMs), microDIMMs, and/or MiniDIMMs), and/or the like. Additionally or alternatively, the memory circuitry 1203 is or includes block addressable memory device(s), such as those based on NAND or NOR flash memory technologies (e.g., single-level cell ("SLC"), multi-level cell ("MLC"), quad-level cell ("QLC"), tri-level cell ("TLC"), or some other NAND or NOR device). Additionally or alternatively, the memory circuitry 1203 can include resistor-based and/or transistor-less memory architectures. In some examples, the memory circuitry 1203 can refer to a die, chip, and/or a packaged memory product. In some implementations, the memory 1203 can be or include the on-die memory or registers associated with the processor circuitry 1201. Additionally or alternatively, the memory 1203 can include any of the devices/components discussed infra w.r.t the storage circuitry 1204.

The storage 1204 (also referred to as "storage circuitry 1204") provides persistent storage of information, such as data, OSs, apps, instructions 1204*x*, and/or other software elements. As examples, the storage 1204 may be embodied as a magnetic disk storage device, hard disk drive (HDD), microHDD, solid-state drive (SSD), optical storage device, flash memory devices, memory card (e.g., secure digital (SD) card, eXtreme Digital (XD) picture card, USB flash drives, SIM cards, and/or the like), and/or any combination thereof. The storage circuitry 1204 can also include specific storage units, such as storage devices and/or storage disks that include optical disks (e.g., DVDs, CDs/CD-ROM, Blu-ray disks, and the like), flash drives, floppy disks, hard drives, and/or any number of other hardware devices in which information is stored for any duration (e.g., for extended time periods, permanently, for brief instances, for temporarily buffering, and/or caching). Additionally or alternatively, the storage circuitry 1204 can include resistor-based and/or transistor-less memory architectures. Further, any number of technologies may be used for the storage 1204 in addition to, or instead of, the previously described technologies, such as, for example, resistance change memories, phase change memories, holographic memories, chemical memories, among many others. Additionally or alternatively, the storage circuitry 1204 can include any of the devices or components discussed previously w.r.t the memory 1203.

Instructions 1201*x*, 1203*x*, 1204*x* in the form of computer programs, computational logic/modules (e.g., including the sorting logic discussed herein), source code, middleware, firmware, object code, machine code, microcode (μcode), or hardware commands/instructions, when executed, implement or otherwise carry out various functions, processes, methods, algorithms, operations, tasks, actions, techniques, and/or other aspects of the present disclosure. The instructions 1201*x*, 1203*x*, 1204*x* may be written in any combination of one or more programming languages, including object oriented programming languages, procedural programming languages, scripting languages, markup languages, machine language, and/or some other suitable programming languages including proprietary programming languages and/or development tools, or any other suitable technologies. The instructions 1201*x*, 1203*x*, 1204*x* may execute entirely on the system 1200, partly on the system 1200, as a stand-alone software package, partly on the system 1200 and partly on a remote system 1290, or entirely on the remote system 1290. In the latter scenario, the remote system 1290 may be connected to the system 1200 through any type of network 1299. Although the instructions 1201*x*, 1203*x*, 1204*x* are shown as code blocks included in the processor 1201, memory 1204, and/or storage 1220, any of the code blocks may be replaced with hardwired circuits, for example, built into memory blocks/cells of an ASIC, FPGA, and/or some other suitable IC.

In some examples, the storage circuitry 1204 is stores computational logic/modules configured to implement the techniques described herein. The computational logic 1204*x* may be employed to store working copies and/or permanent copies of programming instructions, or data to create the programming instructions, for the operation of various components of compute node 1200 (e.g., drivers, libraries, APIs, and/or the like), an OS of compute node 1200, one or more applications, and/or the like. The computational logic 1204*x* may be stored or loaded into memory circuitry 1203 as instructions 1203*x*, or data to create the instructions 1203*x*, which are then accessed for execution by the processor circuitry 1201 via the IX 1206 to carry out the various functions, processes, methods, algorithms, operations, tasks, actions, techniques, and/or other aspects described herein (see e.g., FIGS. 1-11 and 13). The various elements may be implemented by assembler instructions supported by processor circuitry 1201 or high-level languages that may be compiled into instructions 1201*x*, or data to create the instructions 1201*x*, to be executed by the processor circuitry 1201. The permanent copy of the programming instructions may be placed into persistent storage circuitry 1204 at the factory/OEM or in the field through, for example, a distribution medium (e.g., a wired connection and/or over-the-air (OTA) interface) and a communication interface (e.g., communication circuitry 1207) from a distribution server (e.g., remote system 1290) and/or the like.

Additionally or alternatively, the instructions 1201*x*, 1203*x*, 1204*x* can include one or more operating systems (OS) and/or other software to control various aspects of the compute node 1200. The OS can include drivers and/or APIs to control particular devices or components that are embedded in the compute node 1200, attached to the compute node 1200, communicatively coupled with the compute node 1200, and/or otherwise accessible by the compute node 1200. The OSs may also include one or more libraries, drivers, APIs, firmware, middleware, software glue, and the like, which provide program code and/or software components for one or more apps to obtain and use the data from other apps operated by the compute node 1200, such as the various subsystems of the control system 302, AI/ML system(s) 312, sensor systems 321, MHUs 322, 522, control loop 400, sorters 1102, 1105, 1106, conveyors 525, 1104, and/or any other device or system discussed herein. Example OSs include consumer-based OS, real-time OS (RTOS), and/or the like, but for purposes of the present disclosure, can also include hypervisors, container orchestrators and/or container engines.

The various components of the computing node 1200 communicate with one another over an interconnect (IX) 1206. The IX 1206 may include any number of IX (or similar) technologies including, for example, instruction set architecture (ISA), extended ISA (eISA), Inter-Integrated Circuit ($I^2C$), serial peripheral interface (SPI), point-to-point interfaces, power management bus (PMBus), peripheral component interconnect (PCI), PCI express (PCIe), PCI extended (PCIx), Intel® Ultra Path Interconnect (UPI), Intel® Accelerator Link, Intel® QuickPath Interconnect (QPI), Intel® Omni-Path Architecture (OPA), Compute Express Link™ (CXL™) IX, RapidIO™ IX, Coherent Accelerator Processor Interface (CAPI), OpenCAPI, Advanced Microcontroller Bus Architecture (AMBA) IX, cache coherent interconnect for accelerators (CCIX), Gen-Z Consortium IXs, a HyperTransport IX, NVLink provided by NVIDIA®, ARM Advanced eXtensible Interface (AXI), a Time-Trigger Protocol (TTP) system, a FlexRay system, PROFIBUS, Ethernet, USB, On-Chip System Fabric (IOSF), Infinity Fabric (IF), and/or any number of other IX technologies. The IX 1206 may be a proprietary bus, for example, used in a SoC based system.

In some implementations, the compute node 1200 includes one or more hardware accelerators 1208 (also referred to as "acceleration circuitry 1208", "accelerator circuitry 1208", or the like). The acceleration circuitry 1208 includes any suitable hardware device or collection of hardware elements that are designed to perform one or more specific functions more efficiently in comparison to general-purpose processing elements (e.g., those provided as part of the processor circuitry 1201). The acceleration circuitry 1208 can include various hardware elements such as, for example, one or more GPUs, FPGAs, DSPs, SoCs (including programmable SoCs and multi-processor SoCs), ASICs (including programmable ASICs), PLDs (including complex PLDs (CPLDs) and high capacity PLDs (HCPLDs), xPUs (e.g., DPUs, IPUs, and NPUs) and/or other forms of specialized circuitry designed to accomplish specialized tasks. Additionally or alternatively, the acceleration circuitry 1208 may be embodied as, or include, one or more of artificial intelligence (AI) accelerators (e.g., vision processing unit (VPU), neural compute sticks, neuromorphic hardware, deep learning processors (DLPs) or deep learning accelerators, tensor processing units (TPUs), physical neural network hardware, and/or the like), cryptographic accelerators (or secure cryptoprocessors), network processors, I/O accelerator (e.g., DMA engines and the like), and/or any other specialized hardware device/component. The offloaded tasks performed by the acceleration circuitry 1208 can include, for example, AI/ML tasks (e.g., training, feature extraction, model execution for inference/prediction, classification, and so forth), visual data processing, graphics processing, digital and/or analog signal processing, network data processing, infrastructure function management, object detection, rule analysis, and/or the like.

In some implementations, the processor circuitry 1201 and/or acceleration circuitry 1208 includes hardware elements specifically tailored for executing, operating, or otherwise providing AI and/or ML functionality, such as for operating the subsystems of the control system 302, AI/ML system(s) 312, sensor systems 321, MHUs 322, 522, control loop 400, sorters 1102, 1105, 1106, conveyors 525, 1104, and/or any other device or system discussed previously with regard to FIGS. 1-10. In these implementations, the circuitry 1201 and/or 1208 is/are embodied as, or otherwise includes, one or more AI or ML chips that can run many different kinds of AI/ML instruction sets once loaded with the appropriate weightings, training data, AI/ML models, and/or the like. Additionally or alternatively, the processor circuitry 1201 and/or accelerator circuitry 1208 is/are emboddied as, or otherwise includes, one or more custom-designed silicon cores specifically designed to operate corresponding subsystems of the control system 302, AI/ML system(s) 312, sensor systems 321, MHUs 322, 522, control loop 400, sorters 1102, 1105, 1106, conveyors 525, 1104, and/or any other device or system discussed herein. These cores may be designed as synthesizable cores comprising hardware description language logic (e.g., register transfer logic, verilog, Very High Speed Integrated Circuit hardware description language (VHDL), and the like); netlist cores comprising gate-level description of electronic components and connections and/or process-specific very-large-scale integration (VLSI) layout; and/or analog or digital logic in transistor-layout format. In these implementations, one or more of the subsystems of the control system 302, AI/ML system(s) 312, sensor systems 321, MHUs 322, 522, control loop 400, sorters 1102, 1105, 1106, conveyors 525, 1104, and/or any other device or system discussed herein may be operated, at least in part, on custom-designed silicon core(s). These "hardware-ized" subsystems may be integrated into a larger chipset but may be more efficient than using general purpose processor cores.

The TEE 1209 operates as a protected area accessible to the processor circuitry 1201 and/or other components to enable secure access to data and secure execution of instructions. In some implementations, the TEE 1209 may be a physical hardware device that is separate from other components of the system 1200 such as a secure-embedded controller, a dedicated SoC, a trusted platform module (TPM), a tamper-resistant chipset or microcontroller with embedded processing devices and memory devices, and/or the like. Additionally or alternatively, the TEE 1209 is implemented as secure enclaves (or "enclaves"), which are isolated regions of code and/or data within the processor and/or memory/storage circuitry of the compute node 1200, where only code executed within a secure enclave may access data within the same secure enclave, and the secure enclave may only be accessible using the secure app (which may be implemented by an app processor or a tamper-resistant microcontroller). In some implementations, the memory circuitry 1203 and/or storage circuitry 1204 may be divided into one or more trusted memory regions for storing apps or software modules of the TEE 1209.

Additionally or alternatively, the processor circuitry 1201, acceleration circuitry 1208, memory circuitry 1203, and/or storage circuitry 1204 may be divided into, or otherwise separated into virtualized environments using a suitable virtualization technology, such as, for example, virtual machines (VMs), virtualization containers (e.g., Docker® containers, Kubernetes® containers, and the like), and/or the like. These virtualization technologies may be managed and/or controlled by a virtual machine monitor (VMM), hypervisor container engines, orchestrators, and the like. Such virtualization technologies provide execution environments in which one or more apps and/or other software, code, or scripts may execute while being isolated from one or more other apps, software, code, or scripts.

The communication circuitry 1207 is a hardware element, or collection of hardware elements, used to communicate over one or more networks (e.g., network 1299) and/or with other devices. The communication circuitry 1207 includes modem 1207*a* and transceiver circuitry ("TRx") 1207*b*. The modem 1207*a* includes one or more processing devices (e.g., baseband processors) to carry out various protocol and radio control functions. Modem 1207*a* may interface with application circuitry of compute node 1200 (e.g., a combination of processor circuitry 1201, memory circuitry 1203, and/or storage circuitry 1204) for generation and processing of baseband signals and for controlling operations of the TRx 1207*b*. The modem 1207*a* handles various radio control functions that enable communication with one or more radio networks via the TRx 1207*b* according to one or more wireless communication protocols. The modem 1207*a* may include circuitry such as, but not limited to, one or more single-core or multi-core processors (e.g., one or more baseband processors) or control logic to process baseband signals received from a receive signal path of the TRx 1207*b*, and to generate baseband signals to be provided to the TRx 1207*b* via a transmit signal path. In various implementations, the modem 1207*a* may implement a real-time OS (RTOS) to manage resources of the modem 1207*a*, schedule tasks, and the like.

The communication circuitry 1207 also includes TRx 1207*b* to enable communication with wireless networks using modulated electromagnetic radiation through a non-solid medium. The TRx 1207*b* may include one or more radios that are compatible with, and/or may operate according to any one or more of the radio communication technologies, radio access technologies (RATs), and/or communication protocols/standards including any combination of those discussed herein. TRx 1207*b* includes a receive signal path, which comprises circuitry to convert analog RF signals (e.g., an existing or received modulated waveform) into digital baseband signals to be provided to the modem 1207*a*. The TRx 1207*b* also includes a transmit signal path, which comprises circuitry configured to convert digital baseband signals provided by the modem 1207*a* to be converted into analog RF signals (e.g., modulated waveform) that will be amplified and transmitted via an antenna array including one or more antenna elements (not shown). The antenna array may be a plurality of microstrip antennas or printed antennas that are fabricated on the surface of one or more printed circuit boards. The antenna array may be formed in as a patch of metal foil (e.g., a patch antenna) in a variety of shapes, and may be coupled with the TRx 1207*b* using metal transmission lines or the like.

The network interface circuitry/controller (NIC) 1207*c* provides wired communication to the network 1299 and/or to other devices using a standard communication protocol such as, for example, Ethernet (see e.g., IEEE Standard for Ethernet, IEEE Std 802.3-2018, pp. 1-5600 (31 Aug. 2018) ("[IEEE8023]")), Ethernet over GRE Tunnels, Ethernet over Multiprotocol Label Switching (MPLS), Ethernet over USB, Controller Area Network (CAN), Local Interconnect Network (LIN), DeviceNet, ControlNet, Data Highway+, PROFIBUS, or PROFINET, among many others. Network connectivity may be provided to/from the compute node 1200 via the NIC 1207*c* using a physical connection, which may be electrical (e.g., a "copper interconnect"), fiber, and/or optical. The physical connection also includes suitable input connectors (e.g., ports, receptacles, sockets, and the like) and output connectors (e.g., plugs, pins, and the like). The NIC 1207*c* may include one or more dedicated processors and/or FPGAs to communicate using one or more of the aforementioned network interface protocols. In some implementations, the NIC 1207*c* may include multiple controllers to provide connectivity to other networks using the same or different protocols. For example, the compute node 1200 may include a first NIC 1207*c* providing communications to the network 1299 over Ethernet and a second NIC 1207*c* providing communications to other devices over another type of network. As examples, the NIC 1207*c* is or includes one or more of an Ethernet controller (e.g., a Gigabit Ethernet Controller or the like), a high-speed serial interface (HSSI), a Peripheral Component Interconnect (PCI) controller, a USB controller, a SmartNIC, an Intelligent Fabric Processor (IFP), and/or other like device.

The input/output (I/O) interface circuitry 1208 (also referred to as "interface circuitry 1208") is configured to connect or communicatively coupled the compute node 1200 with one or more external (peripheral) components, devices, and/or subsystems. In some implementations, the interface circuitry 1208 may be used to transfer data between the compute node 1200 and another computer device (e.g., remote system 1290, client system 1250, and/or the like) via a wired and/or wireless connection. is used to connect additional devices or subsystems. The interface circuitry 1208, is part of, or includes circuitry that enables the exchange of information between two or more components or devices such as, for example, between the compute node 1200 and one or more external devices. The external devices include sensor circuitry 1241, actuator circuitry 1242, positioning circuitry 1243, and other I/O devices 1240, but may also include other devices or subsystems not shown by FIG. 12. Access to various such devices/components may be implementation specific, and may vary from implementation to implementation. As examples, the interface circuitry 1208 can be embodied as, or otherwise include, one or more hardware interfaces such as, for example, buses (e.g., including an expansion buses, IXs, and/or the like), input/output (I/O) interfaces, peripheral component interfaces (e.g., peripheral cards and/or the like), network interface cards, host bus adapters, and/or mezzanines, and/or the like. In some implementations, the interface circuitry 1208 includes one or more interface controllers and connectors that interconnect one or more of the processor circuitry 1201, memory circuitry 1203, storage circuitry 1204, communication circuitry 1207, and the other components of compute node 1200 and/or to one or more external (peripheral) components, devices, and/or subsystems. Additionally or alternatively, the interface circuitry 1208 includes a sensor hub or other like elements to obtain and process collected sensor data and/or actuator data before being passed to other components of the compute node 1200.

Additionally or alternatively, the interface circuitry 1208 and/or the IX 1206 can be embodied as, or otherwise include memory controllers, storage controllers (e.g., redundant array of independent disk (RAID) controllers and the like), baseboard management controllers (BMCs), input/output (I/O) controllers, host controllers, and the like. Examples of I/O controllers include integrated memory controller (IMC), memory management unit (MMU), input-output MMU (IOMMU), sensor hub, General Purpose I/O (GPIO) controller, PCIe endpoint (EP) device, direct media interface (DMI) controller, Intel® Flexible Display Interface (FDI) controller(s), VGA interface controller(s), Peripheral Component Interconnect Express (PCIe) controller(s), universal serial bus (USB) controller(s), FireWire controller(s), Thunderbolt controller(s), FPGA Mezzanine Card (FMC), eXtensible Host Controller Interface (xHCI) controller(s), Enhanced Host Controller Interface (EHCI) controller(s), Serial Peripheral Interface (SPI) controller(s), Direct Memory Access (DMA) controller(s), hard drive controllers (e.g., Serial AT Attachment (SATA) host bus adapters/controllers, Intel® Rapid Storage Technology (RST), and/or the like), Advanced Host Controller Interface (AHCI), a Low Pin Count (LPC) interface (bridge function), Advanced Programmable Interrupt Controller(s) (APIC), audio controller(s), SMBus host interface controller(s), UART controller(s), and/or the like. Some of these controllers may be part of, or otherwise applicable to the memory circuitry 1203, storage circuitry 1204, and/or IX 1206 as well. As examples, the connectors include electrical connectors, ports, slots, jumpers, receptacles, modular connectors, coaxial cable and/or BNC connectors, optical fiber connectors, PCB mount connectors, inline/cable connectors, chassis/panel connectors, peripheral component interfaces (e.g., non-volatile memory ports, USB ports, Ethernet ports, audio jacks, power supply interfaces, on-board diagnostic (OBD) ports, and so forth), and/or the like.

The sensor(s) 1241 (also referred to as "sensor circuitry 1241") includes devices, modules, or subsystems whose purpose is to detect events or changes in its environment and send the information (sensor data) about the detected events to some other a device, module, subsystem, and the like. In some implementations, the sensor(s) 1241 are the same or similar as the sensors 321 of FIG. 3. Individual sensors 1241 may be exteroceptive sensors (e.g., sensors that capture and/or measure environmental phenomena and/external states), proprioceptive sensors (e.g., sensors that capture and/or measure internal states of the compute node 1200 and/or individual components of the compute node 1200), and/or exproprioceptive sensors (e.g., sensors that capture, measure, or correlate internal states and external states). Examples of such sensors 1241 include inertia measurement units (IMU), microelectromechanical systems (MEMS) or nanoelectromechanical systems (NEMS), level sensors, flow sensors, temperature sensors (e.g., thermistors, including sensors for measuring the temperature of internal components and sensors for measuring temperature external to the compute node 1200), pressure sensors, barometric pressure sensors, gravimeters, altimeters, image capture devices (e.g., visible light cameras, thermographic camera and/or thermal imaging camera (TIC) systems, forward-looking infrared (FLIR) camera systems, radiometric thermal camera systems, active infrared (IR) camera systems, ultraviolet (UV) camera systems, and/or the like), light detection and ranging (LiDAR) sensors, proximity sensors (e.g., IR radiation detector and the like), depth sensors, ambient light sensors, optical light sensors, ultrasonic transceivers, microphones, inductive loops, force and/or load sensors, remote charge converters (RCC), rotor speed and position sensor(s), fiber optic gyro (FOG) inertial sensors, Attitude & Heading Reference Unit (AHRU), fibre Bragg grating (FBG) sensors and interrogators, tachometers, engine temperature gauges, pressure gauges, transformer sensors, airspeed-measurement meters, speed indicators, and/or the like. The IMUs, MEMS, and/or NEMS can include, for example, one or more 3-axis accelerometers, one or more 3-axis gyroscopes, one or more magnetometers, one or more compasses, one or more barometers, and/or the like. Additionally or alternatively, the sensors 1241 can include sensors of various compute components such as, for example, digital thermal sensors (DTS) of respective processors/cores, thermal sensor on-die (TSOD) of respective dual inline memory modules (DIMMs), baseboard thermal sensors, and/or any other sensor(s), such as any of those discussed herein.

The actuators 1242 allow the compute node 1200 to change its state, position, and/or orientation, or move or control a mechanism or system. The actuators 1242 comprise electrical and/or mechanical devices for moving or controlling a mechanism or system, and converts energy (e.g., electric current or moving air and/or liquid) into some kind of motion. The compute node 1200 is configured to operate one or more actuators 1242 based on one or more captured events, instructions, control signals, and/or configurations received from a service provider 1290, client device 1250, and/or other components of the compute node 1200. As examples, the actuators 1242 can be or include any number and combination of the following: soft actuators (e.g., actuators that changes its shape in response to a stimuli such as, for example, mechanical, thermal, magnetic, and/or electrical stimuli), hydraulic actuators, pneumatic actuators, mechanical actuators, electromechanical actuators (EMAs), microelectromechanical actuators, electrohydraulic actuators, linear actuators, linear motors, rotary motors, DC motors, stepper motors, servomechanisms, electromechanical switches, electromechanical relays (EMRs), power switches, valve actuators, piezoelectric actuators and/or biomorphs, thermal biomorphs, solid state actuators, solid state relays (SSRs), shape-memory alloy-based actuators, electroactive polymer-based actuators, relay driver integrated circuits (ICs), solenoids, impactive actuators/mechanisms (e.g., jaws, claws, tweezers, clamps, hooks, mechanical fingers, humaniform dexterous robotic hands, and/or other gripper mechanisms that physically grasp by direct impact upon an object), propulsion actuators/mechanisms (e.g., wheels, axles, thrusters, propellers, engines, motors (e.g., those discussed previously), clutches, and the like), projectile actuators/mechanisms (e.g., mechanisms that shoot or propel objects or elements), controllers of the compute node 1200 or components thereof (e.g., host controllers, cooling element controllers, baseboard management controller (BMC), platform controller hub (PCH), uncore components (e.g., shared last level cache (LLC) cache, caching agent (Cbo), integrated memory controller (IMC), home agent (HA), power control unit (PCU), configuration agent (Ubox), integrated I/O controller (IIO), and interconnect (IX) link interfaces and/or controllers), and/or any other components such as any of those discussed herein), audible sound generators, visual warning devices, virtual instrumentation and/or virtualized actuator devices, and/or other like components or devices. In some examples, such as when the compute node 1200 is part of an MHU 322, the actuator(s) 1242 can be emboddied as or otherwise represent one or more end effector tools, conveyor motors, and/or the like.

The positioning circuitry 1243 includes circuitry to receive and decode signals transmitted/broadcasted by a positioning network of a GNSS. Examples of such navigation satellite constellations include United States' GPS, Russia's Global Navigation System (GLONASS), the European Union's Galileo system, China's BeiDou Navigation Satellite System, a regional navigation system or GNSS augmentation system (e.g., Navigation with Indian Constellation (NAVIC), Japan's Quasi-Zenith Satellite System (QZSS), France's Doppler Orbitography and Radio-positioning Integrated by Satellite (DORIS), and the like), or the like. The positioning circuitry 1243 comprises various hardware elements (e.g., including hardware devices such as switches, filters, amplifiers, antenna elements, and the like to facilitate OTA communications) to communicate with components of a positioning network, such as navigation satellite constellation nodes. In some implementations, the positioning circuitry 1243 may include a Micro-Technology for Positioning, Navigation, and Timing (Micro-PNT) IC that uses a master timing clock to perform position tracking/ estimation without GNSS assistance. The positioning circuitry 1243 may also be part of, or interact with, the communication circuitry 1207 to communicate with the nodes and components of the positioning network. The positioning circuitry 1243 may also provide position data and/or time data to the application circuitry, which may use the data to synchronize operations with various infrastructure (e.g., radio base stations), for turn-by-turn navigation, or the like.

The I/O device(s) 1240 may be present within, or connected to, the compute node 1200. The I/O devices 1240 include input device circuitry and output device circuitry including one or more user interfaces designed to enable user interaction with the compute node 1200 and/or peripheral component interfaces designed to enable peripheral component interaction with the compute node 1200. The input device circuitry includes any physical or virtual means for accepting an input including, inter alia, one or more physical or virtual buttons, a physical or virtual keyboard, keypad, mouse, touchpad, touchscreen, microphones, scanner, headset, and/or the like. In implementations where the input device circuitry includes a capacitive, resistive, or other like touch-surface, a touch signal may be obtained from circuitry of the touch-surface. The touch signal may include information regarding a location of the touch (e.g., one or more sets of (x,y) coordinates describing an area, shape, and/or movement of the touch), a pressure of the touch (e.g., as measured by area of contact between a user's finger or a deformable stylus and the touch-surface, or by a pressure sensor), a duration of contact, any other suitable information, or any combination of such information. In these implementations, one or more apps operated by the processor circuitry 1201 may identify gesture(s) based on the information of the touch signal, and utilizing a gesture library that maps determined gestures with specified actions.

The output device circuitry is used to show or convey information, such as sensor readings, actuator position(s), or other like information. Data and/or graphics may be displayed on one or more user interface components of the output device circuitry. The output device circuitry may include any number and/or combinations of audio or visual display, including, inter alia, one or more simple visual outputs/indicators (e.g., binary status indicators (e.g., light emitting diodes (LEDs)) and multi-character visual outputs, or more complex outputs such as display devices or touchscreens (e.g., Liquid Chrystal Displays (LCD), LED and/or OLED displays, quantum dot displays, projectors, and the like), with the output of characters, graphics, multimedia objects, and the like being generated or produced from operation of the compute node 1200. The output device circuitry may also include speakers or other audio emitting devices, printer(s), and/or the like. In some implementations, the sensor circuitry 1241 may be used as the input device circuitry (e.g., an image capture device, motion capture device, or the like) and one or more actuators 1242 may be used as the output device circuitry (e.g., an actuator to provide haptic feedback or the like). In another example, near-field communication (NFC) circuitry comprising an NFC controller coupled with an antenna element and a processing device may be included to read electronic tags and/or connect with another NFC-enabled device. Peripheral component interfaces may include, but are not limited to, a non-volatile memory port, a universal serial bus (USB) port, an audio jack, a power supply interface, and the like.

A battery 1224 may be coupled to the compute node 1200 to power the compute node 1200, which may be used in implementations where the compute node 1200 is not in a fixed location, such as when the compute node 1200 is a mobile device or laptop. The battery 1224 may be a lithium ion battery, a lead-acid automotive battery, or a metal-air battery, such as a zinc-air battery, an aluminum-air battery, a lithium-air battery, a lithium polymer battery, and/or the like. In implementations where the compute node 1200 is mounted in a fixed location, such as when the system is implemented as a server computer system, the compute node 1200 may have a power supply coupled to an electrical grid. In these implementations, the compute node 1200 may include power tee circuitry to provide for electrical power drawn from a network cable to provide both power supply and data connectivity to the compute node 1200 using a single cable.

Power management integrated circuitry (PMIC) 1222 may be included in the compute node 1200 to track the state of charge (SoCh) of the battery 1224, and to control charging of the compute node 1200. The PMIC 1222 may be used to monitor other parameters of the battery 1224 to provide failure predictions, such as the state of health (SoH) and the state of function (SoF) of the battery 1224. The PMIC 1222 may include voltage regulators, surge protectors, power alarm detection circuitry. The power alarm detection circuitry may detect one or more of brown out (under-voltage) and surge (over-voltage) conditions. The PMIC 1222 may communicate the information on the battery 1224 to the processor circuitry 1201 over the IX 1206. The PMIC 1222 may also include an analog-to-digital (ADC) convertor that allows the processor circuitry 1201 to directly monitor the voltage of the battery 1224 or the current flow from the battery 1224. The battery parameters may be used to determine actions that the compute node 1200 may perform, such as transmission frequency, mesh network operation, sensing frequency, and the like.

A power block 1220, or other power supply coupled to an electrical grid, may be coupled with the PMIC 1222 to charge the battery 1224. In some examples, the power block 1220 may be replaced with a wireless power receiver to obtain the power wirelessly, for example, through a loop antenna in the compute node 1200. In these implementations, a wireless battery charging circuit may be included in the PMIC 1222. The specific charging circuits chosen depend on the size of the battery 1224 and the current required.

The compute node 1200 may include any combinations of the components shown by FIG. 12; however, some of the components shown may be omitted, additional components may be present, and different arrangement of the components shown may occur in other implementations. In one example where the compute node 1200 is or is part of a server computer system, the battery 1224, communication circuitry 1207, the sensors 1241, actuators 1242, and/or positioning circuitry 1243, and possibly some or all of the I/O devices 1240, may be omitted.

In some examples, the memory circuitry 1203 and/or the storage circuitry 1204 are embodied as "non-transitory computer-readable media (NTCRM) (e.g., NTCRM 1202). The NTCRM 1202 is suitable for use to store instructions (or data that creates the instructions) that cause an apparatus (such as any of the devices/components/systems described with regard to FIGS. 1-12), in response to execution of the instructions (e.g., instructions 1201*x*, 1203*x*, 1204*x*) by the compute node 1200 (e.g., one or more processors 1201), to practice selected aspects of the present disclosure. As shown, NTCRSM includes a number of programming instructions (e.g., instructions 1201*x*, 1203*x*, 1204*x*) (or data to create the programming instructions). The programming instructions are configured to enable a device (e.g., any of the devices/components/systems described with regard to FIGS. 1-12), in response to execution of the programming instructions, to perform various programming operations associated with operating system functions, one or more apps, and/or aspects of the present disclosure (including various programming operations associated with FIGS. 1-12). The programming instructions may correspond to any of the computational logic 1204*x*, instructions 1203*x* and 1201*x* discussed previously.

Additionally or alternatively, programming instructions (or data to create the instructions) may be disposed on multiple NTCRSM 1202. In alternate implementations, programming instructions (or data to create the instructions) may be disposed on computer-readable transitory storage media, such as signals. The programming instructions embodied by a machine-readable medium 1202 may be transmitted or received over a communications network using a transmission medium via a network interface device (e.g., communication circuitry 1207 and/or NIC 1207*c* of FIG. 12) utilizing any one of a number of communication protocols and/or data transfer protocols such as any of those discussed herein.

Any combination of one or more computer usable or NTCRM 1202 may be utilized as or instead of the NTCRM 1202. The computer-usable or computer-readable medium 1202 may be, for example, but not limited to one or more electronic, magnetic, optical, electromagnetic, infrared, or semiconductor systems, apparatuses, devices, or propagation media. For instance, the NTCRM 1202 may be embodied by devices described for the storage circuitry 1204 and/or memory circuitry 1203 described previously and/or as discussed elsewhere in the present disclosure. In the context of the present disclosure, a computer-usable or computer-readable medium 1202 may be any medium that can contain, store, communicate, propagate, or transport the program (or data to create the program) for use by or in connection with the instruction execution system, apparatus, or device. The computer-usable medium 1202 may include a propagated data signal with the computer-usable program code (e.g., including programming instructions) or data to create the program code embodied therewith, either in baseband or as part of a carrier wave. The computer usable program code or data to create the program may be transmitted using any appropriate medium, including but not limited to wireless, wireline, optical fiber cable, RF, and the like.

Additionally or alternatively, the program code (or data to create the program code) described herein may be stored in one or more of a compressed format, an encrypted format, a fragmented format, a packaged format, and/or the like. Program code (e.g., programming instructions) or data to create the program code as described herein may require one or more of installation, modification, adaptation, updating, combining, supplementing, configuring, decryption, decompression, unpacking, distribution, reassignment, and the like in order to make them directly readable and/or executable by a computing device and/or other machine. For example, the program code or data to create the program code may be stored in multiple parts, which are individually compressed, encrypted, and stored on separate computing devices, wherein the parts when decrypted, decompressed, and combined form a set of executable instructions that implement the program code or the data to create the program code, such as those described herein. In another example, the program code or data to create the program code may be stored in a state in which they may be read by a computer, but require addition of a library (e.g., a dynamic link library), a software development kit (SDK), an API, and the like in order to execute the instructions on a particular computing device or other device. In another example, the program code or data to create the program code may need to be configured (e.g., settings stored, data input, network addresses recorded, and the like) before the program code or data to create the program code can be executed/used in whole or in part. In this example, the program code (or data to create the program code) may be unpacked, configured for proper execution, and stored in a first location with the configuration instructions located in a second location distinct from the first location. The configuration instructions can be initiated by an action, trigger, or instruction that is not co-located in storage or execution location with the instructions enabling the disclosed techniques. Accordingly, the disclosed program code or data to create the program code are intended to encompass such machine readable instructions and/or program(s) or data to create such machine readable instruction and/or programs regardless of the particular format or state of the machine readable instructions and/or program(s) when stored or otherwise at rest or in transit.

The computer program code for carrying out operations of the present disclosure, including, for example, programming instructions, computational logic 1204*x*, instructions 1203*x*, and/or instructions 1201*x*, may be written in any combination of one or more programming languages, including an object oriented programming language (e.g., Python, PyTorch, Ruby, Scala, Smalltalk, Java™, Java Servlets, Kotlin, C++, C#, and/or the like), a procedural programming language (e.g., the "C" programming language, Go (or "Golang"), and/or the like), a scripting language (e.g., ECMAScript, JavaScript, Server-Side JavaScript (SSJS), PHP, Pearl, Python, PyTorch, Ruby, Lua, Torch/Lua with Just-In Time compiler (LuaJIT), Accelerated Mobile Pages Script (AMPscript), VBScript, and/or the like), a markup language (e.g., hypertext markup language (HTML), extensible markup language (XML), wiki markup or Wikitext, User Interface Markup Language (UIML), and/or the like), a data interchange format/definition (e.g., Java Script Object Notion (JSON), Apache® MessagePack™, and/or the like), a stylesheet language (e.g., Cascading Stylesheets (CSS), extensible stylesheet language (XSL), and/or the like), an interface definition language (IDL) (e.g., Apache® Thrift, Abstract Syntax Notation One (ASN.1), Google® Protocol Buffers (protobuf), efficient XML interchange (EXI), and/or the like), a web framework (e.g., Active Server Pages Network Enabled Technologies (ASP.NET), Apache® Wicket, Asynchronous JavaScript and XML (Ajax) frameworks, Django, Jakarta Server Faces (JSF; formerly JavaServer Faces), Jakarta Server Pages (JSP; formerly JavaServer Pages), Ruby on Rails, web toolkit, and/or the like), a template language (e.g., Apache® Velocity, Tea, Django template language, Mustache, Template Attribute Language (TAL), Extensible Stylesheet Language Transformations (XSLT), Thymeleaf, Facelet view, and/or the like), and/or some other suitable programming languages including proprietary programming languages and/or development tools, or any other languages or tools such as those discussed herein. It should be noted that some of the aforementioned languages, tools, and/or technologies may be classified as belonging to multiple types of languages/technologies or otherwise classified differently than described previously. The computer program code for carrying out operations of the present disclosure may also be written in any combination of the programming languages discussed herein. The program code may execute entirely on the compute node 1200, partly on the compute node 1200 as a stand-alone software package, partly on the compute node 1200 and partly on a remote computer, or entirely on the remote computer. In the latter scenario, the remote computer may be connected to the compute node 1200 through any type of network (e.g., network 1299).

The network 1299 is a set of computers that share resources located on or otherwise provided by a set of network nodes. The set of computers making up the network 1299 can use one or more communication protocols and/or access technologies (such as any of those discussed herein) to communicate with one another and/or with other computers outside of the network 1299 (e.g., device 1200 and/or 1290), and may be connected with one another or otherwise arranged in a variety of network topologies. As examples, the network 1299 can represent the Internet, one or more cellular networks, local area networks (LANs), wide area networks (WANs), wireless LANs (WLANs), Transfer Control Protocol (TCP)/Internet Protocol (IP)-based networks, Personal Area Networks (e.g., Bluetooth® and/or the like), Digital Subscriber Line (DSL) and/or cable networks, data networks, cloud computing services, edge computing networks, proprietary and/or enterprise networks, and/or any combination thereof. In some implementations, the network 1299 is associated with network operator who owns or controls equipment and other elements necessary to provide network-related services, such as one or more network access nodes (NANs) (e.g., base stations, access points, and the like), one or more servers for routing digital data or telephone calls (e.g., a core network or backbone network), and the like. Other networks can be used instead of or in addition to the Internet, such as an intranet, an extranet, a virtual private network (VPN), an enterprise network, a non-TCP/IP based network, any LAN, WLAN, WAN, and/or the like. In either implementation, the network 1299 comprises computers, network connections among various computers (e.g., between the compute node 1200, client device(s) 1250, remote system 1290, and/or the like), and software routines to enable communication between the computers over respective network connections. Connections to the network 1299 (and/or compute nodes therein) may be via a wired and/or a wireless connections using the various communication protocols such as any of those discussed herein. More than one network may be involved in a communication session between the illustrated devices. Connection to the network 1299 may require that the computers execute software routines that enable, for example, the layers of the OSI model of computer networking or equivalent in a wireless (or cellular) phone network.

The remote system 1290 (also referred to as a "service provider", "application server(s)", "app server(s)", "external platform", and/or the like) comprises one or more physical and/or virtualized computing systems owned and/or operated by a company, enterprise, and/or individual that hosts, serves, and/or otherwise provides information objects to one or more users (e.g., compute node 1200). The physical and/or virtualized systems include one or more logically or physically connected servers and/or data storage devices distributed locally or across one or more geographic locations. Generally, the remote system 1290 uses IP/network resources to provide InOb(s) such as electronic documents, webpages, forms, apps (e.g., native apps, web apps, mobile apps, and/or the like), data, services, web services, media, and/or content to different user/client devices 1250. As examples, the service provider 1290 may provide mapping and/or navigation services; cloud computing services; search engine services; social networking, microblogging, and/or message board services; content (media) streaming services; e-commerce services; blockchain services; communication services such as Voice-over-Internet Protocol (VoIP) sessions, text messaging, group communication sessions, and the like; immersive gaming experiences; and/or other like services. Although FIG. 12 shows only a single remote system 1290, the remote system 1290 may represent multiple remote system 1290, each of which may have their own subscribing users.

3. Artificial Intelligence and Machine Learning Aspects

Machine learning (ML) involves programming computing systems to optimize a performance criterion using example (training) data and/or past experience. ML refers to the use and development of computer systems that are able to learn and adapt without following explicit instructions, by using algorithms and/or statistical models to analyze and draw inferences from patterns in data. ML involves using algorithms to perform specific task(s) without using explicit instructions to perform the specific task(s), but instead relying on learnt patterns and/or inferences. ML uses statistics to build mathematical or statistical model(s) (also referred to as "ML models" or simply "models") in order to make predictions or decisions based on sample data (e.g., training data). The model is defined to have a set of parameters, and learning is the execution of a computer program to optimize the parameters of the model using the training data or past experience. The trained model may be a predictive model that makes predictions based on an input dataset, a descriptive model that gains knowledge from an input dataset, or both predictive and descriptive. Once the model is learned (trained), it can be used to make inferences (e.g., predictions).

ML algorithms perform a training process on a training dataset to estimate an underlying ML model. An ML algorithm is a computer program that learns from experience w.r.t some task(s) and some performance measure(s)/metric(s), and an ML model is an object or data structure created after an ML algorithm is trained with training data. In other words, the term "ML model" or "model" may describe the output of an ML algorithm that is trained with training data. After training, an ML model may be used to make predictions on new datasets. Additionally, separately trained AI/ML models can be chained together in a AI/ML pipeline during inference or prediction generation. Although the term "ML algorithm" refers to different concepts than the term "ML model," these terms may be used interchangeably for the purposes of the present disclosure. Any of the ML techniques discussed herein may be utilized, in whole or in part, and variants and/or combinations thereof, for any of the example implementations discussed herein.

ML may require, among other things, obtaining and cleaning a dataset, performing feature selection, selecting an ML algorithm, dividing the dataset into training data and testing data, training a model (e.g., using the selected ML algorithm), testing the model, optimizing or tuning the model, and determining metrics for the model. Some of these tasks may be optional or omitted depending on the use case and/or the implementation used.

ML algorithms accept model parameters (or simply "parameters") and/or hyperparameters that can be used to control certain properties of the training process and the resulting model. Model parameters are parameters, values, characteristics, configuration variables, and/or properties that are learnt during training. Model parameters are usually required by a model when making predictions, and their values define the skill of the model on a particular problem. Hyperparameters at least in some examples are characteristics, properties, and/or parameters for an ML process that cannot be learnt during a training process. Hyperparameter are usually set before training takes place, and may be used in processes to help estimate model parameters.

ML techniques generally fall into the following main types of learning problem categories: supervised learning, unsupervised learning, and reinforcement learning. Supervised learning involves building models from a set of data that contains both the inputs and the desired outputs. Unsupervised learning is an ML task that aims to learn a function to describe a hidden structure from unlabeled data. Unsupervised learning involves building models from a set of data that contains only inputs and no desired output labels. Reinforcement learning (RL) is a goal-oriented learning technique where an RL agent aims to optimize a long-term objective by interacting with an environment. Some implementations of AI and ML use data and neural networks (NNs) in a way that mimics the working of a biological brain. An example of such an implementation is shown by FIG. 13.

Figure 13:
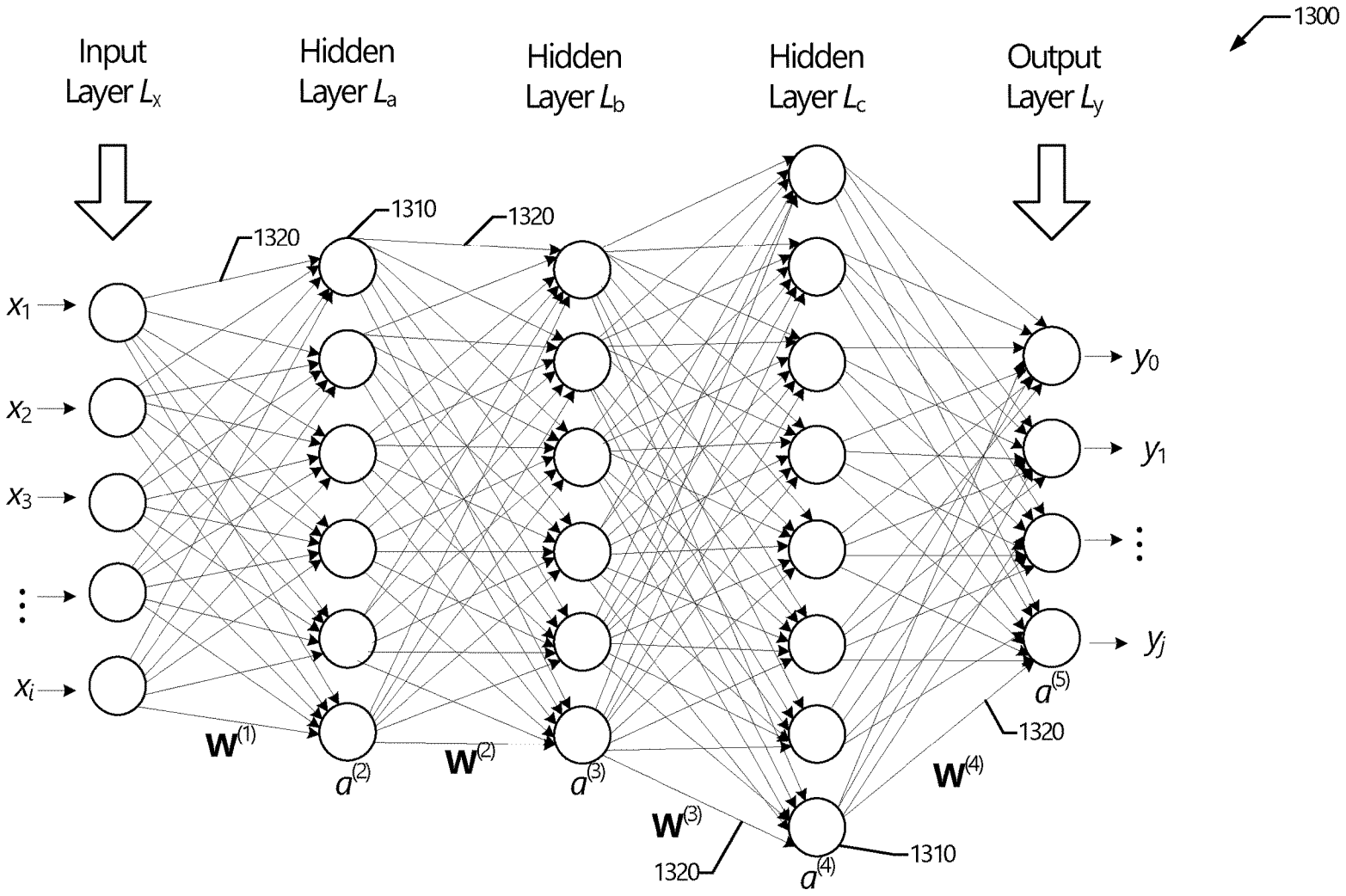
FIG. 13 depicts an example neural network.

FIG. 13 illustrates an example NN 1300, which may be suitable for use by one or more of the computing systems (or subsystems) of the various implementations discussed herein, implemented in part by a HW accelerator, and/or the like. For example, the NN 1300 may be part of the ML/AI systems 312 discussed previously. The NN 1300 may be deep neural network (DNN) used as an artificial brain of a compute node or network of compute nodes to handle very large and complicated observation spaces. Additionally or alternatively, the NN 1300 can be some other type of topology (or combination of topologies), such as a convolution NN (CNN), deep CNN (DCN), recurrent NN (RNN), Long Short Term Memory (LSTM) network, a Deconvolutional NN (DNN), gated recurrent unit (GRU), deep belief NN, a feed forward NN (FFN), a deep FNN (DFF), deep stacking network, Markov chain, perception NN, Bayesian Network (BN) or Bayesian NN (BNN), Dynamic BN (DBN), Linear Dynamical System (LDS), Switching LDS (SLDS), Optical NNs (ONNs), an NN for reinforcement learning (RL) and/or deep RL (DRL), and/or the like. NNs are usually used for supervised learning, but can be used for unsupervised learning and/or RL.

The NN 1300 may encompass a variety of ML techniques where a collection of connected artificial neurons 1310 that (loosely) model neurons in a biological brain that transmit signals to other neurons/nodes 1310. The neurons 1310 may also be referred to as nodes 1310, processing elements (PEs) 1310, or the like. The connections 1320 (or edges 1320) between the nodes 1310 are (loosely) modeled on synapses of a biological brain and convey the signals between nodes 1310. Note that not all neurons 1310 and edges 1320 are labeled in FIG. 13 for the sake of clarity.

Each neuron 1310 has one or more inputs and produces an output, which can be sent to one or more other neurons 1310 (the inputs and outputs may be referred to as "signals"). Inputs to the neurons 1310 of the input layer $L_x$ can be feature values of a sample of external data (e.g., input variables $x_i$). The input variables $x_i$ can be set as a vector containing relevant data (e.g., observations, ML features, and the like). The inputs to hidden units 1310 of the hidden layers $L_a$, $L_b$, and $L_c$ may be based on the outputs of other neurons 1310. The outputs of the final output neurons 1310 of the output layer $L_y$ (e.g., output variables $y_j$) include predictions, inferences, and/or accomplish a desired/configured task. The output variables $y_j$ may be in the form of determinations, inferences, predictions, and/or assessments. Additionally or alternatively, the output variables $y_j$ can be set as a vector containing the relevant data (e.g., determinations, inferences, predictions, assessments, and/or the like).

In the context of ML, an "ML feature" (or simply "feature") is an individual measureable property or characteristic of a phenomenon being observed. Features are usually represented using numbers/numerals (e.g., integers), strings, variables, ordinals, real-values, categories, and/or the like. Additionally or alternatively, ML features are individual variables, which may be independent variables, based on observable phenomenon that can be quantified and recorded. ML models use one or more features to make predictions or inferences. In some implementations, new features can be derived from old features.

Neurons 1310 may have a threshold such that a signal is sent only if the aggregate signal crosses that threshold. A node 1310 may include an activation function, which defines the output of that node 1310 given an input or set of inputs. Additionally or alternatively, a node 1310 may include a propagation function that computes the input to a neuron 1310 from the outputs of its predecessor neurons 1310 and their connections 1320 as a weighted sum. A bias term can also be added to the result of the propagation function.

The NN 1300 also includes connections 1320, some of which provide the output of at least one neuron 1310 as an input to at least another neuron 1310. Each connection 1320 may be assigned a weight that represents its relative importance. The weights may also be adjusted as learning proceeds. The weight increases or decreases the strength of the signal at a connection 1320.

The neurons 1310 can be aggregated or grouped into one or more layers L where different layers L may perform different transformations on their inputs. In FIG. 13, the NN 1300 comprises an input layer $L_x$, one or more hidden layers $L_a$, $L_b$, and $L_c$, and an output layer $L_y$ (where a, b, c, x, and y may be numbers), where each layer L comprises one or more neurons 1310. Signals travel from the first layer (e.g., the input layer $L_1$), to the last layer (e.g., the output layer $L_y$), possibly after traversing the hidden layers $L_a$, $L_b$, and $L_c$ multiple times. In FIG. 13, the input layer $L_a$ receives data of input variables $x_i$ (where i=1, . . . , p, where p is a number). Hidden layers $L_a$, $L_b$, and $L_c$ processes the inputs $x_i$, and eventually, output layer $L_y$ provides output variables $y_1$ (where j=1, . . . , p', where p' is a number that is the same or different than p). In the example of FIG. 13, for simplicity of illustration, there are only three hidden layers $L_a$, $L_b$, and $L_c$ in the NN 1300, however, the NN 1300 may include many more (or fewer) hidden layers $L_a$, $L_b$, and $L_c$ than are shown.

In one example, the ML/AI systems 312 are used for object tracking, recognition, detection, and/or classification using, for example, computer vision techniques and/or other mechanisms such as any of those discussed herein. Examples of such computer vision techniques can include edge detection, corner detection, blob detection, Kalman filters, Gaussian Mixture Models, particle filters, mean-shift based kernel tracking, object detection techniques (e.g., Viola-Jones framework, histogram of oriented gradients (HOG), invariance, scale-invariant feature transform (SIFT), geometric hashing, speeded up robust features (SURF), and/or the like), deep learning object detection techniques (e.g., fully convolutional neural network (FCNN), region proposal convolution neural network (R-CNN), single shot multibox detector, 'you only look once' (YOLO) algorithm, and/or the like), and/or the like. The object detection and/or recognition models may include an enrollment phase and an evaluation phase.

During the enrollment phase, one or more (object) features are extracted from sensor data (e.g., image data, video data, and/or other data). An object feature may include an object's size, color, shape, relationship to other objects, and/or any region or portion of an image, such as edges, ridges, corners, blobs, some defined regions of interest (ROI), parts (geons) and/or components, and/or the like. The features used may be implementation specific, and may be based on, for example, the objects to be detected and the model(s) to be developed and/or used. The evaluation phase involves identifying or classifying objects by comparing obtained sensor data with existing object models created during the enrollment phase. During the evaluation phase, features extracted from the sensor data are compared to the object identification models using a suitable pattern recognition technique. The object models may be qualitative or functional descriptions, geometric surface information, and/or abstract feature vectors, and may be stored in a suitable database that is organized using some type of indexing scheme to facilitate elimination of unlikely object candidates from consideration.

Additionally or alternatively, the ML/AI systems 312 can include one or more data fusion or data integration technique(s) to generate composite information based on, for example, sensor data 331 from multiple sensors 321 of different types and/or disposed at different locations (e.g., within and/or attached to different MHUs 322 and/or placed in different area/locations of an MFR). The data fusion techniques can include direct fusion techniques and/or indirect fusion techniques. Direct fusion combines data acquired directly from multiple components (e.g., MHUs 322 and/or sensors 321), which may be the same or similar (e.g., some or all components or sensors 321 perform the same type of measurement) or different (e.g., different components or sensor types, historical data, and/or the like). Indirect fusion utilizes historical data and/or known properties of the environment and/or human inputs to produce a refined data set. Additionally, the data fusion technique(s) may include one or more fusion algorithms, such as a smoothing algorithm (e.g., estimating a value using multiple measurements in real-time or not in real-time), a filtering algorithm (e.g., estimating an entity's state with current and past measurements in real-time), and/or a prediction state estimation algorithm (e.g., analyzing historical data (e.g., geolocation, speed, direction, and signal measurements) in real-time to predict a state (e.g., a future signal strength/quality at a particular geolocation coordinate)). As examples, the data fusion algorithm(s) may be or include a structured-based algorithm (e.g., tree-based (e.g., Minimum Spanning Tree (MST)), cluster-based, grid and/or centralized-based), a structure-free data fusion algorithm, a Kalman filter algorithm and/or Extended Kalman Filtering, a fuzzy-based data fusion algorithm, an Ant Colony Optimization (ACO) algorithm, a fault detection algorithm, a Dempster-Shafer (D-S) argumentation-based algorithm, a Gaussian Mixture Model algorithm, a triangulation based fusion algorithm, and/or any other like data fusion algorithm.

4. Example Implementations

Additional examples of the presently described implementations and/or implementation include the following, non-limiting examples. Each of the non-limiting examples may stand on its own, or may be combined in any permutation or combination with any one or more of the other examples provided below or throughout the present disclosure.

Example [0176] includes a method of operating a central control unit for a material recovery facility (MRF), the method comprising: receiving a data stream from each of one or more environmental sensors; processing the one or more data streams to determine a status of the MRF; and controlling at least one material handling unit in the MRF on the basis of the one or more data streams to alter its handling of a material waste stream, wherein the status of the MRF includes a composition of the material waste stream at one or more locations within the MRF and an operating condition of the at least one material handling unit, and wherein the at least one material handling unit is controlled to optimize the purity and/or recovery of at least one recyclable material stream extracted from the material waste stream.

Example [0177] includes the method of example [0176] and/or some other example(s) herein, wherein the method includes: causing the control unit to control or otherwise alert a servicing mechanism to service the at least one material handling unit when the operating condition of the at least one material handling unit indicates that service is needed.

Example [0178] includes the method of examples [0176]-[0177] and/or some other example(s) herein, wherein the method includes: causing the control unit to signal an operator of the MRF to service the at least one material handling unit when the operating condition of the at least one material handling unit indicates that service is needed.

Example [0179] includes the method of examples [0176]-[0178] and/or some other example(s) herein, wherein the at least one material handling unit is one of a mechanical sorter, robotic sorter, an optical sorter, an air sorter, a baler, and/or some other type of handling unit/device.

Example [0180] includes the method of examples [0179] and/or some other example(s) herein, wherein the method includes: causing the control unit to control the at least one material handling unit to extract contaminants from the material waste stream.

Example [0181] includes the method of examples [0176]-[0180] and/or some other example(s) herein, wherein the method includes: causing the control unit to control the at least one material handling unit to extract recyclable materials from the material waste stream.

Example [0182] includes the method of examples [0176]-[0181] and/or some other example(s) herein, wherein the method includes: receiving a data stream from each of one or more environmental sensors; processing the one or more data streams to determine a status of the MRF; and controlling at least one material handling unit in the MRF on the basis of the one or more data streams to alter its handling of a material waste stream to optimize the purity and/or recovery of at least one recyclable material stream extracted from the material waste stream, wherein the status of the MRF includes a composition of the material waste stream at one or more locations within the MRF and an operating condition of the at least one material handling unit.

Example [0183] includes the method of examples [0176]-[0182] and/or some other example(s) herein, wherein the method includes: controlling a servicing unit to service the at least one material handling unit when the operating condition of the at least one material handling unit indicates that service is needed.

Example [0184] includes the method of examples [0176]-[0183] and/or some other example(s) herein, wherein the at least one material handling unit comprises a disc separation screen, and further comprising controlling the servicing unit to remove an obstruction from an interfacial opening on the disc separation screen.

Example [0185] includes the method of examples [0176]-[0184] and/or some other example(s) herein, wherein the method includes: signaling an operator of the MRF to service the at least one material handling unit when the operating condition of the at least one material handling unit indicates that service is needed.

Example [0186] includes the method of examples [0176]-[0185] and/or some other example(s) herein, wherein the method includes: controlling the at least one material handling unit to extract recyclable materials from the material waste stream.

Example [0187] includes the method of examples [0176]-[0186] and/or some other example(s) herein, wherein the method includes: controlling the at least one material handling unit to extract contaminants from the material waste stream.

Example [0188] includes a method for material handling, comprising: receiving sensor data from sensing means; and controlling material handling means based on the sensor data received from the sensing means to optimize the recovery of one or more desired materials from a waste stream.

Example [0189] includes the method of example [0188] and/or some other example(s) herein, wherein the method includes: optimizing an arrangement of the material handling means based on the sensor data using optimization means.

Example [0190] includes the method of examples [0188]-[0189] and/or some other example(s) herein, wherein the controlling includes: controlling material handling means to remove contaminants recognized by the sensing means from the waste stream.

Example [0191] includes the method of examples [0188]-[0190] and/or some other example(s) herein, wherein the controlling includes: controlling material handling means to remove the one or more desired materials recognized by the sensing means from the waste stream.

Example [0192] includes a method for material handling, comprising: receiving status information from the material handling means; and controlling the material handling means based on the sensor data received status information.

Example [0193] includes the apparatus of examples [0188]-[0192] and/or some other example(s) herein, wherein the controlling includes: reconfiguring the material handling means in real time or near real time to remove varying types of the one or more desired materials.

Example [0194] includes the apparatus of example [0193] and/or some other example(s) herein, wherein the material handling means includes a plurality material handling mechanisms, and the reconfiguring includes: reconfiguring each of the plurality of material handling mechanisms in real time or near real time to balance an amount of the one or more desired materials to be removed between each of the plurality of material handling mechanisms.

Example [0195] includes the apparatus of examples [0188]-[0194] and/or some other example(s) herein, wherein the sensing means comprises a machine vision system.

Example [0196] includes the method of examples [0188]-[0195] and/or some other example(s) herein, wherein the method includes: operating a machine learning model and/or artificial intelligence system to adaptively control the material handling means based on the sensor data.

Example [0197] includes a method of operating a central controller of a material recovery facility (MRF), the method comprising: receiving data streams from respective sensors of a set of sensors; processing the one or more data streams to determine an MRF status of the MRF, wherein the MRF status is based on a composition of a material waste stream at one or more locations within the MRF and an operating condition of at least one material handling unit (MHU) of a set of MHUs disposed throughout the MRF; identifying and classify objects within the material waste stream based on the data streams; adjusting sorting logic of the central control circuitry based on the identified and classified objects and the MRF status, the adjustment of the sorting logic to optimize purity and/or recovery of at least one recoverable material to be extracted from the material waste stream; and controlling individual MHUs of the set of MHUs based on the adjusted sorting logic to purify and/or recover the at least one recoverable material, wherein, to control the individual MHUs, execution of the instructions is to cause the central control circuitry to retask at least one MHU of the set of MHUs from recovering at least one material different than the at least one recoverable material to recover the at least one recoverable material from the material waste stream.

Example [0198] includes the method of example [0197] and/or some other example(s) herein, wherein the MRF status is further based on a capacity of the material waste stream and/or a capacity of already sorted material streams.

Example [0199] includes the method of examples [0197]-[0198] and/or some other example(s) herein, wherein the method includes: controlling or otherwise alerting a servicing mechanism to service the individual MHUs when the operating condition of the individual MHUs indicates that service is needed.

Example [0200] includes the method of examples [0197]-[0199] and/or some other example(s) herein, wherein the method includes: signaling an operator of the MRF to service the individual MHUs when the operating condition of the individual MHUs indicates that service is needed.

Example [0201] includes the method of examples [0197]-[0200] and/or some other example(s) herein, wherein the method includes operating a machine learning or artificial intelligence model to perform the identification and classification of objects within the material waste stream based on the data streams; and adjust the sorting logic according to the identified and classified objects.

Example [0202] includes the method of examples [0197]-[0201] and/or some other example(s) herein, wherein controlling the individual MHUs includes controlling the individual MHUs to extract contaminants from the material waste stream and extract recoverable materials from the material waste stream.

Example [0203] includes the method of examples [0197]-[0202] and/or some other example(s) herein, wherein the method includes: controlling the individual MHUs to direct the material waste stream to different MHUs of the set of MHUs to achieve load balancing among the set of MHUs.

Example [0204] includes the method of example [0203] and/or some other example(s) herein, wherein achieving the load balancing includes: activating or deactivating different combinations of MHUs of the set of MHUs to optimize power and air consumption.

Example [0205] includes the method of examples [0203]-[0204] and/or some other example(s) herein, wherein achieving the load balancing includes: activating or deactivating sorting technologies within individual MHUs to optimize minimum power and air consumption.

Example [0206] includes the method of example [0205] and/or some other example(s) herein, wherein the sorting technologies include detection mechanism and action mechanisms.

Example [0207] includes the method of examples [0197]-[0206] and/or some other example(s) herein, wherein the controlling individual MHUs of the set of MHUs based on the adjusted sorting logic includes: dynamically causing a subset of MHUs of the set of MHUs to move to different locations within the MRF based on variations in material flow and material composition of the waste stream over a period of time.

Example [0208] includes the method of example [0207] and/or some other example(s) herein, wherein the dynamically causing the subset of MHUs to move includes: sending instructions to the subset of MHUs to move to the different locations, wherein the instructions are to cause the subset of MHUs to move to specified locations indicated by the instructions.

Example [0209] includes the method of examples [0207]-[0208] and/or some other example(s) herein, wherein the movement of the subset of MHUs takes place via robotics, cranes, tracks, and/or any other means of movement.

Example [0210] includes the method of examples [0207]-[0209] and/or some other example(s) herein, wherein the dynamically causing the subset of MHUs to move includes: causing an individual MHU of the set of MHUs to relocate to service center when the operating condition of the individual MHUs indicates that service is needed.

Example [0211] includes the method of examples [0197]-[0210] and/or some other example(s) herein, wherein at least one MHU of the set of MHUs includes a conveyor, and the controlling individual MHUs of the set of MHUs based on the adjusted sorting logic includes: alternating a direction and/or orientation of the conveyor.

Example [0212] includes the method of examples [0211] and/or some other example(s) herein, wherein one or more MHUs of the set of MHUs include end effectors, and at least some of the end effectors include manipulation elements.

Example [0213] includes the method of example [0212] and/or some other example(s) herein, wherein the controlling individual MHUs of the set of MHUs based on the adjusted sorting logic includes: redeploying the one or more MHUs with end effectors based on the alternated direction of the conveyor.

Example [0214] includes the method of examples [0197]-[0213] and/or some other example(s) herein, wherein at least one MHU of the set of MHUs includes a baler, and the controlling individual MHUs of the set of MHUs based on the adjusted sorting logic includes: autonomously controlling the baler and a bunker section based on material conditions and material capacity of the waste stream and previously sorted streams.

Example [0215] includes the method of examples [0197]-[0214] and/or some other example(s) herein, wherein each MHU of the set of MHUs is assigned to respective sets of locations it can occupy, wherein each location of the respective sets of locations is equipped with quick disconnect (QD) coupling mechanism for supplying each MHU with one or more MHU inputs.

Example [0216] includes the method of example [0215] and/or some other example(s) herein, wherein the one or more MHU inputs include one or more of compressed air, power, and control functionality.

Example [0217] includes the method of examples [0197]-[0216] and/or some other example(s) herein, wherein one or more MHUs of the set of MHUs include end effectors including manipulation elements.

Example [0218] includes the method of examples [0197]-[0217] and/or some other example(s) herein, wherein the MRF outputs a commodity bale, and the method includes: certifying the commodity bale based on the sorting; and applying a unique identifier to the commodity bale.

Example [0219] includes the method of example [0218] and/or some other example(s) herein, wherein the certifying includes: determining a material composition of the commodity bale; generating material composition data based on the determined material composition; and storing the material composition data in association with the unique identifier.

Example [0220] includes the method of example [0219] and/or some other example(s) herein, wherein the material composition data includes an amount of each material making up the material composition or a percentage of each material making up the material composition.

Example [0221] includes the method of examples [0219]-[0220] and/or some other example(s) herein, wherein the material composition data includes a purity level for the one or more desired materials in the commodity bale.

Example [0222] includes the method of examples [0219]-[0221] and/or some other example(s) herein, wherein the unique identifier is a machine-readable element including a reference to the stored material composition data.

Example [0223] includes the method of example [0222] and/or some other example(s) herein, wherein the machine-readable element is one of: QR code, a barcode, or an RFID tag.

Example [0224] includes the method of examples [0197]-[0223] and/or some other example(s) herein, wherein the method includes: operating a machine vision system to perform the identification and classification of the objects.

Example [0225] includes the method of examples [0197]-[0224] and/or some other example(s) herein, wherein the set of MHUs include one or more of conveyors, material loaders, mechanical sorters, a robotic sorters, optical sorters, air sorters, baler sorters, and automated quality control (AQC) sorters.

Example [0226] includes the method of examples [0197]-[0225] and/or some other example(s) herein, wherein the set of sensors include one or more of an infrared (IR) light sensor, a near IR (NIR) spectrometer, an ultraviolet (UV) light sensor, an x-ray light sensor, a visible light sensor, a magnetometer, a chemical sensor, an inductive sensor, a load cell, a density sensor, a speed sensor, an inclinometer, a moisture sensor, a laser measurement device, a current sensor, a pressure transducer, and a flow meter.

Example [0227] includes the method of examples [0197]-[0226] and/or some other example(s) herein, wherein the method is performed by a computing device comprising one or more of a multi-core processor, an application-specific integrated circuit (ASIC), a field-programmable gate array (FPGA), a hardware accelerator, a digital signal processor, a crypto-processor, or a graphics processor.

Example [0228] includes a method of operating a controller of a material recovery facility (MRF), the method comprising: receiving data streams from respective MRF components of a plurality of MRF components deployed at various locations in the MRF, wherein the plurality of MRF components includes a set of sensors and a set of material handling units (MHUs); processing the data streams to determine an MRF status of the MRF, wherein the MRF status is based on a composition of a material stream at one or more locations within the MRF and an operating condition of at least one MRF component of the plurality of MRF components, and wherein the composition of the material stream is based on identification and classification of objects within the material streams; determining an MRF arrangement of the plurality of MRF components based on the MRF status, wherein the MRF arrangement of the plurality of MRF components optimizes recovery and/or purity of at least one targetable material from the material stream; and controlling at least one MRF component of the plurality of MRF components to change its operation or its location within the MRF according to the determined MRF arrangement.

Example [0229] includes the method of example [0228] and/or some other example(s) herein, wherein the data streams include a set of sensor data generated by respective sensors of the set of sensors and MHU status information generated by respective MHUs of the set of MHUs.

Example [0230] includes the method of examples [0228]-[0229] and/or some other example(s) herein, wherein, when the at least one MRF component is a sensor of the set of sensors, controlling the at least one MRF component includes: retasking the sensor to collect a different type of sensor data or report sensor data at a different interval.

Example [0231] includes the method of examples [0228]-[0230] and/or some other example(s) herein, wherein, when the at least one MRF component is an MHU of the set of MHUs, controlling the at least one MRF component includes: retasking the MHU including determining one or more tasks for the MHU to perform.

Example [0232] includes the method of example [0231] and/or some other example(s) herein, wherein retasking the MHU includes: retasking the MHU from performing one or more current tasks to performing the determined one or more tasks.

Example [0233] includes the method of examples [0231]-[0232] and/or some other example(s) herein, wherein retasking the MHU includes: causing the MHU to recover at least one material different than the at least one recoverable material to recover the at least one recoverable material from the material stream.

Example [0234] includes the method of examples [0231]-[0233] and/or some other example(s) herein, wherein retasking the MHU includes: causing the MHU to use a selected sorting mechanism to recover the at least one recoverable material from the material stream.

Example [0235] includes the method of example [0234] and/or some other example(s) herein, wherein the selected sorting mechanism is different than a sorting mechanism currently being used by the MHU.

Example [0236] includes the method of examples [0231]-[0235] and/or some other example(s) herein, wherein retasking the MHU includes: causing the MHU to move from a current location within the MRF to a different location within the MRF.

Example [0237] includes the method of examples [0231]-[0236] and/or some other example(s) herein, wherein retasking the MHU includes: causing the MHU to move from a current location within the MRF to a service center when an operating condition of the MHUs indicates that service is needed.

Example [0238] includes the method of examples [0231]-[0237] and/or some other example(s) herein, wherein, when the MHU is a conveyor system, retasking the MHU includes: causing the conveyor system to change a speed, direction, or orientation of a conveyor mechanism.

Example [0239] includes the method of examples [0231]-[0238] and/or some other example(s) herein, wherein, when the MHU is a baling system, to retasking the MHU includes: causing the baling system to change a baling process based on a composition of the material stream.

Example [0240] includes the method of example [0239] and/or some other example(s) herein, wherein retasking the MHU includes: causing the baling system to queue material bales based on material composition such that individual material bales have different purity levels.

Example [0241] includes the method of examples [0231]-[0240] and/or some other example(s) herein, wherein, when the MHU is an infeed system, retasking the MHU includes: autonomously controlling the infeed system to infeed different combinations of materials to achieve semi-homogeneous material distribution.

Example [0242] includes the method of examples [0231]-[0241] and/or some other example(s) herein, wherein retasking the MHU includes: causing the MHU to activate or deactivate one or more sorting technologies to optimize resource consumption by the MHU.

Example [0243] includes the method of examples [0228]-[0242] and/or some other example(s) herein, wherein the method includes operating a first machine learning model to perform the identification and classification of objects within the material stream based on the data streams.

Example [0244] includes the method of example [0243] and/or some other example(s) herein, wherein the method includes operating a second machine learning model to determine the MRF arrangement.

Example [0245] includes the method of example [0244] and/or some other example(s) herein, wherein the first machine learning model is different than the second machine learning model.

Example [0246] includes the method of examples [0228]-[0245] and/or some other example(s) herein, wherein the MRF arrangement is based on a flow the material stream to one or more MHUs of the set of MHUs to achieve load balancing among the set of MHUs.

Example [0247] includes the method of example [0228]-[0246] and/or some other example(s) herein, wherein the set of MHUs include one or more of a conveyor, a mechanical sorter, a robotic sorter, an optical sorter, an air sorter, a baler sorter, and an automated quality control (AQC) sorter.

Example [0248] includes the method of examples [0228]-[0247] and/or some other example(s) herein, wherein the set of sensors include one or more of an infrared (IR) light sensor, an IR spectrometer, an ultraviolet (UV) light sensor, an x-ray sensor, a visible light sensor, a magnetometer, a chemical sensor, an inductive sensor, a load cell, a density sensor, a speed sensor, an inclinometer, an accelerometer, a moisture sensor, a laser measurement device, a current sensor, a pressure transducer, a temperature sensor, and a flow meter.

Example [0249] includes the method of examples [0228]-[0248] and/or some other example(s) herein, wherein the controller includes one or more of a multi-core processor, microcontroller, application-specific integrated circuit, field-programmable gate array, digital signal processor, digital signal controller, electronic control units, programmable logic device, crypto processor, hardware accelerator, and graphics processor.

Example [0250] includes the method of examples [0228]-[0249] and/or some other example(s) herein, wherein the controller is implemented by an individual computer node or is distributed across a plurality of compute nodes.

Example [0251] includes the method of example [0250] and/or some other example(s) herein, wherein the individual compute node or the pluarlity of compute nodes include(s)

any combination of a set of programmable logic device, a set of application servers, a set of cloud compute nodes, a set of edge compute nodes, a set of network functions in a cellular core network, a set of network access nodes, a set of gateway devices, a set of network appliances, a set of smart appliances, a subset of MHUs of the set of MHUs, and/or a subset of sensors of the set of sensors.

Example [0252] includes one or more computer readable media comprising instructions, wherein execution of the instructions by processor circuitry is to cause the processor circuitry to perform the method of examples [0176]-[0251] and/or some other example(s) herein.

Example [0253] includes a computer program comprising the instructions of example [0252] and/or some other example(s) herein.

Example [0254] includes an Application Programming Interface defining functions, methods, variables, data structures, and/or protocols for the computer program of example [0253] and/or some other example(s) herein.

Example [0255] includes an apparatus comprising circuitry loaded with the instructions of example [0252] and/or some other example(s) herein.

Example [0256] includes an apparatus comprising circuitry operable to run the instructions of example [0252] and/or some other example(s) herein.

Example [0257] includes an integrated circuit comprising one or more of the processor circuitry and the one or more computer readable media of example [0252] and/or some other example(s) herein.

Example [0258] includes a computing system comprising the one or more computer readable media and the processor circuitry of example [0252] and/or some other example(s) herein.

Example [0259] includes an apparatus comprising means for executing the instructions of example [0252] and/or some other example(s) herein.

Example [0260] includes a signal generated as a result of executing the instructions of example [0252] and/or some other example(s) herein.

Example [0261] includes a data unit generated as a result of executing the instructions of example [0252] and/or some other example(s) herein.

Example [0262] includes the data unit of example [0261] and/or some other example(s) herein, wherein the data unit is a packet, frame, datagram, protocol data unit (PDU), service data unit (SDU), segment, message, data block, data chunk, cell, data field, data element, information element, type length value, set of bytes, set of bits, set of symbols, and/or database object.

Example [0263] includes a signal encoded with the data unit of examples [0261]-[0262] and/or some other example(s) herein.

Example [0264] includes an electromagnetic signal carrying the instructions of example [0252] and/or some other example(s) herein.

Example [0265] includes an apparatus comprising means for performing the method of examples [0176]-[0251] and/or some other example(s) herein.

5. Terminology

In the present disclosure, reference is made to the accompanying drawings which form a part hereof, and in which are shown by way of illustration embodiments that may be practiced. It is to be understood that other implementations may be utilized and structural or logical changes may be made without departing from the scope. Therefore, the following detailed description is not to be taken in a limiting sense, and the scope of embodiments is defined by the appended claims and their equivalents. Various operations may be described as multiple discrete operations in turn, in a manner that may be helpful in understanding embodiments; however, the order of description should not be construed to imply that these operations are order dependent. The description may use perspective-based descriptions such as up/down, back/front, and top/bottom. Such descriptions are merely used to facilitate the discussion and are not intended to restrict the application of disclosed embodiments.

As used herein, the singular forms "a," "an" and "the" are intended to include plural forms as well, unless the context clearly indicates otherwise. It will be further understood that the terms "comprises" and/or "comprising," when used in this specification, specific the presence of stated features, integers, steps, operations, elements, and/or components, but do not preclude the presence or addition of one or more other features, integers, steps, operation, elements, components, and/or groups thereof. The phrase "A and/or B" means (A), (B), or (A and B). For the purposes of the present disclosure, the phrase "A, B, and/or C" means (A), (B), (C), (A and B), (A and C), (B and C), or (A, B and C). The description may use the phrases "in an embodiment," or "in some embodiments," "in some implementations", and variants thereof, each of which may refer to one or more of the same or different embodiments, implementations, and/or examples. Furthermore, the terms "comprising," "including," "having," and the like, as used with respect to (w.r.t) the present disclosure, are synonymous.

The terms "coupled," "communicatively coupled," along with derivatives thereof are used herein. The term "coupled" may mean two or more elements are in direct physical or electrical contact with one another, may mean that two or more elements indirectly contact each other but still cooperate or interact with each other, and/or may mean that one or more other elements are coupled or connected between the elements that are said to be coupled with each other. The term "directly coupled" may mean that two or more elements are in direct contact with one another. The term "communicatively coupled" may mean that two or more elements may be in contact with one another by a means of communication including through a wire or other interconnect connection, through a wireless communication channel or ink, and/or the like.

The term "establish" or "establishment" at least in some examples refers to (partial or in full) acts, tasks, operations, and the like, related to bringing or the readying the bringing of something into existence either actively or passively (e.g., exposing a device identity or entity identity). Additionally or alternatively, the term "establish" or "establishment" at least in some examples refers to (partial or in full) acts, tasks, operations, and the like, related to initiating, starting, or warming communication or initiating, starting, or warming a relationship between two entities or elements (e.g., establish a session, establish a session, and the like). Additionally or alternatively, the term "establish" or "establishment" at least in some examples refers to initiating something to a state of working readiness. The term "established" at least in some examples refers to a state of being operational or ready for use (e.g., full establishment). Furthermore, any definition for the term "establish" or "establishment" defined in any specification or standard can be used for purposes of the present disclosure and such definitions are not disavowed by any of the aforementioned definitions.

The term "obtain" at least in some examples refers to (partial or in full) acts, tasks, operations, and the like, of intercepting, movement, copying, retrieval, or acquisition (e.g., from a memory, an interface, or a buffer), on the original packet stream or on a copy (e.g., a new instance) of the packet stream. Other aspects of obtaining or receiving may involving instantiating, enabling, or controlling the ability to obtain or receive a stream of packets (or the following parameters and templates or template values).

The term "receipt" at least in some examples refers to any action (or set of actions) involved with receiving or obtaining an object, data, data unit, and the like, and/or the fact of the object, data, data unit, and the like being received. The term "receipt" at least in some examples refers to an object, data, data unit, and the like, being pushed to a device, system, element, and the like (e.g., often referred to as a push model), pulled by a device, system, element, and the like (e.g., often referred to as a pull model), and/or the like.

The term "element" at least in some examples refers to a unit that is indivisible at a given level of abstraction and has a clearly defined boundary, wherein an element may be any type of entity including, for example, one or more devices, systems, controllers, network elements, modules, and so forth, or combinations thereof. The term "entity" at least in some examples refers to a distinct element of a component, architecture, platform, device, and/or system.

The term "measurement" at least in some examples refers to the observation and/or quantification of attributes of an object, event, or phenomenon. Additionally or alternatively, the term "measurement" at least in some examples refers to a set of operations having the object of determining a measured value or measurement result, and/or the actual instance or execution of operations leading to a measured value. Additionally or alternatively, the term "measurement" at least in some examples refers to data recorded during testing.

The term "metric" at least in some examples refers to a quantity produced in an assessment of a measured value. Additionally or alternatively, the term "metric" at least in some examples refers to data derived from a set of measurements. Additionally or alternatively, the term "metric" at least in some examples refers to set of events combined or otherwise grouped into one or more values. Additionally or alternatively, the term "metric" at least in some examples refers to a combination of measures or set of collected data points. Additionally or alternatively, the term "metric" at least in some examples refers to a standard definition of a quantity, produced in an assessment of performance and/or reliability of the network, which has an intended utility and is carefully specified to convey the exact meaning of a measured value.

The term "signal" at least in some examples refers to an observable change in a quality and/or quantity. Additionally or alternatively, the term "signal" at least in some examples refers to a function that conveys information about of an object, event, or phenomenon. Additionally or alternatively, the term "signal" at least in some examples refers to any time varying voltage, current, or electromagnetic wave that may or may not carry information. The term "digital signal" at least in some examples refers to a signal that is constructed from a discrete set of waveforms of a physical quantity so as to represent a sequence of discrete values.

The term "task" at least in some examples refers to a specific activity and/or a type of activity. Additionally or alternatively, the term "task" at least in some examples refers to a unit of execution and/or a unit of work. Additionally or alternatively, the term "task" at least in some examples refers to an actual operation, activity, action, or job to be accomplished or performed. The term "retask" at least in some examples refers to causing to perform a new task and/or to change the work or mission of an entity or element.

The term "identifier" at least in some examples refers to a value, or a set of values, that uniquely identify an identity in a certain scope. Additionally or alternatively, the term "identifier" at least in some examples refers to a sequence of characters that identifies or otherwise indicates the identity of a unique object, element, or entity, or a unique class of objects, elements, or entities. Additionally or alternatively, the term "identifier" at least in some examples refers to a sequence of characters used to identify or refer to an application, program, session, object, element, entity, variable, set of data, and/or the like. The "sequence of characters" mentioned previously at least in some examples refers to one or more names, labels, words, numbers, letters, symbols, and/or any combination thereof. Additionally or alternatively, the term "identifier" at least in some examples refers to a name, address, label, distinguishing index, and/or attribute. Additionally or alternatively, the term "identifier" at least in some examples refers to an instance of identification. The term "persistent identifier" at least in some examples refers to an identifier that is reused by a device or by another device associated with the same person or group of persons for an indefinite period. The term "identification" at least in some examples refers to a process of recognizing an identity as distinct from other identities in a particular scope or context, which may involve processing identifiers to reference an identity in an identity database. The term "application identifier", "application ID", or "app ID" at least in some examples refers to an identifier that can be mapped to a specific application, application instance, or application instance. In the context of 3GPP 5G/NR, an "application identifier" at least in some examples refers to an identifier that can be mapped to a specific application traffic detection rule.

The term "circuitry" at least in some examples refers to a circuit or system of multiple circuits configured to perform a particular function in an electronic device. The circuit or system of circuits may be part of, or include one or more hardware components, such as a logic circuit, a processor (shared, dedicated, or group) and/or memory (shared, dedicated, or group), an application-specific integrated circuit (ASIC), field-programmable gate array (FPGA), programmable logic controller (PLC), system on chip (SoC), single-board computer (SBC), system in package (SiP), multi-chip package (MCP), digital signal processor (DSP), and the like, that are configured to provide the described functionality. In addition, the term "circuitry" may also refer to a combination of one or more hardware elements with the program code used to carry out the functionality of that program code. Some types of circuitry may execute one or more software or firmware programs to provide at least some of the described functionality. Such a combination of hardware elements and program code may be referred to as a particular type of circuitry.

The term "device" at least in some examples refers to a physical entity embedded inside, or attached to, another physical entity in its vicinity, with capabilities to convey digital information from or to that physical entity. The term "controller" at least in some examples refers to an element or entity that has the capability to affect a physical and/or virtual entity, such as by changing its state or causing the physical entity to move. The term "scheduler" at least in some examples refers to an entity or element that assigns resources (e.g., processor time, network links, memory space, and/or the like) to perform tasks.

The term "computer-readable medium" may include, but is not limited to, memory, portable or fixed storage devices, optical storage devices, and various other mediums capable of storing, containing or carrying instructions or data. Additionally or alternatively, the terms "machine-readable medium" and "computer-readable medium" refers to tangible medium that is capable of storing, encoding or carrying instructions for execution by a machine and that cause the machine to perform any one or more of the methodologies of the present disclosure, and/or that is capable of storing, encoding or carrying data structures utilized by or associated with such instructions. The terms "machine-readable medium" and "computer-readable medium" may be interchangeable for purposes of the present disclosure. The term "non-transitory computer-readable medium at least in some examples refers to any type of memory, computer readable storage device, and/or storage disk and may exclude propagating signals and transmission media.

The term "compute node" or "compute device" at least in some examples refers to an identifiable entity implementing an aspect of computing operations, whether part of a larger system, distributed collection of systems, or a standalone apparatus. In some examples, a compute node may be referred to as a "computing device", "computing system", or the like, whether in operation as a client, server, or intermediate entity. Specific implementations of a compute node may be incorporated into a server, base station, gateway, road side unit, on-premise unit, user equipment, end consuming device, appliance, or the like.

The term "computer system" at least in some examples refers to any type interconnected electronic devices, computer devices, or components thereof. Additionally, the terms "computer system" and/or "system" at least in some examples refer to various components of a computer that are communicatively coupled with one another. Furthermore, the term "computer system" and/or "system" at least in some examples refer to multiple computer devices and/or multiple computing systems that are communicatively coupled with one another and configured to share computing and/or networking resources.

The term "network element" at least in some examples refers to physical or virtualized equipment and/or infrastructure used to provide wired or wireless communication network services. The term "network element" may be considered synonymous to and/or referred to as a networked computer, networking hardware, network equipment, network node, router, switch, hub, bridge, radio network controller, network access node (NAN), base station, access point (AP), RAN device, RAN node, gateway, server, network appliance, network function (NF), virtualized NF (VNF), and/or the like.

The term "network access node" or "NAN" at least in some examples refers to a network element in a radio access network (RAN) responsible for the transmission and reception of radio signals in one or more cells or coverage areas to or from a UE or station. A "network access node" or "NAN" can have an integrated antenna or may be connected to an antenna array by feeder cables. Additionally or alternatively, a "network access node" or "NAN" may include specialized digital signal processing, network function hardware, and/or compute hardware to operate as a compute node. In some examples, a "network access node" or "NAN" may be split into multiple functional blocks operating in software for flexibility, cost, and performance In some examples, a "network access node" or "NAN" may be a base station (e.g., an evolved Node B (eNB) or a next generation Node B (gNB)), an access point and/or wireless network access point, router, switch, hub, radio unit or remote radio head, Transmission Reception Point (TRxP), a gateway device (e.g., Residential Gateway, Wireline 5G Access Network, Wireline 5G Cable Access Network, Wireline BBF Access Network, and the like), network appliance, and/or some other network access hardware.

The term "cloud computing" or "cloud" at least in some examples refers to a paradigm for enabling network access to a scalable and elastic pool of shareable computing resources with self-service provisioning and administration on-demand and without active management by users. Cloud computing provides cloud computing services (or cloud services), which are one or more capabilities offered via cloud computing that are invoked using a defined interface (e.g., an API or the like).

The term "service consumer" at least in some examples refers to an entity that consumes one or more services. The term "service producer" at least in some examples refers to an entity that offers, serves, or otherwise provides one or more services. The term "service provider" at least in some examples refers to an organization or entity that provides one or more services to at least one service consumer. For purposes of the present disclosure, the terms "service provider" and "service producer" may be used interchangeably even though these terms may refer to difference concepts. Examples of service providers include cloud service provider (CSP), network service provider (NSP), application service provider (ASP) (e.g., Application software service provider in a service-oriented architecture (ASSP)), internet service provider (ISP), telecommunications service provider (TSP), online service provider (OSP), payment service provider (PSP), managed service provider (MSP), storage service providers (SSPs), SAML service provider, and/or the like.

The term "virtualization container", "execution container", or "container" at least in some examples refers to a partition of a compute node that provides an isolated virtualized computation environment. The term "OS container" at least in some examples refers to a virtualization container utilizing a shared Operating System (OS) kernel of its host, where the host providing the shared OS kernel can be a physical compute node or another virtualization container. Additionally or alternatively, the term "container" at least in some examples refers to a standard unit of software (or a package) including code and its relevant dependencies, and/or an abstraction at the application layer that packages code and dependencies together. Additionally or alternatively, the term "container" or "container image" at least in some examples refers to a lightweight, standalone, executable software package that includes everything needed to run an application such as, for example, code, runtime environment, system tools, system libraries, and settings.

The term "virtual machine" or "VM" at least in some examples refers to a virtualized computation environment that behaves in a same or similar manner as a physical computer and/or a server. The term "hypervisor" at least in some examples refers to a software element that partitions the underlying physical resources of a compute node, creates VMs, manages resources for VMs, and isolates individual VMs from each other.

The term "Internet of Things" or "IoT" at least in some examples refers to a system of interrelated computing devices, mechanical and digital machines capable of transferring data with little or no human interaction, and may involve technologies such as real-time analytics, machine learning and/or AI, embedded systems, wireless sensor networks, control systems, automation (e.g., smart home, smart building and/or smart city technologies), and the like. IoT devices are usually low-power devices without heavy compute or storage capabilities.

The term "protocol" at least in some examples refers to a predefined procedure or method of performing one or more operations. Additionally or alternatively, the term "protocol" at least in some examples refers to a common means for unrelated objects to communicate with each other (sometimes also called interfaces). The term "communication protocol" at least in some examples refers to a set of standardized rules or instructions implemented by a communication device and/or system to communicate with other devices and/or systems, including instructions for packetizing/depacketizing data, modulating/demodulating signals, implementation of protocols stacks, and/or the like. In various implementations, a "protocol" and/or a "communication protocol" may be represented using a protocol stack, a finite state machine (FSM), and/or any other suitable data structure.

The term "application layer" at least in some examples refers to an abstraction layer that specifies shared communications protocols and interfaces used by hosts in a communications network. Additionally or alternatively, the term "application layer" at least in some examples refers to an abstraction layer that interacts with software applications that implement a communicating component, and may include identifying communication partners, determining resource availability, and synchronizing communication. Examples of application layer protocols include HTTP, HTTPs, File Transfer Protocol (FTP), Dynamic Host Configuration Protocol (DHCP), Internet Message Access Protocol (IMAP), Lightweight Directory Access Protocol (LDAP), MQTT (MQ Telemetry Transport), Remote Authentication Dial-In User Service (RADIUS), Diameter protocol, Extensible Authentication Protocol (EAP), RDMA over Converged Ethernet version 2 (RoCEv2), Real-time Transport Protocol (RTP), RTP Control Protocol (RTCP), Real Time Streaming Protocol (RTSP), SBMV Protocol, Skinny Client Control Protocol (SCCP), Session Initiation Protocol (SIP), Session Description Protocol (SDP), Simple Mail Transfer Protocol (SMTP), Simple Network Management Protocol (SNMP), Simple Service Discovery Protocol (SSDP), Small Computer System Interface (SCSI), Internet SCSI (iSCSI), iSCSI Extensions for RDMA (iSER), Transport Layer Security (TLS), voice over IP (VoIP), Virtual Private Network (VPN), Extensible Messaging and Presence Protocol (XMPP), and/or the like.

The term "transport layer" at least in some examples refers to a protocol layer that provides end-to-end (e2e) communication services such as, for example, connection-oriented communication, reliability, flow control, and multiplexing. Examples of transport layer protocols include datagram congestion control protocol (DCCP), fibre channel protocol (FBC), Generic Routing Encapsulation (GRE), GPRS Tunneling (GTP), Micro Transport Protocol (μTP), Multipath TCP (MPTCP), MultiPath QUIC (MPQUIC), Multipath UDP (MPUDP), Quick UDP Internet Connections (QUIC), Remote Direct Memory Access (RDMA), Resource Reservation Protocol (RSVP), Stream Control Transmission Protocol (SCTP), transmission control protocol (TCP), user datagram protocol (UDP), and/or the like.

The term "network layer" at least in some examples refers to a protocol layer that includes means for transferring network packets from a source to a destination via one or more networks. Additionally or alternatively, the term "network layer" at least in some examples refers to a protocol layer that is responsible for packet forwarding and/or routing through intermediary nodes. Additionally or alternatively, the term "network layer" or "internet layer" at least in some examples refers to a protocol layer that includes interworking methods, protocols, and specifications that are used to transport network packets across a network. As examples, the network layer protocols include internet protocol (IP), IP security (IPsec), Internet Control Message Protocol (ICMP), Internet Group Management Protocol (IGMP), Open Shortest Path First protocol (OSPF), Routing Information Protocol (RIP), RDMA over Converged Ethernet version 2 (RoCEv2), Subnetwork Access Protocol (SNAP), and/or some other internet or network protocol layer.

The term "session layer" at least in some examples refers to an abstraction layer that controls dialogues and/or connections between entities or elements, and may include establishing, managing and terminating the connections between the entities or elements. The term "link layer" or "data link layer" at least in some examples refers to a protocol layer that transfers data between nodes on a network segment across a physical layer. Examples of link layer protocols include logical link control (LLC), medium access control (MAC), Ethernet, RDMA over Converged Ethernet version 1 (RoCEv1), and/or the like. The term "medium access control protocol", "MAC protocol", or "MAC" at least in some examples refers to a protocol that governs access to the transmission medium in a network, to enable the exchange of data between stations in a network. The term "physical layer", "PHY layer", or "PHY" at least in some examples refers to a protocol layer or sublayer that includes capabilities to transmit and receive modulated signals for communicating in a communications network.

The term "local area network" or "LAN" at least in some examples refers to a network of devices, whether indoors or outdoors, covering a limited area or a relatively small geographic area (e.g., within a building or a campus). The term "wireless local area network", "wireless LAN", or "WLAN" at least in some examples refers to a LAN that involves wireless communications. The term "wide area network" or "WAN" at least in some examples refers to a network of devices that extends over a relatively large geographic area (e.g., a telecommunications network). Additionally or alternatively, the term "wide area network" or "WAN" at least in some examples refers to a computer network spanning regions, countries, or even an entire planet.

The term "stream" or "data stream" at least in some examples refers to a sequence of data elements made available over time. Additionally or alternatively, the term "stream", "data stream", or "streaming" refers to a unidirectional flow of data. Additionally or alternatively, the term "stream", "data stream", or "streaming" refers to a manner of processing in which an object is not represented by a complete data structure of nodes occupying memory proportional to a size of that object, but are processed "on the fly" as a sequence of events. At least in some examples, functions that operate on a stream, which may produce another stream, are referred to as "filters," and can be connected in pipelines, analogously to function composition; filters may operate on one item of a stream at a time, or may base an item of output on multiple input items, such as a moving average or the like.

The term "service" at least in some examples refers to the provision of a discrete function within a system and/or environment. Additionally or alternatively, the term "service" at least in some examples refers to a functionality or a set of functionalities that can be reused. The term "microservice" at least in some examples refers to one or more processes that communicate over a network to fulfil a goal using technology-agnostic protocols (e.g., HTTP or the like). Additionally or alternatively, the term "microservice" at least in some examples refers to services that are relatively small in size, messaging-enabled, bounded by contexts, autonomously developed, independently deployable, decentralized, and/or built and released with automated processes. Additionally or alternatively, the term "microservice" at least in some examples refers to a self-contained piece of functionality with clear interfaces, and may implement a layered architecture through its own internal components. Additionally or alternatively, the term "microservice architecture" at least in some examples refers to a variant of the service-oriented architecture (SOA) structural style wherein applications are arranged as a collection of loosely-coupled services (e.g., fine-grained services) and may use lightweight protocols.

The term "network address" at least in some examples refers to an identifier for a node or host in a computer network, and may be a unique identifier across a network and/or may be unique to a locally administered portion of the network. The term "universally unique identifier" or "UUID" at least in some examples refers to a number used to identify information in computer systems. In some examples, a UUID includes 128-bit numbers and/or are represented as 32 hexadecimal digits displayed in five groups separated by hyphens in the following format: "xxxxxxxx-xxxx-Mxxx-Nxxx-xxxxxxxxxxxx" where the four-bit M and the 1 to 3 bit N fields code the format of the UUID itself. Additionally or alternatively, the term "universally unique identifier" or "UUID" at least in some examples refers to a "globally unique identifier" and/or a "GUID". The term "endpoint address" at least in some examples refers to an address used to determine the host/authority part of a target URI, where the target URI is used to access an NF service (e.g., to invoke service operations) of an NF service producer or for notifications to an NF service consumer. The term "port" in the context of computer networks, at least in some examples refers to a communication endpoint, a virtual data connection between two or more entities, and/or a virtual point where network connections start and end. Additionally or alternatively, a "port" at least in some examples is associated with a specific process or service.

The term "application" at least in some examples refers to a computer program designed to carry out a specific task other than one relating to the operation of the computer itself. Additionally or alternatively, term "application" at least in some examples refers to a complete and deployable package, environment to achieve a certain function in an operational environment.

The term "process" at least in some examples refers to an instance of a computer program that is being executed by one or more threads. In some implementations, a process may be made up of multiple threads of execution that execute instructions concurrently.

The term "algorithm" at least in some examples refers to an unambiguous specification of how to solve a problem or a class of problems by performing calculations, input/output operations, data processing, automated reasoning tasks, and/or the like.

The term "analytics" at least in some examples refers to the discovery, interpretation, and communication of meaningful patterns in data.

The term "application programming interface" or "API" at least in some examples refers to a set of subroutine definitions, communication protocols, and tools for building software. Additionally or alternatively, the term "application programming interface" or "API" at least in some examples refers to a set of clearly defined methods of communication among various components. In some examples, an API may be defined or otherwise used for a web-based system, operating system, database system, computer hardware, software library, and/or the like.

The term "data processing" or "processing" at least in some examples refers to any operation or set of operations which is performed on data or on sets of data, whether or not by automated means, such as collection, recording, writing, organization, structuring, storing, adaptation, alteration, retrieval, consultation, use, disclosure by transmission, dissemination or otherwise making available, alignment or combination, restriction, erasure and/or destruction. The term "data pipeline" or "pipeline" at least in some examples refers to a set of data processing elements (or data processors) connected in series and/or in parallel, where the output of one data processing element is the input of one or more other data processing elements in the pipeline; the elements of a pipeline may be executed in parallel or in time-sliced fashion and/or some amount of buffer storage can be inserted between elements.

The term "data set" or "dataset" at least in some examples refers to a collection of data; a "data set" or "dataset" may be formed or arranged in any type of data structure. In some examples, one or more characteristics can define or influence the structure and/or properties of a dataset such as the number and types of attributes and/or variables, and various statistical measures (e.g., standard deviation, kurtosis, and/or the like).

The term "instrumentation" at least in some examples refers to measuring instruments used for indicating, measuring, and/or recording physical quantities and/or physical events. Additionally or alternatively, the term "instrumentation" at least in some examples refers to the measure of performance (e.g., of SW and/or HW (sub)systems) in order to diagnose errors and/or to write trace information. The term "trace" or "tracing" at least in some examples refers to logging or otherwise recording information about a program's execution and/or information about the operation of a component, subsystem, device, system, and/or other entity; in some examples, "tracing" is used for debugging and/or analysis purposes.

The term "telemetry" at least in some examples refers to the in situ collection of measurements, metrics, or other data (often referred to as "telemetry data" or the like) and their conveyance to another device or equipment. Additionally or alternatively, the term "telemetry" at least in some examples refers to the automatic recording and transmission of data from a remote or inaccessible source to a system for monitoring and/or analysis.

The term "telemeter" at least in some examples refers to a device used in telemetry, and at least in some examples, includes sensor(s), a communication path, and a control device.

The term "telemetry pipeline" at least in some examples refers to a set of elements/entities/components in a telemetry system through which telemetry data flows, is routed, or otherwise passes through the telemetry system. Additionally or alternatively, the term "telemetry pipeline" at least in some examples refers to a system, mechanism, and/or set of elements/entities/components that takes collected data from an agent and leads to the generation of insights via analytics. Examples of entities/elements/components of a telemetry pipeline include a collector or collection agent, analytics function, data upload and transport (e.g., to the cloud or the like), data ingestion (e.g., Extract Transform and Load (ETL)), storage, and analysis functions.

The term "telemetry system" at least in some examples refers to a set of physical and/or virtual components that interconnect to provide telemetry services and/or to provide for the collection, communication, and analysis of data.

The term "accuracy" at least in some examples refers to the closeness of one or more measurements to a specific value.

The term "artificial intelligence" or "AI" at least in some examples refers to any intelligence demonstrated by machines, in contrast to the natural intelligence displayed by humans and other animals. Additionally or alternatively, the term "artificial intelligence" or "AI" at least in some examples refers to the study of "intelligent agents" and/or any device that perceives its environment and takes actions that maximize its chance of successfully achieving a goal.

The terms "artificial neural network", "neural network", or "NN" refer to an ML technique comprising a collection of connected artificial neurons or nodes that (loosely) model neurons in a biological brain that can transmit signals to other arterial neurons or nodes, where connections (or edges) between the artificial neurons or nodes are (loosely) modeled on synapses of a biological brain. The artificial neurons and edges typically have a weight that adjusts as learning proceeds. The weight increases or decreases the strength of the signal at a connection. Neurons may have a threshold such that a signal is sent only if the aggregate signal crosses that threshold. The artificial neurons can be aggregated or grouped into one or more layers where different layers may perform different transformations on their inputs. Signals travel from the first layer (the input layer), to the last layer (the output layer), possibly after traversing the layers multiple times. NNs are usually used for supervised learning, but can be used for unsupervised learning as well. Examples of NNs include deep NN (DNN), feed forward NN (FFN), deep FNN (DFF), convolutional NN (CNN), deep CNN (DCN), deconvolutional NN (DNN), a deep belief NN, a perception NN, recurrent NN (RNN) (e.g., including Long Short Term Memory (LSTM) algorithm, gated recurrent unit (GRU), echo state network (ESN), and the like), spiking NN (SNN), deep stacking network (DSN), Markov chain, perception NN, generative adversarial network (GAN), transformers, stochastic NNs (e.g., Bayesian Network (BN), Bayesian belief network (BBN), a Bayesian NN (BNN), Deep BNN (DBNN), Dynamic BN (DBN), probabilistic graphical model (PGM), Boltzmann machine, restricted Boltzmann machine (RBM), Hopfield network or Hopfield NN, convolutional deep belief network (CDBN), and the like), Linear Dynamical System (LDS), Switching LDS (SLDS), Optical NNs (ONNs), an NN for reinforcement learning (RL) and/or deep RL (DRL), and/or the like.

The term "attention" in the context of machine learning and/or neural networks, at least in some examples refers to a technique that mimics cognitive attention, which enhances important parts of a dataset where the important parts of the dataset may be determined using training data by gradient descent. The term "attention model" or "attention mechanism" at least in some examples refers to input processing techniques for neural networks that allow the neural network to focus on specific aspects of a complex input, one at a time until the entire dataset is categorized. The goal is to break down complicated tasks into smaller areas of attention that are processed sequentially. Similar to how the human mind solves a new problem by dividing it into simpler tasks and solving them one by one. The term "attention network" at least in some examples refers to an artificial neural networks used for attention in machine learning. The term "self-attention" at least in some examples refers to an attention mechanism relating different positions of a single sequence in order to compute a representation of the sequence. Additionally or alternatively, the term "self-attention" at least in some examples refers to an attention mechanism applied to a single context instead of across multiple contexts wherein queries, keys, and values are extracted from the same context.

The term "backpropagation" at least in some examples refers to a method used in NNs to calculate a gradient that is needed in the calculation of weights to be used in the NN; "backpropagation" is shorthand for "the backward propagation of errors." Additionally or alternatively, the term "backpropagation" at least in some examples refers to a method of calculating the gradient of neural network parameters. Additionally or alternatively, the term "backpropagation" or "back pass" at least in some examples refers to a method of traversing a neural network in reverse order, from the output to the input layer.

The term "Bayesian optimization" at least in some examples refers to a sequential design strategy for global optimization of black-box functions that does not assume any functional forms. Additionally or alternatively, the term "Bayesian optimization" at least in some examples refers to an optimization technique based upon the minimization of an expected deviation from an extremum. At least in some examples, Bayesian optimization minimizes an objective function by building a probability model based on past evaluation results of the objective.

The term "classification" in the context of machine learning at least in some examples refers to an ML technique for determining the classes to which various data points belong. Here, the term "class" or "classes" at least in some examples refers to categories, and are sometimes called "targets" or "labels." Classification is used when the outputs are restricted to a limited set of quantifiable properties. Classification algorithms may describe an individual (data) instance whose category is to be predicted using a feature vector. As an example, when the instance includes a collection (corpus) of text, each feature in a feature vector may be the frequency that specific words appear in the corpus of text. In ML classification, labels are assigned to instances, and models are trained to correctly predict the pre-assigned labels of from the training examples. ML algorithms for classification may be referred to as a "classifier." Examples of classifiers include linear classifiers, k-nearest neighbor (kNN), decision trees, random forests, support vector machines (SVMs), Bayesian classifiers, convolutional neural networks (CNNs), among many others (note that some of these algorithms can be used for other ML tasks as well).

The term "computational graph" at least in some examples refers to a data structure that describes how an output is produced from one or more inputs.

The term "converge" or "convergence" at least in some examples refers to the stable point found at the end of a sequence of solutions via an iterative optimization algorithm. Additionally or alternatively, the term "converge" or "convergence" at least in some examples refers to the output of a function or algorithm getting closer to a specific value over multiple iterations of the function or algorithm.

The term "convolution" at least in some examples refers to a convolutional operation or a convolutional layer of a CNN. The term "convolutional layer" at least in some examples refers to a layer of a DNN in which a convolutional filter passes along an input matrix (e.g., a CNN). Additionally or alternatively, the term "convolutional layer" at least in some examples refers to a layer that includes a series of convolutional operations, each acting on a different slice of an input matrix. The term "convolutional neural network" or "CNN" at least in some examples refers to a neural network including at least one convolutional layer. Additionally or alternatively, the term "convolutional neural network" or "CNN" at least in some examples refers to a DNN designed to process structured arrays of data such as images.

The term "covariance" at least in some examples refers to a measure of the joint variability of two random variables, wherein the covariance is positive if the greater values of one variable mainly correspond with the greater values of the other variable (and the same holds for the lesser values such that the variables tend to show similar behavior), and the covariance is negative when the greater values of one variable mainly correspond to the lesser values of the other.

The term "ensemble averaging" at least in some examples refers to the process of creating multiple models and combining them to produce a desired output, as opposed to creating just one model. The term "ensemble learning" or "ensemble method" at least in some examples refers to using multiple learning algorithms to obtain better predictive performance than could be obtained from any of the constituent learning algorithms alone.

The term "epoch" at least in some examples refers to one cycle through a full training dataset. Additionally or alternatively, the term "epoch" at least in some examples refers to a full training pass over an entire training dataset such that each training example has been seen once; here, an epoch represents N/batch size training iterations, where N is the total number of examples.

The term "event", in probability theory, at least in some examples refers to a set of outcomes of an experiment (e.g., a subset of a sample space) to which a probability is assigned. Additionally or alternatively, the term "event" at least in some examples refers to a software message indicating that something has happened. Additionally or alternatively, the term "event" at least in some examples refers to an object in time, or an instantiation of a property in an object. Additionally or alternatively, the term "event" at least in some examples refers to a point in space at an instant in time (e.g., a location in space-time). Additionally or alternatively, the term "event" at least in some examples refers to a notable occurrence at a particular point in time.

The term "feature" at least in some examples refers to an individual measureable property, quantifiable property, or characteristic of a phenomenon being observed. Additionally or alternatively, the term "feature" at least in some examples refers to an input variable used in making predictions. At least in some examples, features may be represented using numbers/numerals (e.g., integers), strings, variables, ordinals, real-values, categories, and/or the like. The term "feature extraction" at least in some examples refers to a process of dimensionality reduction by which an initial set of raw data is reduced to more manageable groups for processing. Additionally or alternatively, the term "feature extraction" at least in some examples refers to retrieving intermediate feature representations calculated by an unsupervised model or a pretrained model for use in another model as an input. Feature extraction is sometimes used as a synonym of "feature engineering." The term "feature vector" at least in some examples, in the context of ML, refers to a set of features and/or a list of feature values representing an example passed into a model. Additionally or alternatively, the term "feature vector" at least in some examples, in the context of ML, refers to a vector that includes a tuple of one or more features.

The term "forward propagation" or "forward pass" at least in some examples, in the context of ML, refers to the calculation and storage of intermediate variables (including outputs) for a neural network in order from the input layer to the output layer.

The term "hidden layer", in the context of ML and NNs, at least in some examples refers to an internal layer of neurons in an ANN that is not dedicated to input or output. The term "hidden unit" refers to a neuron in a hidden layer in an ANN.

The term "hyperparameter" at least in some examples refers to characteristics, properties, and/or parameters for an ML process that cannot be learnt during a training process. Hyperparameter are usually set before training takes place, and may be used in processes to help estimate model parameters. Examples of hyperparameters include model size (e.g., in terms of memory space, bytes, number of layers, and the like); training data shuffling (e.g., whether to do so and by how much); number of evaluation instances, iterations, epochs (e.g., a number of iterations or passes over the training data), or episodes; number of passes over training data; regularization; learning rate (e.g., the speed at which the algorithm reaches (converges to) optimal weights); learning rate decay (or weight decay); momentum; number of hidden layers; size of individual hidden layers; weight initialization scheme; dropout and gradient clipping thresholds; the C value and sigma value for SVMs; the k in k-nearest neighbors; number of branches in a decision tree; number of clusters in a clustering algorithm; vector size; word vector size for NLP and NLU; and/or the like.

The term "inference engine" at least in some examples refers to a component of a computing system that applies logical rules to a knowledge base to deduce new information. The term "intelligent agent" at least in some examples refers to a software agent or other autonomous entity which acts, directing its activity towards achieving goals upon an environment using observation through sensors and consequent actuators (i.e. it is intelligent). Intelligent agents may also learn or use knowledge to achieve their goals.

The terms "instance-based learning" or "memory-based learning" in the context of ML at least in some examples refers to a family of learning algorithms that, instead of performing explicit generalization, compares new problem instances with instances seen in training, which have been stored in memory. Examples of instance-based algorithms include k-nearest neighbor, and the like), decision tree Algorithms (e.g., Classification And Regression Tree (CART), Iterative Dichotomiser 3 (ID3), C4.5, chi-square automatic interaction detection (CHAID), and the like), Fuzzy Decision Tree (FDT), and the like), Support Vector Machines (SVM), Bayesian Algorithms (e.g., Bayesian network (BN), a dynamic BN (DBN), Naive Bayes, and the like), and ensemble algorithms (e.g., Extreme Gradient Boosting, voting ensemble, bootstrap aggregating ("bagging"), Random Forest and the like).

The term "iteration" at least in some examples refers to the repetition of a process in order to generate a sequence of outcomes, wherein each repetition of the process is a single iteration, and the outcome of each iteration is the starting point of the next iteration. Additionally or alternatively, the term "iteration" at least in some examples refers to a single update of a model's weights during training.

The term "Kullback-Leibler divergence" at least in some examples refers to a measure of how one probability distribution is different from a reference probability distribution. The "Kullback-Leibler divergence" may be a useful distance measure for continuous distributions and is often useful when performing direct regression over the space of (discretely sampled) continuous output distributions. The term "Kullback-Leibler divergence" may also be referred to as "relative entropy".

The term "loss function" or "cost function" at least in some examples refers to an event or values of one or more variables onto a real number that represents some "cost" associated with the event. A value calculated by a loss function may be referred to as a "loss" or "error". Additionally or alternatively, the term "loss function" or "cost function" at least in some examples refers to a function used to determine the error or loss between the output of an algorithm and a target value. Additionally or alternatively, the term "loss function" or "cost function" at least in some examples refers to a function are used in optimization problems with the goal of minimizing a loss or error.

The term "mathematical model" at least in some examples refer to a system of postulates, data, and inferences presented as a mathematical description of an entity or state of affairs including governing equations, assumptions, and constraints. The term "statistical model" at least in some examples refers to a mathematical model that embodies a set of statistical assumptions concerning the generation of sample data and/or similar data from a population; in some examples, a "statistical model" represents a data-generating process.

The term "machine learning" or "ML" at least in some examples refers to the use of computer systems to optimize a performance criterion using example (training) data and/or past experience. ML involves using algorithms to perform specific task(s) without using explicit instructions to perform the specific task(s), and/or relying on patterns, predictions, and/or inferences. ML uses statistics to build ML model(s) (also referred to as "models") in order to make predictions or decisions based on sample data (e.g., training data).

The term "machine learning model" or "ML model" at least in some examples refers to an application, program, process, algorithm, and/or function that is capable of making predictions, inferences, or decisions based on an input data set and/or is capable of detecting patterns based on an input data set. In some examples, a "machine learning model" or "ML model" is trained on a training data to detect patterns and/or make predictions, inferences, and/or decisions. In some examples, a "machine learning model" or "ML model" is based on a mathematical and/or statistical model. For purposes of the present disclosure, the terms "ML model", "AI model", "AI/ML model", and the like may be used interchangeably.

The term "machine learning algorithm" or "ML algorithm" at least in some examples refers to an application, program, process, algorithm, and/or function that builds or estimates an ML model based on sample data or training data. Additionally or alternatively, the term "machine learning algorithm" or "ML algorithm" at least in some examples refers to a program, process, algorithm, and/or function that learns from experience w.r.t some task(s) and some performance measure(s)/metric(s), and an ML model is an object or data structure created after an ML algorithm is trained with training data. For purposes of the present disclosure, the terms "ML algorithm", "AI algorithm", "AI/ML algorithm", and the like may be used interchangeably. Additionally, although the term "ML algorithm" may refer to different concepts than the term "ML model," these terms may be used interchangeably for the purposes of the present disclosure.

The term "machine learning application" or "ML application" at least in some examples refers to an application, program, process, algorithm, and/or function that contains some AI/ML model(s) and application-level descriptions. Additionally or alternatively, the term "machine learning application" or "ML application" at least in some examples refers to a complete and deployable application and/or package that includes at least one ML model and/or other data capable of achieving a certain function and/or performing a set of actions or tasks in an operational environment. For purposes of the present disclosure, the terms "ML application", "AI application", "AI/ML application", and the like may be used interchangeably.

The term "matrix" at least in some examples refers to a rectangular array of numbers, symbols, or expressions, arranged in rows and columns, which may be used to represent an object or a property of such an object.

The terms "model parameter" and/or "parameter" in the context of ML, at least in some examples refer to values, characteristics, and/or properties that are learnt during training. Additionally or alternatively, "model parameter" and/or "parameter" in the context of ML, at least in some examples refer to a configuration variable that is internal to the model and whose value can be estimated from the given data. Model parameters are usually required by a model when making predictions, and their values define the skill of the model on a particular problem. Examples of such model parameters/parameters include weights (e.g., in an ANN); constraints; support vectors in a support vector machine (SVM); coefficients in a linear regression and/or logistic regression; word frequency, sentence length, noun or verb distribution per sentence, the number of specific character n-grams per word, lexical diversity, and the like, for natural language processing (NLP) and/or natural language understanding (NLU); and/or the like.

The term "objective function" at least in some examples refers to a function to be maximized or minimized for a specific optimization problem. In some cases, an objective function is defined by its decision variables and an objective. The objective is the value, target, or goal to be optimized, such as maximizing profit or minimizing usage of a particular resource. The specific objective function chosen depends on the specific problem to be solved and the objectives to be optimized. Constraints may also be defined to restrict the values the decision variables can assume thereby influencing the objective value (output) that can be achieved. During an optimization process, an objective function's decision variables are often changed or manipulated within the bounds of the constraints to improve the objective function's values. In general, the difficulty in solving an objective function increases as the number of decision variables included in that objective function increases. The term "decision variable" refers to a variable that represents a decision to be made.

The term "optimization" at least in some examples refers to an act, process, or methodology of making something (e.g., a design, system, or decision) as fully perfect, functional, or effective as possible. Optimization usually includes mathematical procedures such as finding the maximum or minimum of a function. The term "optimal" at least in some examples refers to a most desirable or satisfactory end, outcome, or output. The term "optimum" at least in some examples refers to an amount or degree of something that is most favorable to some end. The term "optima" at least in some examples refers to a condition, degree, amount, or compromise that produces a best possible result. Additionally or alternatively, the term "optima" at least in some examples refers to a most favorable or advantageous outcome or result.

The term "probability" at least in some examples refers to a numerical description of how likely an event is to occur and/or how likely it is that a proposition is true. The term "probability distribution" at least in some examples refers to a mathematical function that gives the probabilities of occurrence of different possible outcomes for an experiment or event. Additionally or alternatively, the term "probability distribution" at least in some examples refers to a statistical function that describes all possible values and likelihoods that a random variable can take within a given range (e.g., a bound between minimum and maximum possible values). A probability distribution may have one or more factors or attributes such as, for example, a mean or average, mode, support, tail, head, median, variance, standard deviation, quantile, symmetry, skewness, kurtosis, and the like. A probability distribution may be a description of a random phenomenon in terms of a sample space and the probabilities of events (subsets of the sample space). Example probability distributions include discrete distributions (e.g., Bernoulli distribution, discrete uniform, binomial, Dirac measure, Gauss-Kuzmin distribution, geometric, hypergeometric, negative binomial, negative hypergeometric, Poisson, Poisson binomial, Rademacher distribution, Yule-Simon distribution, zeta distribution, Zipf distribution, and the like), continuous distributions (e.g., Bates distribution, beta, continuous uniform, normal distribution, Gaussian distribution, bell curve, joint normal, gamma, chi-squared, non-central chi-squared, exponential, Cauchy, lognormal, logit-normal, F distribution, t distribution, Dirac delta function, Pareto distribution, Lomax distribution, Wishart distribution, Weibull distribution, Gumbel distribution, Irwin-Hall distribution, Gompertz distribution, inverse Gaussian distribution (or Wald distribution), Chernoff's distribution, Laplace distribution, Pólya-Gamma distribution, and the like), and/or joint distributions (e.g., Dirichlet distribution, Ewens's sampling formula, multinomial distribution, multivariate normal distribution, multivariate t-distribution, Wishart distribution, matrix normal distribution, matrix t distribution, and the like).

The term "probability density function" or "PDF" at least in some examples refers to a function whose value at any given sample (or point) in a sample space can be interpreted as providing a relative likelihood that the value of the random variable would be close to that sample. Additionally or alternatively, the term "probability density function" or "PDF" at least in some examples refers to a probability of a random variable falling within a particular range of values. Additionally or alternatively, the term "probability density function" or "PDF" at least in some examples refers to a value at two different samples can be used to infer, in any particular draw of the random variable, how much more likely it is that the random variable would be close to one sample compared to the other sample.

The term "precision" at least in some examples refers to the closeness of the two or more measurements to each other. The term "precision" may also be referred to as "positive predictive value". The term "quantile" at least in some examples refers to a cut point(s) dividing a range of a probability distribution into continuous intervals with equal probabilities, or dividing the observations in a sample in the same way. The term "quantile function" at least in some examples refers to a function that is associated with a probability distribution of a random variable, and the specifies the value of the random variable such that the probability of the variable being less than or equal to that value equals the given probability. The term "quantile function" may also be referred to as a percentile function, percent-point function, or inverse cumulative distribution function.

The term "recall" at least in some examples refers to the fraction of relevant instances that were retrieved, or he number of true positive predictions or inferences divided by the number of true positives plus false negative predictions or inferences. The term "recall" may also be referred to as "sensitivity".

The terms "regression algorithm" and/or "regression analysis" in the context of ML at least in some examples refers to a set of statistical processes for estimating the relationships between a dependent variable (often referred to as the "outcome variable") and one or more independent variables (often referred to as "predictors", "covariates", or "features"). Examples of regression algorithms/models include logistic regression, linear regression, gradient descent (GD), stochastic GD (SGD), and the like.

The term "reinforcement learning" or "RL" at least in some examples refers to a goal-oriented learning technique based on interaction with an environment. In RL, an agent aims to optimize a long-term objective by interacting with the environment based on a trial and error process. Examples of RL algorithms include Markov decision process, Markov chain, Q-learning, multi-armed bandit learning, temporal difference learning, and deep RL. The term "reward function", in the context of RL, at least in some examples refers to a function that outputs a reward value based on one or more reward variables; the reward value provides feedback for an RL policy so that an RL agent can learn a desirable behavior. The term "reward shaping", in the context of RL, at least in some examples refers to a adjusting or altering a reward function to output a positive reward for desirable behavior and a negative reward for undesirable behavior.

The term "sample space" in probability theory (also referred to as a "sample description space" or "possibility space") of an experiment or random trial at least in some examples refers to a set of all possible outcomes or results of that experiment. The term "search space", in the context of optimization, at least in some examples refers to an a domain of a function to be optimized. Additionally or alternatively, the term "search space", in the context of search algorithms, at least in some examples refers to a feasible region defining a set of all possible solutions. Additionally or alternatively, the term "search space" at least in some examples refers to a subset of all hypotheses that are consistent with the observed training examples. Additionally or alternatively, the term "search space" at least in some examples refers to a version space, which may be developed via machine learning.

The term "softmax" or "softmax function" at least in some examples refers to a generalization of the logistic function to multiple dimensions; the "softmax function" is used in multinomial logistic regression and is often used as the last activation function of a neural network to normalize the output of a network to a probability distribution over predicted output classes.

The term "supervised learning" at least in some examples refers to an ML technique that aims to learn a function or generate an ML model that produces an output given a labeled data set. Supervised learning algorithms build models from a set of data that contains both the inputs and the desired outputs. For example, supervised learning involves learning a function or model that maps an input to an output based on example input-output pairs or some other form of labeled training data including a set of training examples. Each input-output pair includes an input object (e.g., a vector) and a desired output object or value (referred to as a "supervisory signal"). Supervised learning can be grouped into classification algorithms, regression algorithms, and instance-based algorithms.

The term "standard deviation" at least in some examples refers to a measure of the amount of variation or dispersion of a set of values. Additionally or alternatively, the term "standard deviation" at least in some examples refers to the square root of a variance of a random variable, a sample, a statistical population, a dataset, or a probability distribution.

The term "stochastic" at least in some examples refers to a property of being described by a random probability distribution. Although the terms "stochasticity" and "randomness" are distinct in that the former refers to a modeling approach and the latter refers to phenomena themselves, for purposes of the present disclosure these two terms may be used synonymously unless the context indicates otherwise.

The term "tensor" at least in some examples refers to an object or other data structure represented by an array of components that describe functions relevant to coordinates of a space. Additionally or alternatively, the term "tensor" at least in some examples refers to a generalization of vectors and matrices and/or may be understood to be a multidimensional array. Additionally or alternatively, the term "tensor" at least in some examples refers to an array of numbers arranged on a regular grid with a variable number of axes. At least in some examples, a tensor can be defined as a single point, a collection of isolated points, or a continuum of points in which elements of the tensor are functions of position, and the Tensor forms a "tensor field". At least in some examples, a vector may be considered as a one dimensional (1D) or first order tensor, and a matrix may be considered as a two dimensional (2D) or second order tensor. Tensor notation may be the same or similar as matrix notation with a capital letter representing the tensor and lowercase letters with subscript integers representing scalar values within the tensor.

The term "unsupervised learning" at least in some examples refers to an ML technique that aims to learn a function to describe a hidden structure from unlabeled data. Unsupervised learning algorithms build models from a set of data that contains only inputs and no desired output labels. Unsupervised learning algorithms are used to find structure in the data, like grouping or clustering of data points. Examples of unsupervised learning are K-means clustering, principal component analysis (PCA), and topic modeling, among many others. The term "semi-supervised learning at least in some examples refers to ML algorithms that develop ML models from incomplete training data, where a portion of the sample input does not include labels.

The term "vector" at least in some examples refers to a one-dimensional array data structure. Additionally or alternatively, the term "vector" at least in some examples refers to a tuple of one or more values called scalars.

The term "fabrication" at least in some examples refers to the creation of a metal structure using fabrication means. The term "fabrication means" as used herein refers to any suitable tool or machine that is used during a fabrication process and may involve tools or machines for cutting (e.g., using manual or powered saws, shears, chisels, routers, torches including handheld torches such as oxy-fuel torches or plasma torches, and/or computer numerical control (CNC) cutters including lasers, mill bits, torches, water jets, routers, and the like), bending (e g, manual, powered, or CNC hammers, pan brakes, press brakes, tube benders, roll benders, specialized machine presses, and the like), assembling (e.g., by welding, soldering, brazing, crimping, coupling with adhesives, riveting, using fasteners, and the like), molding or casting (e.g., die casting, centrifugal casting, injection molding, extrusion molding, matrix molding, three-dimensional (3D) printing techniques including fused deposition modeling, selective laser melting, selective laser sintering, composite filament fabrication, fused filament fabrication, stereolithography, directed energy deposition, electron beam freeform fabrication, and the like), and PCB and/or semiconductor manufacturing techniques (e.g., silk-screen printing, photolithography, photoengraving, PCB milling, laser resist ablation, laser etching, plasma exposure, atomic layer deposition (ALD), molecular layer deposition (MLD), chemical vapor deposition (CVD), rapid thermal processing (RTP), and/or the like).

The term "fastener", "fastening means", or the like at least in some examples refers to a device that mechanically joins or affixes two or more objects together, and may include threaded fasteners (e.g., bolts, screws, nuts, threaded rods, and the like), pins, linchpins, r-clips, clips, pegs, clamps, dowels, cam locks, latches, catches, ties, hooks, magnets, molded or assembled joineries, and/or the like.

The terms "flexible," "flexibility," and/or "pliability" at least in some examples refer to the ability of an object or material to bend or deform in response to an applied force; "the term "flexible" is complementary to "stiffness." The term "stiffness" and/or "rigidity" refers to the ability of an object to resist deformation in response to an applied force. The term "elasticity" refers to the ability of an object or material to resist a distorting influence or stress and to return to its original size and shape when the stress is removed. Elastic modulus (a measure of elasticity) is a property of a material, whereas flexibility or stiffness is a property of a structure or component of a structure and is dependent upon various physical dimensions that describe that structure or component.

The term "wear" at least in some examples refers to the phenomenon of the gradual removal, damaging, and/or displacement of material at solid surfaces due to mechanical processes (e.g., erosion) and/or chemical processes (e.g., corrosion). Wear causes functional surfaces to degrade, eventually leading to material failure or loss of functionality. The term "wear" at least in some examples also includes other processes such as fatigue (e.g., he weakening of a material caused by cyclic loading that results in progressive and localized structural damage and the growth of cracks) and creep (e.g., the tendency of a solid material to move slowly or deform permanently under the influence of persistent mechanical stresses). Mechanical wear may occur as a result of relative motion occurring between two contact surfaces. Wear that occurs in machinery components has the potential to cause degradation of the functional surface and ultimately loss of functionality. Various factors, such as the type of loading, type of motion, temperature, lubrication, and the like may affect the rate of wear.

The term "fluid" at least in some examples refers to a deformable material (e.g., liquid, gas, supercritical fluid, slurries, powders, masses of small solids, and/or the like) that is capable of flowing under an applied shear stress and/or some other external force.

The term "recoverable material" at least in some examples refers to any material, or combination or materials, that can be collected and processed for resale, reuse, and/or recycling of the material, and/or for some other purpose. For purposes of the present disclosure, the term "recoverable material" may be used interchangeably with the terms "recyclable material", "commodity material", and/or the like.

Aspects of the inventive subject matter may be referred to herein, individually and/or collectively, merely for convenience and without intending to voluntarily limit the scope of this application to any single aspect or inventive concept if more than one is in fact disclosed. Although specific embodiments, implementations, features, functions, elements, properties, configurations, arrangements, and/or other aspects have been shown and described herein, the present disclosure is intended to cover any and all combinations, subcombinations, adaptations, variations, and/or equivalents of the disclosed embodiments, implementations, features, functions, elements, properties, configurations, arrangements, and/or other aspects.

The invention claimed is:

1. One or more non-transitory computer readable medium (NTCRM) comprising instructions, wherein execution of the instructions by controller circuitry of a material recovery facility (MRF) is to cause the controller circuitry to:

receive data streams from respective MRF components of a plurality of MRF components deployed at various locations in the MRF, wherein the plurality of MRF components includes a set of sensors and a set of material handling units (MHUs);

process the data streams to determine an MRF status of the MRF, wherein the MRF status is based on a composition of a material stream at one or more locations within the MRF and an operating condition of at least one MRF component of the plurality of MRF components, and wherein the composition of the material stream is based on identification and classification of objects within the material streams;

determine an MRF arrangement of the plurality of MRF components based on the MRF status, wherein the MRF arrangement of the plurality of MRF components optimizes recovery and/or purity of at least one targetable material from the material stream; and retask an individual MHU of the set of MHUs, and to retask the individual MHU, execution of the instructions is to cause the control circuitry to: cause the individual MHU to move from a current location within the MRF to a different location within the MRF.

2. The NTCRM of claim 1, wherein the data streams include a set of sensor data generated by respective sensors of the set of sensors and MHU status information generated by respective MHUs of the set of MHUs.

3. The NTCRM of claim 1, wherein, execution of the instructions is to cause the controller circuitry to:

retask a sensor of the set of sensors to collect a different type of sensor data; or report collected sensor data at a different interval.

4. The NTCRM of claim 1, wherein, execution of the instructions is to cause the controller circuitry to:

control at least one MRF component of the plurality of MRF components to change its operation within the MRF according to the determined MRF arrangement.

5. The NTCRM of claim 1, wherein the individual MHU is a sorter and, to retask the MHU, execution of the instructions is to cause the controller circuitry to:

retask the sorter from recovering at least one material different than the at least one targetable material to recover the at least one targetable material from the material stream.

6. The NTCRM of claim 1, wherein the individual MHU is a sorter and, to retask the MHU, execution of the instructions is to cause the controller circuitry to:

cause the sorter to use a selected sorting mechanism to recover the at least one targetable material from the material stream.

7. The NTCRM of claim 1, wherein, to retask the MHU, execution of the instructions is to cause the controller circuitry to:

cause the individual MHU to move from a current location within the MRF to a service center when an operating condition of the MHUs indicates that service is needed.

8. The NTCRM of claim 1, wherein the individual MHU is a conveyor system and, to retask the MHU, execution of the instructions is to cause the controller circuitry to:

cause the conveyor system to change a speed, direction, or orientation of a conveyor mechanism of the conveyor system.

9. The NTCRM of claim 1, wherein the individual MHU is a baling system and, to retask the MHU, execution of the instructions is to cause the controller circuitry to:

cause the baling system to change a baling process based on a composition of the material stream.

10. The NTCRM of claim 9, wherein, to retask the MHU, execution of the instructions is to cause the controller circuitry to:

cause the baling system to queue material bales based on material composition such that individual material bales have different purity levels.

11. The NTCRM of claim 1, wherein the individual MHU is an infeed system and, to retask the MHU, execution of the instructions is to cause the controller circuitry to:

autonomously control the infeed system to infeed different combinations of materials to achieve semi-homogeneous material distribution.

12. The NTCRM of claim 1, wherein the individual MHU is a sorter and, to retask the MHU, execution of the instructions is to cause the controller circuitry to:

cause the sorter to activate or deactivate one or more sorting technologies to optimize resource consumption by the MRE.

13. The NTCRM of claim 1, wherein execution of the instructions is to cause the controller circuitry to implement a machine learning model to:

perform the identification and classification of objects within the material stream based on the data streams.

14. The NTCRM of claim 1, wherein execution of the instructions is to cause the controller circuitry to operate a machine learning model to determine the MRF arrangement.

15. The NTCRM of claim 1, wherein the MRF arrangement is based on a flow the material stream to one or more MHUs of the set of MHUs to achieve load balancing among the set of MHUs.

16. The NTCRM of claim 1, wherein: the set of MHUs include one or more of a conveyor, a mechanical sorter, a robotic sorter, an optical sorter, an air sorter, a baler sorter, and an automated quality control (AQC) sorter; and the set of sensors include one or more of an infrared (IR) light sensor, an IR spectrometer, an ultraviolet (UV) light sensor, an x-ray sensor, a visible light sensor, a magnetometer, a chemical sensor, an inductive sensor, a load cell, a density sensor, a speed sensor, an inclinometer, an accelerometer, a moisture sensor, a laser measurement device, a current sensor, a pressure transducer, a temperature sensor, and a flow meter.

17. The NTCRM of claim 1, wherein the controller circuitry includes one or more of a multi-core processor, microcontroller, an application-specific integrated circuit, field-programmable gate array, a digital signal processor, a digital signal controller, an electronic control unit, a programmable logic device, a cryptoprocessor, a hardware accelerator, and a graphics processor.

18. A compute node of a material recovery facility (MRF), comprising:

interface circuitry to receive data streams from respective MRF components of a plurality of MRF components deployed at various locations in the MRF; and processor circuitry connected to the interface circuitry, wherein the processor circuitry is to:

process the data streams to determine an MRF status of the MRF, wherein the MRF status is based on a composition of a material stream at one or more locations within the MRF and an operating condition of at least one MRF component of the plurality of MRF components, and wherein the composition of the material stream is based on identification and classification of objects within the material streams;

determine an MRF arrangement of the plurality of MRF components based on the MRF status, wherein the MRF arrangement of the plurality of MRF components optimizes recovery and/or purity of at least one targetable material from the material stream; and retask the at least one MRF component including: cause the at least one MRF component to move from a current location within the MRF to a service center when the operating condition of the at least one MRF component indicates that service is needed.

19. The compute node of claim 18, wherein the plurality of MRF components includes a set of sensors and a set of material handling units (MHUs), and wherein:

the set of MHUs include one or more of a conveyor, a mechanical sorter, a robotic sorter, an optical sorter, an air sorter, a baler sorter, and an automated quality control (AQC) sorter;

the set of sensors include one or more of an infrared (IR) light sensor, an IR spectrometer, an ultraviolet (UV) light sensor, an x-ray sensor, a visible light sensor, a magnetometer, a chemical sensor, an inductive sensor, a load cell, a density sensor, a speed sensor, an inclinometer, an accelerometer, a moisture sensor, a laser measurement device, a current sensor, a pressure transducer, a temperature sensor, and a flow meter; and the processor circuitry includes one or more of a multi-core processor, microcontroller, application-specific integrated circuit, field-programmable gate array, digital signal processor, digital signal controller, electronic control units, programmable logic devices, a crypto processor, hardware accelerator, and a graphics processor.

20. The compute node of claim 18, wherein the processor circuitry is to:

cause the at least one MRF component to move from a current location within the MRF to a different location within the MRF.

* * * * *